US007381880B2

(12) United States Patent
Fujiwara et al.

(10) Patent No.: US 7,381,880 B2
(45) Date of Patent: Jun. 3, 2008

(54) MUSICAL INSTRUMENT RECORDING ADVANCED MUSIC DATA CODES FOR PLAYBACK, MUSIC DATA GENERATOR AND MUSIC DATA SOURCE FOR THE MUSICAL INSTRUMENT

(75) Inventors: Yuji Fujiwara, Hamamatsu (JP); Taro Kawabata, Hamamatsu (JP)

(73) Assignee: Yamaha Corporation, Hamamatsu-Shi (JP)

( * ) Notice: Subject to any disclaimer, the term of this patent is extended or adjusted under 35 U.S.C. 154(b) by 505 days.

(21) Appl. No.: 10/971,975

(22) Filed: Oct. 21, 2004

(65) Prior Publication Data

US 2005/0092164 A1 May 5, 2005

(30) Foreign Application Priority Data

| | | |
|---|---|---|
| Oct. 31, 2003 | (JP) | 2003-372656 |
| Oct. 31, 2003 | (JP) | 2003-372657 |
| Oct. 31, 2003 | (JP) | 2003-372658 |
| Aug. 6, 2004 | (JP) | 2004-231013 |
| Aug. 6, 2004 | (JP) | 2004-231014 |
| Aug. 6, 2004 | (JP) | 2004-231015 |

(51) Int. Cl.
*G10H 1/00* (2006.01)

(52) U.S. Cl. ..... 84/615; 84/653; 84/626; 84/633

(58) Field of Classification Search ..... 84/600–602, 84/615, 626, 633, 653, 658
See application file for complete search history.

(56) References Cited

U.S. PATENT DOCUMENTS

| | | | | |
|---|---|---|---|---|
| 5,001,339 | A | 3/1991 | Starkey | |
| 5,293,311 | A * | 3/1994 | Takauji | 84/659 |
| 6,075,196 | A | 6/2000 | Fujiwara | |
| 6,245,985 | B1 | 6/2001 | Sasaki | |
| 6,359,207 | B1 | 3/2002 | Oba | |

FOREIGN PATENT DOCUMENTS

EP 0747876 A2 12/1996

* cited by examiner

*Primary Examiner*—Lincoln Donovan
*Assistant Examiner*—David S. Warren
(74) *Attorney, Agent, or Firm*—Morrison & Foerster LLP

(57) ABSTRACT

In order to precisely express motion of a key or motion of a hammer, a voice message for the polyphonic key pressure and another voice message for the control change, which stand idle in an automatic player piano, are used to express rough key position or rough hammer position and an offset from the rough key position or rough hammer position, and the offset is described at a high resolution on an ordinary trajectory between the rest position and the end position and at a low resolution outside of the ordinary trajectory; moreover, the numerical range expressed by the third byte of the voice message for the polyphonic key pressure is divided into two numerical sub-ranges respectively assigned to the keys and hammers so that only a few voice messages are required.

25 Claims, 35 Drawing Sheets

| | 1st. BYTE | 2nd. BYTE | 3rd. BYTE | HEXADECIMAL NOTATION |
|---|---|---|---|---|
| BASIC DATA | 1010nnnn | 0kkkkkkk | 0xxxxxxx | [An kk xx] |
| EXTENDED DATA | 1011nnnn | 00010000 | 0yyyyyyy | [Bn 10 yy] |

| | | |
|---|---|---|
| Basic Positioning Data [An kk xx] | | |
| | Numerical range of [xx] | From [40h] to [70h] |
| | Stroke of each digit | 1.0 millimeter |
| | Minimum stroke | [xx]=[40h] =0mm at rest position |
| | Maximum stroke | [xx]=[70h]=48 mm at end position |
| Extended Positioning Data [Bn 10 yy] | | |
| | Numerical range of [yy] | From [00h] to [7Fh] |
| | Numerical range of [xx] at high resolution | [40h] < [xx] < [70h] |
| | Stroke of each digit | 1/ 64 mm |
| | Maximum decrement | [yy]=[40h]=-64/64mm =-1 mm |
| | Reference position | [yy]=[00h]= 0 mm |
| | Maximum increment | [yy]=[3Fh]=+63/64mm =+0.984375mm |
| | Numerical range of [xx] at low resolution | [xx] = [40h] or [xx] = [70h] |
| | Stroke of each digit | 1/ 4 mm |
| | Maximum decrement | [yy]=[40h]= -64/4 mm = -16mm |
| | Reference position | [yy] = [00h]= 0 mm |
| | Maximum increment | [yy]= [3Fh]=+63/ 4 mm = +15.75mm |

Fig. 7 A

| | | |
|---|---|---|
| Basic Positioning Data [An kk xx] | | |
| | Numerical range of [xx] | From [01h] to [30h] |
| | Stroke of each digit | 0.225 millimeter |
| | Minimum stroke | [xx]=[01h] =0.225mm inside of rest position |
| | Maximum stroke | [xx]=[30h]=10.8 mm outside of end position |
| Extended Positioning Data [Bn 10 yy] | | |
| | Numerical range of [yy] | From [00h] to [7Fh] |
| | Numerical range of [xx] at high resolution | [01h] < [xx] < [30h] |
| | Stroke of each digit | 0.225/64 mm |
| | Maximum decrement | [yy]=[40h]=-64×0.225/64mm =-0.225mm |
| | Reference position | [yy]=[00h]= 0 mm |
| | Maximum increment | [yy]=[3Fh]=+63×0.225/64mm =+0.221484375mm |
| | Numerical range of [xx] at low resolution | [xx] = [01h] or [xx] = [30h] |
| | Stroke of each digit | 0.225/4 mm |
| | Maximum decrement | [yy]=[40h]= -64×0.225/4 mm = -3.6mm |
| | Reference position | [yy] = [00h]= 0 mm |
| | Maximum increment | [yy]= [3Fh]=+63×0.225/4 mm=+3.54375mm |

Fig. 7 B

| | |
|---|---|
| Format Assigned to Positioning Data | [An kk xx] |
| Numerical Range of [xx] | [00h] to [7Fh] |
| Current Key Position outside of Rest Position | [00h] to [0Fh] |
| Resolution | about 0. 16 millimeter |
| Margin | about 2.5 millimeters |
| Current Key Position between Rest Position and End Position | [10h] to [6Fh] |
| Resolution | about 0.01 millimeter |
| Theoretical Full Keystroke | 10 millimeters, i.e., from zero to 10 millimeters |
| Current Key Position outside of End Position | [70h] to [7Fh] |
| Resolution | about 0.16 millimeter |
| Margin | about 2. 5 millimeters |

Fig. 8

Basic Positioning Data
[An kk xx]

| | |
|---|---|
| Numerical range of [xx] | From [40h] to [70h] |
| Stroke of each digit | 1.0 millimeter |
| Minimum stroke | [xx]=[40h] =0mm at rest position |
| Maximum stroke | [xx]=[70h]=48 mm at end position |

Extended Positioning Data [Bn 10 yy]

| | |
|---|---|
| Numerical range of [yy] | From [00h] to [7Fh] |
| Numerical range of [xx] at high resolution | [40h] < [xx] < [70h] |
| Stroke of each digit | 1/ 128 mm |
| Minimum increment | [yy]=[00h]= 0 mm |
| Maximum increment | [yy]=[7Fh]= 127/128 mm = 0.9921875 mm |
| Numerical range of [xx] at low resolution | [xx] = [40h] or [xx] = [70h] |
| Stroke of each digit | 1/ 8 mm |
| Minimum increment | [yy]=[00h]= 0 mm |
| Maximum increment | [yy]= [7Fh]= 127/ 8 mm = 15.875 mm |

Extended Positioning Data [Bn 11 yy]

| | |
|---|---|
| Numerical range of [yy] | From [00h] to [7Fh] |
| Numerical range of [xx] at high resolution | [40h] < [xx] < [70h] |
| Stroke of each digit | 1/ 128 mm |
| Maximum decrement | [yy]=[7Fh]=-127/128 mm =-0.9921875 mm |
| Minimum decrement | [yy]=[00h]= 0 mm |
| Numerical range of [xx] at low resolution | [xx] = [40h] or [xx] = [70h] |
| Stroke of each digit | 1/ 8 mm |
| Maximum decrement | [yy]=[7Fh]= -127/8mm = -15.875 mm |
| Minimum decrement | [yy]= [00h]= 0 mm |

Fig. 11A

Basic Positioning Data
[An kk xx]

| | |
|---|---|
| Numerical range of [xx] | From [00h] to [30h] |
| Stroke of each digit | 0.225 millimeter |
| Minimum stroke | [xx]=[00h] =0 mm at rest position |
| Maximum stroke | [xx]=[30h]=10.8 mm outside of end position |

Extended Positioning Data [Bn 10 yy]

| | |
|---|---|
| Numerical range of [yy] | From [00h] to [7Fh] |
| Numerical range of [xx] at high resolution | [00h] < [xx] < [30h] |
| Stroke of each digit | 0.225/128 mm |
| Minimum increment | [yy]=[00h]= 0 mm |
| Maximum increment | [yy]=[7Fh]= 127×0.225/128mm =0.2232421875mm |
| Numerical range of [xx] at low resolution | [xx] = [00h] or [xx] = [30h] |
| Stroke of each digit | 0.225/8 mm |
| Minimum increment | [yy]=[00h]= 0 mm |
| Maximum increment | [yy]= [7Fh]=127×0.225/8 mm=3.571875mm |

Extended Positioning Data [Bn 11 yy]

| | |
|---|---|
| Numerical range of [yy] | From [00h] to [7Fh] |
| Numerical range of [xx] at high resolution | [00h] < [xx] < [30h] |
| Stroke of each digit | 0.225/ 128 mm |
| Maximum decrement | [yy]=[7Fh]=-127×0.225/128 mm =-0.2232421875 mm |
| Minimum decrement | [yy]=[00h]= 0 mm |
| Numerical range of [xx] at low resolution | [xx] = [00h] or [xx] = [30h] |
| Stroke of each digit | 0.225/ 8 mm |
| Maximum decrement | [yy]=[7Fh]= -127×0.225/8mm = -3.571875 mm |
| Minimum decrement | [yy]= [00h]= 0 mm |

Fig. 11 B

| | 1st. BYTE | 2nd. BYTE | 3rd. BYTE | HEXADECIMAL NOTATION |
|---|---|---|---|---|
| BASIC DATA | 1010nnnn | 0kkkkkkk | 0xxxxxxx | [An kk xx] |
| EXTENDED DATA | 1011nnnn | 00010000 | 0yyyyyyy | [Bn 10 yy] |

Fig. 17

BASIC POSITIONING DATA [An kk xx]

| | |
|---|---|
| CURRENT KEY POSITION | xx=01h to 30h |
| CURRENT HAMMER POSITION | xx=40h to 70h |

EXTENDED POSITIONING DATA [Bn 10 yy]

| | |
|---|---|
| COMMON | yy= 00h to 7Fh |

Fig. 18

| | | |
|---|---|---|
| Basic Positioning Data [An kk xx] | Numerical range of [xx] | From [40h] to [70h] |
| | Stroke of each digit | 1.0 millimeter |
| | Minimum stroke | [xx]=[40h] =0mm at rest position |
| | Maximum stroke | [xx]=[70h]=48 mm at end position |
| Extended Positioning Data [Bn 10 yy] | Numerical range of [yy] | From [00h] to [7Fh] |
| | Numerical range of [xx] at high resolution | [40h] < [xx] < [70h] |
| | Stroke of each digit | 1/ 64 mm |
| | Maximum decrement | [yy]=[40h]=-64/64mm =-1 mm |
| | Reference position | [yy]=[00h]= 0 mm |
| | Maximum increment | [yy]=[3Fh]=+63/64mm =+0.984375mm |
| | Numerical range of [xx] at low resolution | [xx] = [40h] or [xx] = [70h] |
| | Stroke of each digit | 1/ 4 mm |
| | Maximum decrement | [yy]=[40h]= -64/4 mm = -16mm |
| | Reference position | [yy] = [00h]= 0 mm |
| | Maximum increment | [yy]= [3Fh]=+63/ 4 mm = +15.75mm |

Fig. 20A

| | | |
|---|---|---|
| Basic Positioning Data [An kk xx] | Numerical range of [xx] | From [01h] to [30h] |
| | Stroke of each digit | 0.225 millimeter |
| | Minimum stroke | [xx]=[01h] =0.225mm inside of rest position |
| | Maximum stroke | [xx]=[30h]=10.8 mm outside of end position |
| Extended Positioning Data [Bn 10 yy] | Numerical range of [yy] | From [00h] to [7Fh] |
| | Numerical range of [xx] at high resolution | [01h] < [xx] < [30h] |
| | Stroke of each digit | 0.225/64 mm |
| | Maximum decrement | [yy]=[40h]=-64×0.225/64mm =-0.225mm |
| | Reference position | [yy]=[00h]= 0 mm |
| | Maximum increment | [yy]=[3Fh]=+63×0.225/64mm =+0.221484375mm |
| | Numerical range of [xx] at low resolution | [xx] = [01h] or [xx] = [30h] |
| | Stroke of each digit | 0.225/4 mm |
| | Maximum decrement | [yy]=[40h]= -64×0.225/4 mm = -3.6mm |
| | Reference position | [yy] = [00h]= 0 mm |
| | Maximum increment | [yy]= [3Fh]=+63×0.225/4 mm=+3.54375mm |

Fig. 20B

Basic Positioning Data [An kk xx]

| | |
|---|---|
| Numerical range of [xx] | From [40h] to [70h] |
| Stroke of each digit | 1.0 millimeter |
| Minimum stroke | [xx]=[40h] =0mm at rest position |
| Maximum stroke | [xx]=[70h]=48 mm at end position |

Extended Positioning Data [Bn 10 yy]

| | |
|---|---|
| Numerical range of [yy] | From [00h] to [7Fh] |
| Numerical range of [xx] at high resolution | [40h] < [xx] < [70h] |
| Stroke of each digit | 1/ 128 mm |
| Minimum increment | [yy]=[00h]= 0 mm |
| Maximum increment | [yy]=[7Fh]= 127/128 mm = 0.9921875 mm |
| Numerical range of [xx] at low resolution | [xx] = [40h] or [xx] = [70h] |
| Stroke of each digit | 1/ 8 mm |
| Minimum increment | [yy]=[00h]= 0 mm |
| Maximum increment | [yy]= [7Fh]= 127/ 8 mm = 15.875 mm |

Extended Positioning Data [Bn 11 yy]

| | |
|---|---|
| Numerical range of [yy] | From [00h] to [7Fh] |
| Numerical range of [xx] at high resolution | [40h] < [xx] < [70h] |
| Stroke of each digit | 1/ 128 mm |
| Maximum decrement | [yy]=[7Fh]=-127/128 mm =-0.9921875 mm |
| Minimum decrement | [yy]=[00h]= 0 mm |
| Numerical range of [xx] at low resolution | [xx] = [40h] or [xx] = [70h] |
| Stroke of each digit | 1/ 8 mm |
| Maximum decrement | [yy]=[7Fh]= -127/8mm = -15.875 mm |
| Minimum decrement | [yy]= [00h]= 0 mm |

Fig. 23A

Basic Positioning Data
[An kk xx]

| | |
|---|---|
| Numerical range of [xx] | From [00h] to [30h] |
| Stroke of each digit | 0.225 millimeter |
| Minimum stroke | [xx]=[00h] =0 mm at rest position |
| Maximum stroke | [xx]=[30h]=10.8 mm outside of end position |

Extended Positioning Data [Bn 10 yy]

| | |
|---|---|
| Numerical range of [yy] | From [00h] to [7Fh] |
| Numerical range of [xx] at high resolution | [00h] < [xx] < [30h] |
| Stroke of each digit | 0.225/128 mm |
| Minimum increment | [yy]=[00h]= 0 mm |
| Maximum increment | [yy]=[7Fh]= 127×0.225/128mm =0.2232421875mm |
| Numerical range of [xx] at low resolution | [xx] = [00h] or [xx] = [30h] |
| Stroke of each digit | 0.225/8 mm |
| Minimum increment | [yy]=[00h]= 0 mm |
| Maximum increment | [yy]= [7Fh]=127×0.225/8 mm=3.571875mm |

Extended Positioning Data [Bn 11 yy]

| | |
|---|---|
| Numerical range of [yy] | From [00h] to [7Fh] |
| Numerical range of [xx] at high resolution | [00h] < [xx] < [30h] |
| Stroke of each digit | 0.225/ 128 mm |
| Maximum decrement | [yy]=[7Fh]=-127×0.225/128 mm =-0.2232421875 mm |
| Minimum decrement | [yy]=[00h]= 0 mm |
| Numerical range of [xx] at low resolution | [xx] = [00h] or [xx] = [30h] |
| Stroke of each digit | 0.225/ 8 mm |
| Maximum decrement | [yy]=[7Fh]= -127×0.225/8mm = -3.571875 mm |
| Minimum decrement | [yy]= [00h]= 0 mm |

Fig. 23B

| | 1st byte | 2nd byte | 3rd byte | Hexadecimal Notation |
|---|---|---|---|---|
| Basic P.D. | 1010nnnn | 0kkkkkkk | 0xxxxxxx | [An kk xx] |
| Extended P.D. | 1011nnnn | 00010000 | 0yyyyyyy | [Bn 10 yy] |
| | | | | B1 |
| Basic P.D. Delta Time | 1010nnnn | 0kkkkkkk Δt | 0xxxxxxx | [An kk xx] |
| Basic P.D. Delta Time | 1010nnnn | 0kkkkkkk Δt | 0xxxxxxx | [An kk xx] |
| | | | | B2 |
| | | | | B3 E1 |
| Basic P.D. | 1010nnnn | 0kkkkkkk | 0xxxxxxx | [An kk xx] |
| Extended P.D. Delta Time | 1011nnnn | 00010000 Δt | 0yyyyyyy | [Bn 10 yy] |
| Extended P.D. Delta Time | 1011nnnn | 00010000 Δt | 0yyyyyyy | [Bn 10 yy] |
| ⋮ | | | | |
| | | | | E2 |

Fig. 29

Basic Positioning Data
[An kk xx]

| | |
|---|---|
| Numerical range of [xx] | From [40h] to [70h] |
| Stroke of each digit | 1.0 millimeter |
| Minimum stroke | [xx]=[40h] =0mm at rest position |
| Maximum stroke | [xx]=[70h]=48 mm at end position |

Extended Positioning Data [Bn 10 yy]

| | |
|---|---|
| Numerical range of [yy] | From [00h] to [7Fh] |
| Numerical range of [xx] at high resolution | [40h] < [xx] < [70h] |
| Stroke of each digit | 1/ 64 mm |
| Maximum decrement | [yy]=[40h]=-64/64mm =-1 mm |
| Reference position | [yy]=[00h]= 0 mm |
| Maximum increment | [yy]=[3Fh]=+63/64mm =+0.984375mm |
| Numerical range of [xx] at low resolution | [xx] = [40h] or [xx] = [70h] |
| Stroke of each digit | 1/ 4 mm |
| Maximum decrement | [yy]=[40h]= -64/4 mm = -16mm |
| Reference position | [yy] = [00h]= 0 mm |
| Maximum increment | [yy]= [3Fh]=+63/ 4 mm = +15.75mm |

Fig. 31 A

Basic Positioning Data
[An kk xx]

| | |
|---|---|
| Numerical range of [xx] | From [01h] to [30h] |
| Stroke of each digit | 0.225 millimeter |
| Minimum stroke | [xx]=[01h] =0.225mm inside of rest position |
| Maximum stroke | [xx]=[30h]=10.8 mm outside of end position |

Extended Positioning Data [Bn 10 yy]

| | |
|---|---|
| Numerical range of [yy] | From [00h] to [7Fh] |
| Numerical range of [xx] at high resolution | [01h] < [xx] < [30h] |
| Stroke of each digit | 0.225/64 mm |
| Maximum decrement | [yy]=[40h]=-64×0.225/64mm =-0.225mm |
| Reference position | [yy]=[00h]= 0 mm |
| Maximum increment | [yy]=[3Fh]=+63×0.225/64mm =+0.221484375mm |
| Numerical range of [xx] at low resolution | [xx] = [01h] or [xx] = [30h] |
| Stroke of each digit | 0.225/4 mm |
| Maximum decrement | [yy]=[40h]= -64×0.225/4 mm = -3.6mm |
| Reference position | [yy] = [00h]= 0 mm |
| Maximum increment | [yy]= [3Fh]=+63×0.225/4 mm=+3.54375mm |

Fig. 31 B

| Positioning Data | Format |
|---|---|
| Basic positioning data | [An kk xx] |
| 1st extended positioning data | [Bn 10 yy] |
| 2nd extended positioning data | [Bn 30 yy'] |
| 3rd extended positioning data | [Bn 11 zz] |
| 4th extended positioning data | [Bn 31 zz'] |
| ⋮ | ⋮ |

Fig. 32A

| Positioning Data | Format |
|---|---|
| Basic positioning data | [An kk xx] |
| 1st extended positioning data | [Bn 10 yy] |
| 2nd extended positioning data | [Bn 10 yy'] |
| 3rd extended positioning data | [Bn 10 yy''] |
| ⋮ | ⋮ |

Fig. 32B

Basic Positioning Data
[An kk xx]

| | |
|---|---|
| Numerical range of [xx] | From [40h] to [70h] |
| Stroke of each digit | 1.0 millimeter |
| Minimum stroke | [xx]=[40h] =0mm at rest position |
| Maximum stroke | [xx]=[70h]=48 mm at end position |

Extended Positioning
Data [Bn 10 yy]

| | |
|---|---|
| Numerical range of [yy] | From [00h] to [7Fh] |
| Numerical range of [xx] at high resolution | [40h] < [xx] < [70h] |
| Stroke of each digit | 1/ 128 mm |
| Minimum increment | [yy]=[00h]= 0 mm |
| Maximum increment | [yy]=[7Fh]= 127/128 mm = 0.9921875 mm |
| Numerical range of [xx] at low resolution | [xx] = [40h] or [xx] = [70h] |
| Stroke of each digit | 1/ 8 mm |
| Minimum increment | [yy]=[00h]= 0 mm |
| Maximum increment | [yy]= [7Fh]= 127/ 8 mm = 15.875 mm |

Extended Positioning
Data [Bn 11 yy]

| | |
|---|---|
| Numerical range of [yy] | From [00h] to [7Fh] |
| Numerical range of [xx] at high resolution | [40h] < [xx] < [70h] |
| Stroke of each digit | 1/ 128 mm |
| Maximum decrement | [yy]=[7Fh]=-127/128 mm =-0.9921875 mm |
| Minimum decrement | [yy]=[00h]= 0 mm |
| Numerical range of [xx] at low resolution | [xx] = [40h] or [xx] = [70h] |
| Stroke of each digit | 1/ 8 mm |
| Maximum decrement | [yy]=[7Fh]= -127/8mm = -15.875 mm |
| Minimum decrement | [yy]= [00h]= 0 mm |

Fig. 35A

Basic Positioning Data
[An kk xx]

| | |
|---|---|
| Numerical range of [xx] | From [00h] to [30h] |
| Stroke of each digit | 0.225 millimeter |
| Minimum stroke | [xx]=[00h] =0 mm at rest position |
| Maximum stroke | [xx]=[30h]=10.8 mm outside of end position |

Extended Positioning Data [Bn 10 yy]

| | |
|---|---|
| Numerical range of [yy] | From [00h] to [7Fh] |
| Numerical range of [xx] at high resolution | [00h] < [xx] < [30h] |
| Stroke of each digit | 0.225/128 mm |
| Minimum increment | [yy]=[00h]= 0 mm |
| Maximum increment | [yy]=[7Fh]= 127×0.225/128mm =0.2232421875mm |
| Numerical range of [xx] at low resolution | [xx] = [00h] or [xx] = [30h] |
| Stroke of each digit | 0.225/8 mm |
| Minimum increment | [yy]=[00h]= 0 mm |
| Maximum increment | [yy]= [7Fh]=127×0.225/8 mm=3.571875mm |

Extended Positioning Data [Bn 11 yy]

| | |
|---|---|
| Numerical range of [yy] | From [00h] to [7Fh] |
| Numerical range of [xx] at high resolution | [00h] < [xx] < [30h] |
| Stroke of each digit | 0.225/ 128 mm |
| Maximum decrement | [yy]=[7Fh]=-127×0.225/128 mm =-0.2232421875 mm |
| Minimum decrement | [yy]=[00h]= 0 mm |
| Numerical range of [xx] at low resolution | [xx] = [00h] or [xx] = [30h] |
| Stroke of each digit | 0.225/ 8 mm |
| Maximum decrement | [yy]=[7Fh]= -127×0.225/8mm = -3.571875 mm |
| Minimum decrement | [yy]= [00h]= 0 mm |

Fig. 35B

MUSICAL INSTRUMENT RECORDING ADVANCED MUSIC DATA CODES FOR PLAYBACK, MUSIC DATA GENERATOR AND MUSIC DATA SOURCE FOR THE MUSICAL INSTRUMENT

FIELD OF THE INVENTION

This invention relates to a musical instrument and, more particularly, to a musical instrument such as, for example, a keyboard musical instrument and a music data generator and a music data source both associated with the musical instrument.

DESCRIPTION OF THE RELATED ART

While a musician is playing an acoustic musical instrument such as a piano, the player sequentially specifies the tones to be generated through manipulators, i.e., black and white keys with the assistance of a music score, and the depressed black and white keys give rise to motion of the action units so as to strike the strings with the hammers. The basic music data are given to the musician in the form of notes and rests on the staff, and the musician interprets the piece of music expressed on the music score so as to determine the actual key motion. Thus, the brainwork is required for the performance on the acoustic musical instrument.

Manufacturers for musical instruments have offered electronic musical instruments and hybrid musical instruments such as, for example, automatic player pianos to users, and these sorts of musical instruments have become popular among them.

Pieces of music are expressed as binary codes for the electronic musical instrument and hybrid musical instruments. When a user wishes to perform a piece of music through the electronic musical instrument, a data processor interprets the key motion, and supplies the binary codes to a tone generator for producing electronic tones. Similarly, when a user instructs the automatic player piano to reproduce a performance, a data source starts to supply the binary codes to the data processor so as to make the key actuators to give rise to the key motion without the fingering of a human player. This means that the music data are given in the form of binary codes. Not only the notes and rests on the staff but also the delicate brainwork are to be expressed in the binary codes. The electronic musical instruments and hybrid musical instruments are hereinafter referred to as "non-acoustic musical instrument".

Typical examples of the non-acoustic musical instrument are disclosed in Japanese Patent Application laid-open Nos. Sho 53-112716, Sho 58-159279 and Sho 59-82682. The music data are converted to binary codes, the formats of which are defined in the MIDI (Musical Instrument Digital Interface) protocols. The binary codes are hereinafter referred to as "MIDI music data codes". The note-on event, note-off event, pitches of tones to be produced and velocity to be imparted to the tones are, by way of examples, expressed by the MIDI music data codes. Although the note-on event, note-off event and pitches are corresponding to the notes on the staff, the velocity is not exactly expressed on the music score, and is determined through the brainwork of the human player for the acoustic musical instrument. Thus, the MIDI music data codes are convenient to express a performance on the acoustic musical instrument, and are widely employed in the non-acoustic musical instruments.

The MIDI music data codes are available for playback through the automatic player piano. The built-in controller determines reference trajectories on the basis of the music data for the black/white keys to be moved, and forces the black/white keys to travel between the rest positions and the end positions along the reference trajectories through a servo-controlling technique.

However, a problem is encountered in the non-acoustic musical instruments in that the tones reproduced on the basis of the MIDI music data codes are not exactly corresponding to the tones in the original performance on an acoustic musical instrument or the tones designed by a musician.

SUMMARY OF THE INVENTION

It is therefore an important object of the present invention to provide a musical instrument, which exactly records tones to be expected in the form of advanced music data codes.

It is also an important object of the present invention to provide a music data generator, which records tones to be expected in the form of advanced music data codes.

It is another important object of the present invention to provide a music data source, in which the advanced music data codes are stored.

In accordance with one aspect of the present invention, there is provided a musical instrument for producing tones, comprising a tone generating system including plural link-works selectively actuated for designating the pitch of the tones to be produced, each of the plural link-works having a certain component part, and a tone generating subsystem driven to produce the tones by means of the plural link works and a recording system including plural sensors monitoring at least the certain component parts of the plural link-works and producing detecting signals carrying pieces of data each representative of a physical quantity for expressing motion of the certain component parts and a data processing unit analyzing the pieces of data for producing a set of music data codes representative of the tones produced by the tone generating system, wherein the set of music data codes includes certain music data codes each having a data field assigned to a bit string expressing the physical quantity in an ordinary zone at a resolution and in a zone outside of the ordinary zone at another resolution different from the resolution; a music data generator comprising plural sensors monitoring at least certain component parts of plural link-works incorporated in a musical instrument and producing detecting signals carrying pieces of data each representative of a physical quantity for expressing motion of the certain component parts and a data processing unit analyzing the pieces of data for producing a set of music data codes representative of tones produced by the musical instrument, wherein the set of music data codes includes certain music data codes each having a data field assigned to a bit string expressing the physical quantity in an ordinary zone at a resolution and in a zone outside of the ordinary zone at another resolution different from the resolution; and a music data source for outputting at least a set of music data codes comprising a memory space for storing the set of music data codes representative of tones to be produced, wherein the set of music data codes includes certain music data codes each having a data field assigned to a bit string expressing a physical quantity in an ordinary zone at a resolution and in a zone outside of the ordinary zone at another resolution different from the resolution.

In accordance with another aspect of the present invention, there is provided a musical instrument for producing tones comprising a tone generating system including plural link-works selectively actuated for designating the pitch of the tones to be produced and having respective component parts and respective other component parts and a tone generating subsystem driven to produce the tones by means of the plural link works and a recording system including plural sensors monitoring the component parts and the other component parts of the plural link-works and producing detecting signals carrying pieces of first data each representative of a physical quantity for expressing motion of the component parts and other detecting signals carrying pieces of second data each representative of another physical quantity for expressing motion of the other certain component parts and a data processing unit analyzing the pieces of first data and the pieces of second data for producing a set of music data codes representative of the tones produced by the tone generating system, wherein the set of music data codes includes certain music data codes each having a data field assigned to a bit string, a numerical range of which is dividable into at least two numerical ranges expressing the physical quantity and the another physical quantity, respectively; a music data generator comprising plural sensors monitoring component parts and other component parts of plural link-works incorporated in a musical instrument and producing detecting signals carrying pieces of first data each representative of a physical quantity for expressing motion of the component parts and other detecting signals carrying pieces of second data each representative of another physical quantity for expressing motion of the other component parts and a data processing unit analyzing the pieces of first data and the pieces of second data for producing a set of music data codes representative of tones produced by the musical instrument, wherein the set of music data codes includes certain music data codes each having a data field assigned to a bit string, a numerical range of which is dividable into at least two numerical ranges expressing the physical quantity and the another physical quantity, respectively; and a music data source for outputting at least a set of music data codes comprising a memory space for storing the set of music data codes representative of tones to be produced, wherein the set of music data codes includes certain music data codes each having a data field assigned to a bit string, a numerical range of which is dividable into at least two numerical ranges expressing the physical quantity and the another physical quantity, respectively.

In accordance with yet another aspect of the present invention, there is provided a musical instrument for producing tones comprising a tone generating system including plural link-works selectively actuated for designating the pitch of the tones to be produced, each of the plural link-works having a certain component part, and a tone generating subsystem driven to produce the tones by means of the plural link works and a recording system including plural sensors monitoring at least the certain component parts of the plural link-works and producing detecting signals carrying pieces of data each representative of a physical quantity for expressing motion of the certain component parts and a data processing unit analyzing the pieces of data for producing a set of music data codes representative of the tones produced by the tone generating system, wherein the set of music data codes includes plural subsets of music data codes representative of the physical quantity, each subset of music data codes having a first bit string roughly expressing the physical quantity and a second bit string precisely expressing the physical quantity; a music data generator comprising plural sensors monitoring at least certain component parts of plural link-works incorporated in a musical instrument and producing detecting signals carrying pieces of data each representative of a physical quantity for expressing motion of the certain component parts and a data processing unit analyzing the pieces of data for producing a set of music data codes representative of tones produced by the musical instrument, wherein the set of music data codes includes plural subsets of music data codes representative of the physical quantity, each subset of music data codes having a first bit string roughly expressing the physical quantity and a second bit string precisely expressing the physical quantity; and a music data source for outputting at least a set of music data codes comprising a memory space for storing the set of music data codes representative of tones to be produced, wherein the set of music data codes includes plural subsets of music data codes representative of a physical quantity expressing motion of certain component parts of a musical instrument, and in which each subset of music data codes having a first bit string roughly expressing the physical quantity and a second bit string precisely expressing the physical quantity.

BRIEF DESCRIPTION OF THE DRAWINGS

The features and advantages of the musical instrument, music data generator and music data source will be more clearly understood from the following description taken in conjunction with the accompanying drawings, in which FIG. 7A is a view showing a table describing features of the basic positioning/extended positioning data for the actual hammer stroke as the first example, FIG. 7B is a view showing a table describing features of the basic positioning/extended positioning data for the actual keystroke as the first example, FIG. 8 is a view showing a table describing numerical sub-ranges assigned to different data for the second example, FIG. 11A is a view showing a table describing features of the basic positioning/extended positioning data for the actual hammer stroke as the third example, FIG. 11B is a view showing a table describing features of the basic positioning/extended positioning data for the actual keystroke as the third example, FIG. 17 is a view showing formats assigned to basic positioning data and extended positioning data used in the hybrid keyboard musical instrument, FIG. 18 is a view showing two numerical ranges respectively assigned to current key position and a current hammer position, FIG. 20A is a view showing a table describing features of the basic positioning/extended positioning data for the actual hammer stroke as the first example, FIG. 20B is a view showing a table describing features of the basic positioning/extended positioning data for the actual keystroke as the first example, FIG. 23A is a view showing a table describing features of the basic positioning/extended positioning data for the actual hammer stroke as the second example, FIG. 23B is a view showing a table describing features of the basic positioning/extended positioning data for the actual keystroke as the second example, FIG. 29 is a view showing a series of pieces of positioning data, FIG. 31A is a view showing a table describing features of the basic positioning/extended positioning data for the actual hammer stroke as the first example, FIG. 31B is a view showing a table describing features of the basic positioning/extended positioning data for the actual keystroke as the first example, FIGS. 32A and 32B are views showing two sets of extended positioning data available for a current hammer position and a current key position, FIG. 35A is a view showing a table describing features of the basic positioning/extended positioning data for the actual hammer stroke as the third example, FIG. 35B is a view showing a table describing features of the basic positioning/extended positioning data for the actual keystroke as the third example.

DESCRIPTION OF THE PREFERRED EMBODIMENTS

In the following description, term "front" is indicative of a position closer to a player, who is playing a piece of music, than a position modified with term "rear". A line drawn between a front position and a corresponding rear position extends in a "fore-and-aft direction", and a lateral direction crosses the fore-and-aft direction at right angle.

First Embodiment

Structure of Hybrid Keyboard Musical Instrument

Figure 1:
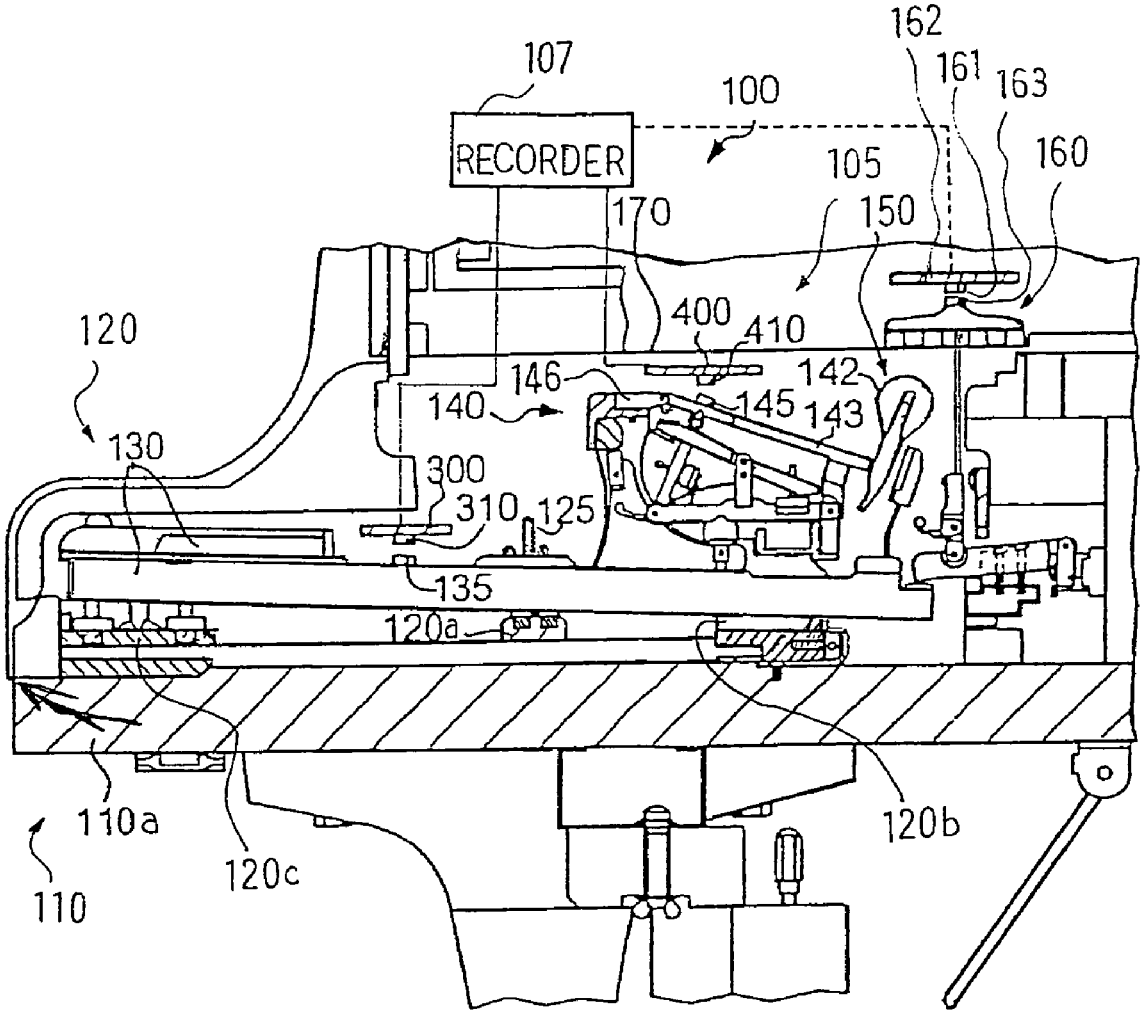
FIG. 1 is a cross sectional side view showing the structure of a hybrid keyboard musical according to the present invention.

Referring first to FIG. 1 of the drawings, a hybrid keyboard musical instrument embodying the present invention largely comprises an acoustic piano 100 and a recording system 105. The recording system 105 is installed in the acoustic piano 100, and produces music data codes representative of a performance on the acoustic piano 100.

The acoustic piano 100 includes a piano cabinet 110, a keyboard 120, action units 140, hammers 150, dampers 160 and strings 170. The keyboard 120 is mounted on a key bed 110*a* of the piano cabinet 110, and is exposable to a pianist who sits on a stool (not shown) in front of the acoustic piano 100. The strings 170 are stretched over the rear portion of the keyboard 120 inside of the piano cabinet 110, and the action units 140 and hammers 150 are housed in the piano cabinet 110 under the strings 170. The dampers 160 are respectively associated with the strings 170, and are spaced from and brought into contact with the associated strings 170 so as to temporarily permit the strings 170 to vibrate.

The keyboard 120 includes a balance rail 120*a*, balance pins 125 and black keys/white keys 130. The balance rail 120*a* laterally extends over the key bed 110*a*, and the balance pins 125 upwardly projects from the balance rail 120*a* at intervals. Vertical holes are formed in the intermediate portions of the black/white keys 130, and the balance pins 125 respectively pass through the vertical holes so as to offer the fulcrums of the key motion to the black/white keys 130, respectively. In this instance, the total number of the black/white keys 130 is eighty-eight, and key codes representative of the note numbers [21] to [108] are assigned to the black/white keys 130, respectively.

Turning back to FIG. 1, the key action units 140 are linked with the rear portions of the black/white keys 130, respectively, so that the rear portions of the black/white keys 130 sink onto a back rail due to the self-weight. On the other hand, the front portions of the black/white keys 130 are lifted over a front rail 120*c*. Thus, the black/white keys 130 are staying at respective rest positions without any external force exerted on the front portions. One of the white keys 130 at the rest position is indicated by real lines in FIG. 2.

When a pianist exerts force on the front portions of the black/white keys 130 with his or her fingers, the front portions sink onto the front rail 120*c*, and the rear portions push the action units 140 upwardly. When the front portions are brought into contact with the front rail 120*c*, the black/white keys 130 reach respectively end portions. The white key 130 at the end position is indicated by dots-and-dash lines in FIG. 2. In this instance, the keystroke is of the order of 10 millimeters at the front ends of the black/white keys 130. The structure of the action units 140 are well known to persons skilled in the art, and no further description is hereinafter incorporated for the sake of simplicity.

The hammers 150 are respectively associated with the action units 140 and, accordingly, the black/white keys 130. For this reason, the note numbers [21] to [108] are also assigned to the hammers 150, respectively. While the black/white keys 130 are resting at the rest positions, the associated hammers 150 are held in contact with the associated action units 140 at the heads of the jacks, and stays at respective rest positions. One of the hammers 150 at the rest position is indicated by real lines in FIG. 3. When a pianist depresses the front end portions of the black/white keys 130, the associated action unit 140 starts to rotate, and pushes the hammers upwardly. The action units 140 escape from the associated hammers 150 on the way of the black/white keys 130 to the end position. Then, the hammers 150 are driven for rotation, and are brought into collision with the strings 170 at the end of the free rotation. The hammers 150 give rise to the vibrations of the strings 170, and the vibrations are propagated to a sound board (not shown). The sound board also vibrates, and the tones are radiated from the sound board.

Figure 3:
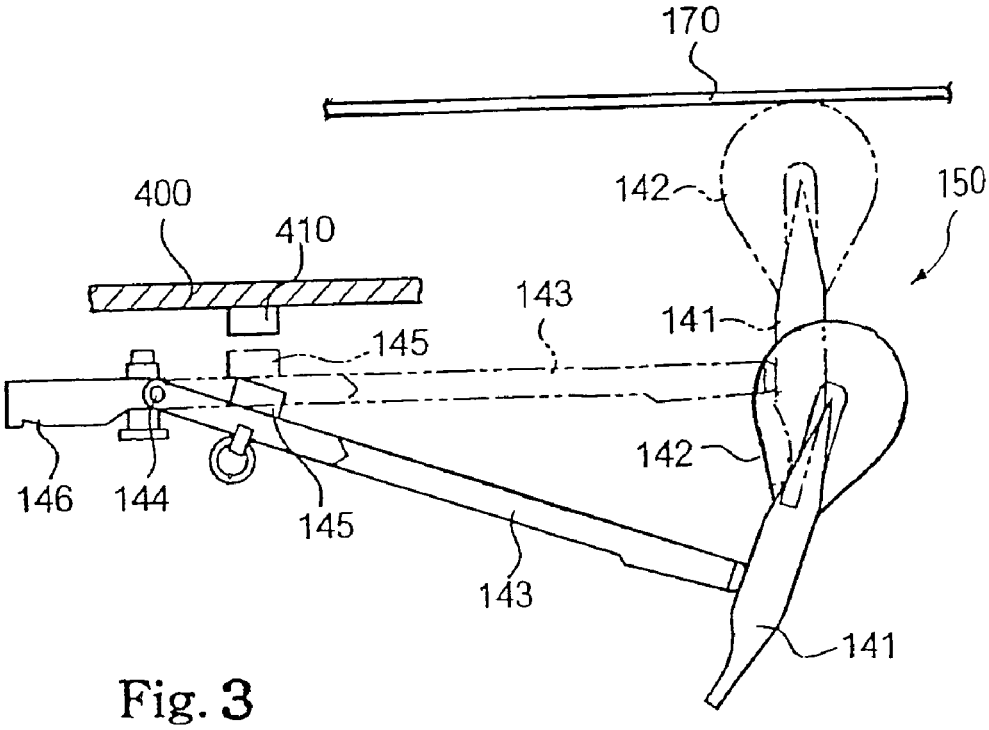
FIG. 3 is a side view showing a hammer also incorporated in the hybrid keyboard musical instrument.

The hammers 150 is broken down into a hammer wood 141, a hammer felt 142 and a hammer shank 143 as shown in FIG. 3. The hammer wood 141 is fixed to the leading end of the hammer shank 142, and the hammer felt 142 is held by the hammer wood 141. The hammer shank 143 is connected at the other end thereof to a hammer shank flange 146 by means of a pin 144 so as to rotate about the pin 144. Dots-and-dash lines are indicative of the hammer 150 at end positions where the hammers 150 are brought into collision with the string 170 (as shown in FIG. 3). In this instance, the hammer felt 142 is moved over about 48 millimeters from the rest position to the end position.

If all the component parts of the acoustic piano 100 were rigid, the black/white keys 130 would travel between the rest positions and the end positions, and the hammers would rotate from the rest positions to the positions at which the hammers 130 are brought into collision with the strings 170. However, the component parts of the actual acoustic piano 100 are resiliently deformable. Moreover, some component parts tend to be plastically deformed due to the aged deterioration. This means that the black/white keys 130 and hammers 150 overrun the end positions and rest positions.

In fact, it was observed in actual performances on acoustic pianos that the black/white keys 130 and hammers 150 sometimes overran the end positions and rest positions. However, the key motion and hammer motion were described on the assumption that the black/white keys and hammers traveled on the reference trajectories between the rest positions and the end positions in the prior art. The present inventors noticed the difference between the actual key motion and the assumption rendering the tones in the playback curious. In order to exactly describe the key motion, the overrun is taken into account as described hereinafter in detail.

The recording system 105 includes a recorder 107, key sensors 310 and hammer sensors 410. The key sensors 310 are respectively associated with the black/white keys 130, and monitor the associated black/white keys 130. On the other hand, the hammer sensors 410 are respectively associated with the hammers 150, and monitors the associated hammers 150. The key sensors 310 and hammer sensors 410 are connected to the recorder 107, and supply key position signals representative of current key positions of the associated black/white keys 130 and hammer position signals representative of current hammer positions of the associated hammers 150.

Figure 2:
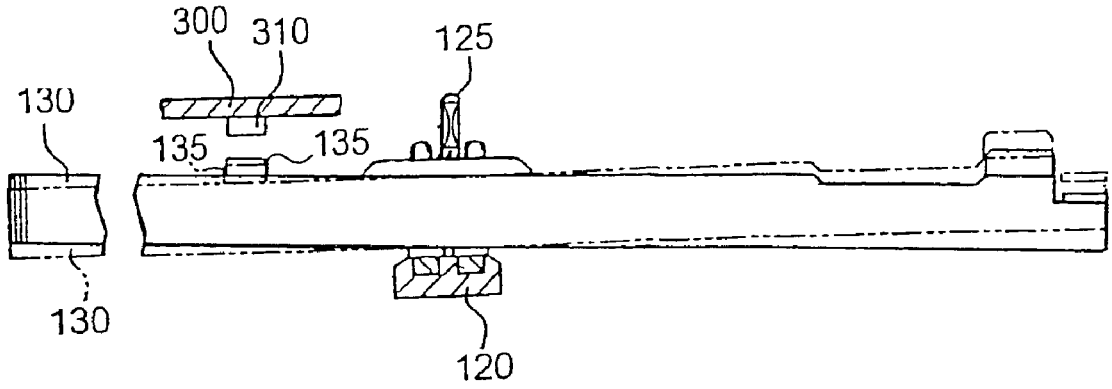
FIG. 2 is a side view showing a white key incorporated in the hybrid keyboard musical instrument.

As will be better seen in FIG. 2, a rigid plate 300 laterally extends over the array of black/white keys 130, and the key sensors 310 are attached to the lower surface of the rigid plate 300 at intervals equal to the pitches of the black/white keys 130. In this instance, the key sensors 310 are implemented by pairs of light emitting elements and light detecting elements, i.e., reflection-type photo-couplers, respectively, and reflection plates 135 are adhered to the upper surfaces of the black/white keys 130. The light emitting elements radiates light beams to the associated reflection plates 135. The light beams are reflected on the reflection plates 135, and are incident on the light detecting elements. The incident light is converted to photo-current in the light detecting elements, and the key position signals are produced from the photo-current. The strength of incident light is varied together with the distance between the photo-couplers and the reflection plates 135 so that the key position signals represent the distance from the key sensors 310, i.e., the current key positions. The key sensors 310 can discriminate the increment/decrement of 0.001 millimeter, and the detectable range is prolonged over each of the rest and end positions by a third of the key stroke, i.e., the length of the trajectory between the rest position and the end position. In order to make the two sorts of keystrokes discriminative, the keystroke between the rest position and the end position is referred to as "theoretical keystroke", and the keystroke in the detectable range is referred to as "real keystroke". When a black/white key 130 is moved from the rest position to the end position, the black/white key 130 travels over the "theoretical full keystroke". The detectable range outside of the theoretical full keystroke is referred to as an "overrunning region".

Similarly, a rigid plate 400 laterally extends over the hammer shanks 143, and the hammer sensors 410 and associated reflection plates 145 are attached to the lower surface of the rigid plate 400 and the upper surfaces of the hammer shanks 143, respectively, as will be better seen in FIG. 3. The hammer sensors 410 are implemented by the photo-couplers, and the hammer position signals are produced from the photo-current as similar to the key position signals. The hammer sensors 410 also have the resolution of 0.001 millimeter, and the detectable range is prolonged over each of the rest and end positions by a third of the hammer stroke, i.e., the length of the trajectory between the rest position and the end position. As similar to the keystroke, the hammer stroke between the rest position and the end position is referred to as "theoretical hammer stroke", and the hammer stroke in the detectable range is referred to as "real hammer stroke". When a hammer 150 rotates from the rest position to the end position, the hammer travels over "theoretical full hammer stroke". The detectable range outside of the theoretical full hammer stroke is referred to as an "overrunning region".

Although the key sensors 310 and hammer sensors 410 are prepared for the acoustic piano 100, another sort of the component parts may be monitored with sensors. For example, damper sensors 161 may be provided over the dampers 160. The damper sensors 161 will be attached to a rigid plate 162 in such a manner as to be opposed to reflection plates 163. As described hereinbefore, the dampers 160 permit the strings 170 to vibrate and decay the vibrations. However, the dampers 160 are not changed between the two positions. In actual performances, pianists sometimes keep the dampers 160 lightly in contact with the strings 170 so as to impart an artificial expression to the tones. If the damper sensors 161 are further installed in the acoustic piano 100, the recorder 107 acquires another sort of music data from the damper sensors 161, and makes the performance closer to the original performance.

System Configuration of Recorder

Figures 4, 5:
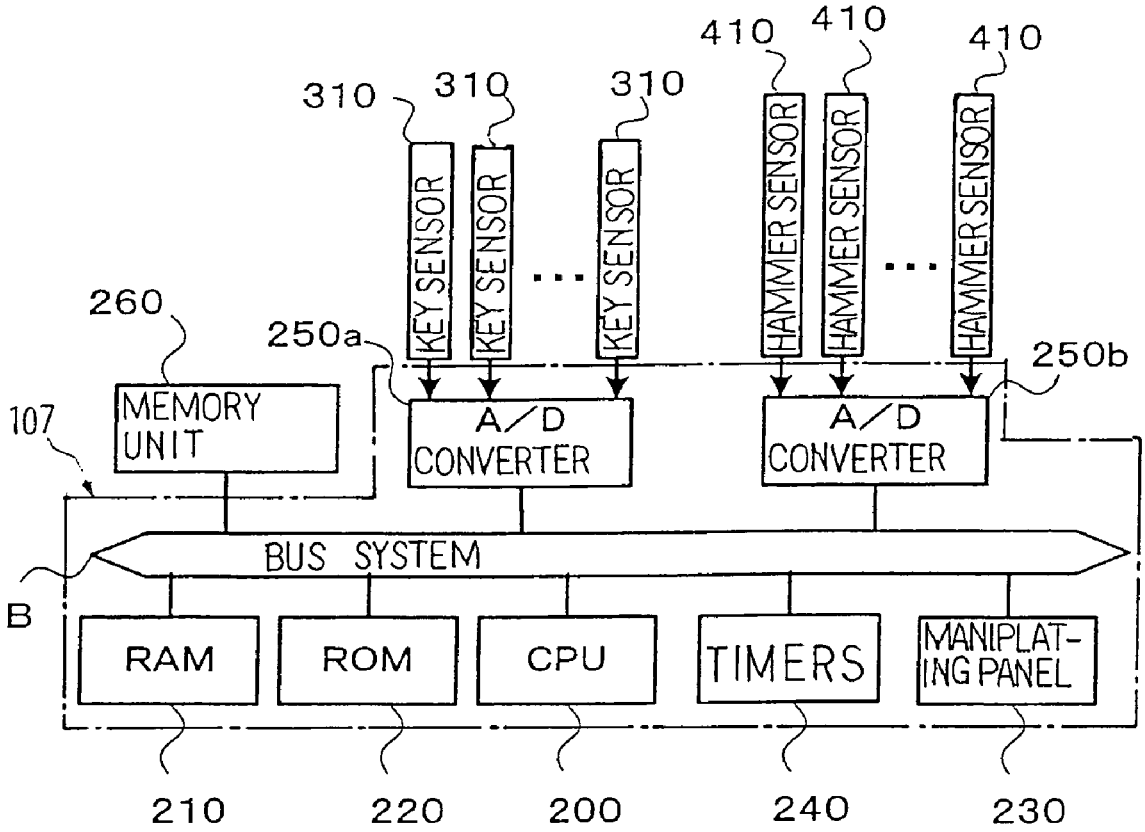
FIG. 4 is a block diagram showing the system configuration of a recorder incorporated in the hybrid keyboard musical instrument.
FIG. 5 is a view showing formats assigned to basic positioning data and extended positioning data used in the hybrid keyboard musical instrument.

Turning to FIG. 4 of the drawings, the recorder 107 includes a central processing unit 200, which is abbreviated as "CPU", a random access memory 210, which is abbreviated as "RAM", a read only memory 220, which is abbreviated as "ROM", a manipulating panel 230, timers 240, analog-to-digital converters 250*a*/250*b* and a shared bus system B, and a memory unit 260 such as, for example, a floppy disk driver, a disk driver unit or a hard disk driver unit is provided in associated with the recorder 107. Another sort of memory devices is available for the data storage. The memory unit 260 may be implemented by a compact disk driver for CD-ROM or CD-RAM, an optoelectromagnetic disk driver, a ZIP disk driver, a DVD (Digital Versatile Disk) driver or a memory board where semiconductor memory devices are mounted.

The central processing unit 200, random access memory 210, read only memory 220, manipulating panel 230, timers 240, analog-to-digital converters 250*a*/250*b* and the memory unit 260 are connected to the shared bus system B so that the central processing unit 200 can communicate with the other components 210/220/230/240/250*a*/250*b*/260 through the shared bus system B. The eighty-eight key sensors 310 are connected to the analog-to-digital converter 250*a*, and the key position signals are converted to digital key position signals by means of the analog-to-digital converter 250*a*. On the other hand, the eighty-eight hammer sensors 410 are connected to the other analog-to-digital converter 250*b*, and the hammer position signals are converted to digital hammer position signals through the analog-to-digital converter 250*b*. The digital key position signal and digital hammer position signal have a bit string long enough to express the resolution. In this instance, 12 bits are assigned to the current key position or current hammer position.

Computer programs and tables of parameters are stored in the read only memory 220, and the random access memory 210 serves as a working memory. The central processing unit 200 runs on the computer programs, and accomplishes tasks expressed in the computer programs so as to produce music data codes representative of MIDI messages for a performance on the keyboard 120. A set of music data codes representative of the MIDI messages, i.e., MIDI music data codes is stored in the memory unit 260. Thus, the performance is recorded in the memory unit 260.

The manipulating panel 230 is a man-machine interface. Various switches, levers, indicators and display window are provided on the manipulating panel 230, and a user gives instructions to the central processing unit 200 through the manipulating panel 230. The timers 240 may be implemented by software. The central processing unit 200 selectively starts and stops the timers, and measures lapses of time.

While a pianist is performing a piece of music on the acoustic piano 100, the central processing unit 200 runs on the computer program so as to produce the MIDI music data codes. The central processing unit 200 periodically fetches the current key positions and current hammer positions from the analog-to-digital converters 250*a*/250*b*, and adds the current key positions and current hammer positions to series of current key positions and series of current hammer positions already stored in the random access memory 210. The central processing unit 200 checks the series of current key positions to see whether or not any key 130 is moved.

When the central processing unit 200 finds a black/white key 130 changed in position, the central processing unit 200 determines the key motion, and produces a MIDI voice message for the tones to be produced or decayed. The central processing units 200 further starts the timer 240 at the occurrence of the MIDI voice message, and stops the timer 240 at the occurrence of the next MIDI voice message. The central processing unit 200 measures the lapse of time between the MIDI events, and produces duration data code representative of the lapse of time. In this instance, the central processing unit 200 further produces voice messages representative of the current key positions and current hammer positions. Idle formats, which are not employed in musical instrument used for the playback, are assigned to the voice messages representative of the current key positions and current hammer positions, and the MIDI music data codes representative of the current key positions and current hammer positions are stored in the memory unit 260 together with the MIDI music data representative of the note-on, note-off and lapse of time. The idle formats will be hereinlater described in detail.

The MIDI music data codes and duration data codes are supplied to the memory unit 260, and are stored therein. The user can give data write-in speed and data read-out speed through the manipulating panel 230 to the central processing unit 200, which in tern instructs the data write-in speed and data read-out speed to the memory unit 260. However, the default value is stored in the read only memory 220 for the data write-in speed and data readout speed, and the central processing unit 200 usually instructs the memory unit 260 to write the MIDI music data codes and duration data codes into and read out them from the memory disk at the default value. In the following description, the memory unit 260 is assumed to write those data cods into and read out them from the disk at the default value.

Although the central processing unit 200 usually transfers all the MIDI music data codes and duration data codes, which represent a performance, from the random access memory 210 to the memory unit 260, the user can select the notes to be recorded in the memory unit 260. The user is assumed to wish to record a part of the piece of music. The user instructs the central processing unit 200 to record the tones in a certain register. The central processing unit 200 selects the MIDI music data codes representative of the selected notes, and changes the lapse of time of the duration data codes. The central processing unit 200 transfers the selected MIDI music data codes and duration data codes to the selected data codes to the memory unit 260, and stores them in the memory disk. Thus, the recorder 107 can selectively record the tones expressed by the key motion/hammer motion.

A set of MIDI music data codes and duration data codes is stored in the memory unit 260 in the form of the standard MIDI file, which is usually abbreviated as "SMF". In other words, the key motion and hammer motion are translated into the idle voice messages together with the applied voice messages representative of the note-on, note number, velocity and note-off, and those voice messages are stored in the MIDI music data codes. The translation into the voice messages is preferable to data codes, which directly express the key trajectories and hammer trajectories, because the user easily edits and transmits the MIDI music data codes.

Positioning Data

FIG. 5 shows formats assigned to the key motion and hammer motion. Since the formats are assigned to the polyphonic key pressure and control change in the MIDI protocols, the polyphonic key pressure and control change are useless in an automatic player piano, through which the performance is reproduced. In other words, these formats stand idle in the automatic player piano. For this reason, the idle formats are assigned to basic positioning data and extended positioning data as described hereinafter in detail.

The basic positioning data and extended positioning data express the current key position and current hammer position at different resolution. A piece of basic positioning data roughly indicates the current key position on the key trajectory between the rest position and the end position, i.e., the theoretical keystroke or the current hammer position on the hammer trajectory between the rest position and the end position, i.e., the theoretical hammer stroke at a relatively low resolution. In other words, a certain region of the key trajectory between the rest position and the end position or a certain region of the hammer trajectory between the rest position and the end position is roughly specified by the piece of basic positioning data.

On the other hand, a piece of extended positioning data is indicative of the current key position in the certain region between the end position and the rest position at a relatively high resolution or in the overrunning region at a relatively low resolution. Otherwise, the piece of extended positioning data is indicative of the current hammer position in the certain region between the rest position and the end position at a relatively high resolution or in the overrunning region at a relatively low resolution. Thus, the piece of extended positioning data describes not only the actual keystroke/actual hammer stroke between the rest position and the end position but also the actual keystroke or actual hammer stroke in the overrunning region. The pieces of extended positioning data make it possible to express a "margin", which means the amount of overrun. Since the basic positioning data and extended positioning data are shared between the current key position and the current hammer position, two numerical ranges are respectively assigned to the theoretical/actual keystrokes and theoretical/actual hammer strokes.

As shown in FIG. 5, the voice messages representative of a piece of basic positioning data and a piece of extended positioning data are expressed by 3 bytes. The first byte is the status byte defined in the MIDI protocols, and the second byte and third byte are the data byte also defined in the MIDI protocols. The voice message representative of a piece of basic positioning data has the status byte expressed as [1010nnnn] and the data bytes expressed as [0kkkkkkk] and [0xxxxxxx], and is expressed by [An kk xx] in the hexadecimal notation. The bit string [nnnn] is indicative of a channel number. The bit string [kkkkkkk] is indicative of the note number assigned to one of the black/white keys 130 or one of the hammers 150. In other words, the bit string [kkkkkkk] stands for one of the binary number from [0010101], which is equal to 21 in the decimal notation, to [1101100], which is equal to 108 in the decimal notation. As described hereinbefore, the user can instruct the central processing unit 200 to process the motion of the black/white keys 130 in a certain region and the motion of the hammers 150 in the certain register. If the user has given the certain register to the central processing unit 200, the central processing unit 200 selects the black/white keys 130 and hammers 150 by comparing the bit string [kkkkkkk] with the note numbers in the certain register.

The bit string [xxxxxxx] stands for a piece of basic positioning data. The numerical range [xxxxxxx] is divided into two numerical ranges, and the two numerical ranges are respectively assigned to the theoretical keystroke and theoretical hammer stroke. Thus, only one format is shared between the black/white keys 130 and the hammers 150. This feature is desirable from the viewpoint of economical usage of the MIDI message.

The extended positioning data represents the actual keystroke in the certain/overrunning regions at different values of resolution and actual hammer stroke in the certain/overrunning regions at the different values of resolution. The voice message representative of a piece of extended positioning data also has a status byte expressed as [1011nnnn] and two data bytes expressed as [00010000] and [0yyyyyyy]. The bit string [nnnn] also represents the channel number, which is to be consistent with the bit string [nnnn] of the corresponding status byte [An]. The status byte accompanied with the bit string [00010000] represents a general-purpose extended data.

If the basic positioning data indicates that the black/white key 130 or hammer 150 is traveling in a certain region between the rest position and the end position, the bit string [yyyyyyy] represents the current key position or current hammer position in the certain region at a relatively high resolution. On the other hand, while the black/white key 130 is traveling in the overrunning region, the bit string [yyyyyyy] represents the current key position or current hammer position at a relatively low resolution. Thus, the change of resolution makes the bit string [yyyyyyy] possible to express the actual keystroke and actual hammer stroke.

When the voice message representative of a piece of extended positioning data is stored in the memory unit 260, the piece of extended positioning data is stored at the address next to the address where the corresponding basic positioning data is stored. While the MIDI music data codes are being transmitted from the memory unit 260 to the central processing unit 200, the voice message representative of the piece of basic positioning data is followed by the voice message representative of the piece of extended positioning data, and any other voice message is not transmitted between these voice messages. This results in that the piece of basic positioning data is surely paired with the piece of extended positioning data. Thus, the continuous address assignment and continuous transmission of messages are effective against unintentional missing data.

FIRST EXAMPLE

Figure 6A:
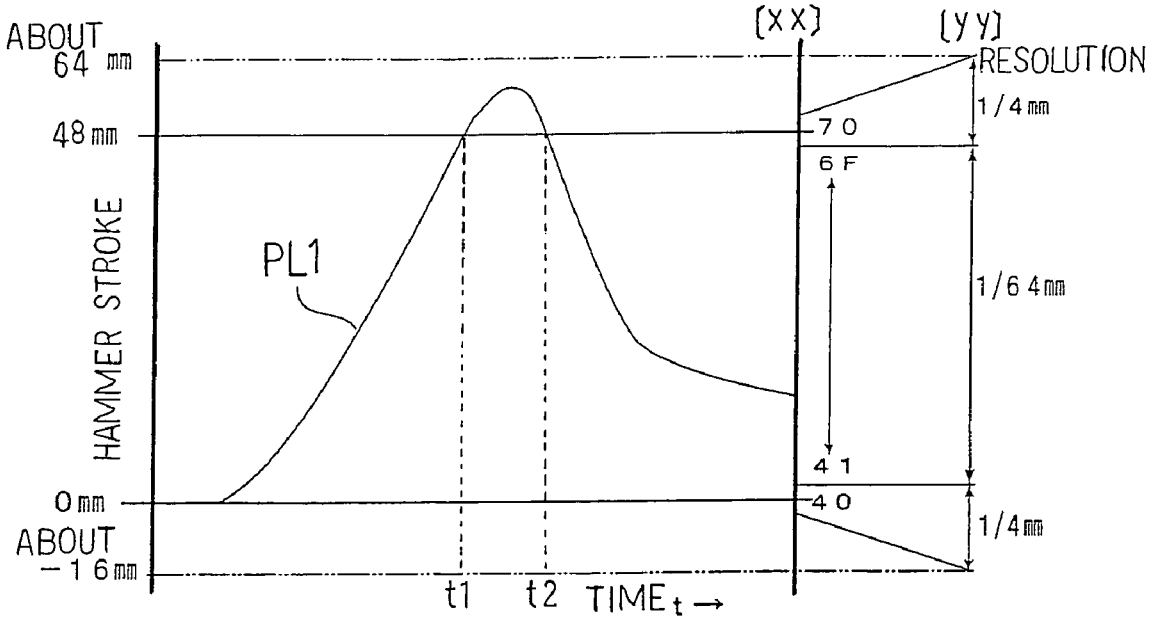
FIG. 6A is a graph showing a relation between an actual hammer stroke and basic positioning/extended positioning data for the first example.
Figure 6B:
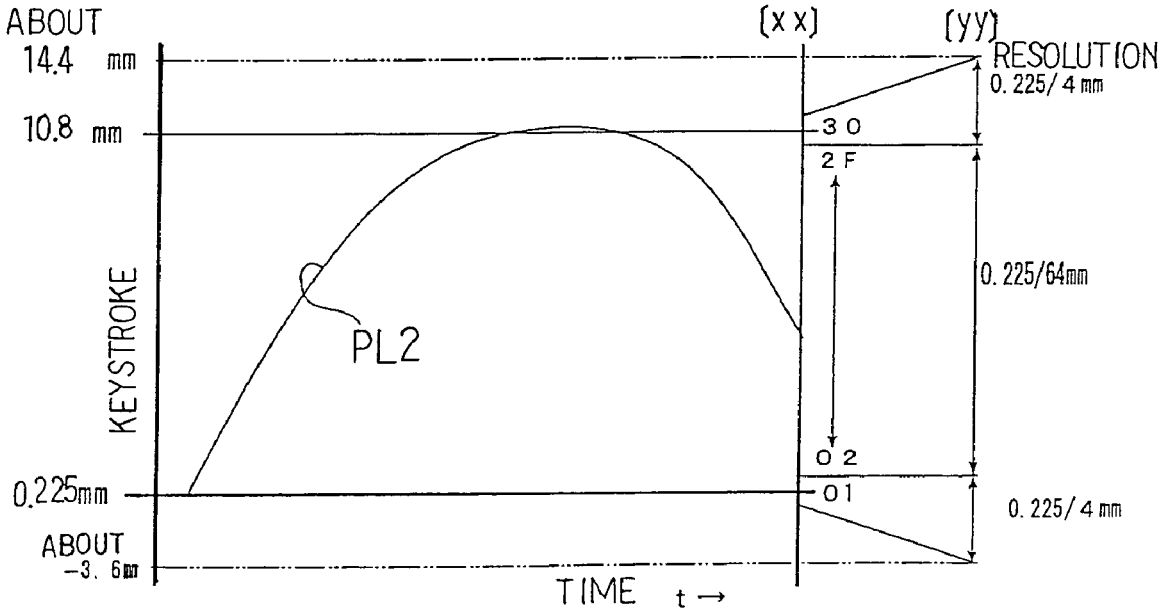
FIG. 6B is a graph showing a relation between an actual keystroke and basic positioning/extended positioning data for the first example.

FIGS. 6A and 6B show an actual hammer trajectory and an actual key trajectory. The axes of abscissas are indicative of a lapse of time, and the axes of coordinates are indicative of the actual keystroke/actual hammer stroke or the current hammer position/current key position expressed by hexadecimal numbers. Plots PL1 and PL2 stand for the actual hammer stroke and actual keystroke. Since the current key position/current hammer position are expressed by 7 bits, the hexadecimal numbers [xx] and [yy] are varied from zero, i.e., [00h] in the hexadecimal notation, to 127, i.e., [7Fh] in the hexadecimal notation. The small letter "h" in the brackets stands for the hexadecimal notation.

FIGS. 7A and 7B shows a table describing features of the basic positioning/extended positioning data for the actual hammer stroke and a table describing features of the basic positioning/extended positioning data for the actual keystroke.

First, description is made on the actual hammer stroke with reference to FIGS. 6A and 7A. The basic positioning data for the hammer stroke are assigned the numerical range from [40h] to [70h]. The hammer 150 is rotated from the rest position at 0 millimeter to the end position at 48 millimeters so that the theoretical full hammer stroke is 48 millimeters. The third byte [xx] is varied from [40h], which is equal to 64 in decimal notation, to [70h], which is equal to 112 in decimal notation, so that the theoretical full hammer stroke, i.e., 48 millimeter is divided into 48 regions. Thus, each digit is representative of the variation of 1 millimeter. If the hammer 150 is rotated over 40 millimeters, the voice message is expressed as [An kk 68]. The hammer trajectory in each region is assumed to be linear.

The current hammer position is precisely expressed by the extended positioning data. The third byte [yy] is varied from [00h] to [7Fh] so that each piece of extended positioning data offers 128 sub-regions to the associated piece of basic positioning data. When the third byte [xx] is fallen within the numerical range from [41h] to [6Fh], the third byte [yy] is indicative of an increment and decrement of the current hammer position between the rest position and the end position, and each digit is equal to 1/64 millimeter. The 128 sub-regions are divided into two groups. One of the 128 sub-regions, i.e., [00h] is assigned to the piece of basic positioning data [An kk xx], and the remaining sub-regions are divided into two groups. One of the two groups consists of 64 sub-regions [00h] to −[40h], and the other group consists of 63 sub-regions [00h] to +[3Fh]. The decrement is expressed by the 64 subregions so that maximum decrement is −1 millimeter with respect to the current hammer position at [An kk xx]. On the other hand, the increment is expressed by the 63 sub-regions so that the maximum increment is +63/64 millimeter, i.e., +0.984375 millimeters. Thus, the third byte [yy] expresses the minimum stroke of −1 millimeter to the maximum hammer stroke of +0.984375 millimeter. The current hammer position is expressed as the sum of the hexadecimal numbers [xx] and [yy].

When the third byte [xx] is indicative of the rest position, i.e., [40h] or the end position, i.e., [70h], the third byte [yy] expresses the increment or decrement, and each digit is equal to ¼ millimeter. The actual hammer stroke is represented by the sum of [xx] and [yy]/64 millimeters. Since the current hammer position in the overrunning region is determined at the low resolution, it is possible to express the actual hammer stroke in the overrunning region without increasing the number of data bytes expressing the idle voice messages.

As described hereinbefore, the maximum decrement and maximum increment are −1 millimeter and 0.984375 millimeter. Thus, the bit string expresses the numerical range of ±1 millimeter at the relatively high resolution. When the third byte [yy] is [00h], the increment or decrement is zero, and is corresponding to the current hammer position expressed by the piece of basic positioning data of [40h] or [70h]. The maximum decrement from the rest position is −64/4 millimeter, i.e., −16 millimeters, and is expressed by [40h]. On the other hand, the maximum increment from the end position is +63/4 millimeters, i.e., 15.75 millimeters, and is expressed by [3Fh]. Thus, the third byte [yy] expresses the numerical range ±16 millimeters in the overrunning region. The increment and decrement are corresponding to the margin.

The hammer stroke is assumed to be 40.5 millimeters from the rest position. The hammer stroke is expressed by the piece of basic positioning data [An kk 68] and the piece of extended positioning data [Bn 10 20]. The third byte [68h] is equivalent to 40 millimeters, and the third byte [20h] is equivalent to +0.5 millimeter. Thus, the sum of the two hexadecimal numbers is equivalent to 40.5 millimeters. Of course, the hammer stroke of 40.5 millimeters is also expressed by the piece of basic positioning data [An kk 69] and the piece of extended positioning data [Bn 10 60], because the third bytes [69h] and [60h] are equivalent to 41 millimeters and −5 millimeter. Similarly, the hammer stroke of 56 millimeters is expressed by the piece of basic positioning data [An kk 70] and the piece of extended positioning data [Bn 10 20]. The third byte [70h] is equivalent to 48 millimeters, and the third byte [20h] is equivalent to +8 millimeters. Thus, the sum of the two hexadecimal numbers is equivalent to 48 millimeters.

The hammer stroke of −0.25 millimeter is expressed by the piece of basic positioning data [An kk 40] and the piece of extended positioning data [Bn 10 7F]. The third byte [40h] is equivalent to 0 millimeter or the rest position, and the other third byte [7Fh] is equivalent to −0.25 millimeter. Thus, the sum of the two hexadecimal numbers is equivalent to −0.25 millimeter.

Subsequently, description is made on the keystroke with reference to FIGS. 6B and 7B. The basic positioning data for the keystroke are assigned the numerical range from [01h] to [30h]. The black/white key 130 is moved from the rest position to the end position over the theoretical full keystroke of 10 millimeters. Each digit of the third byte [xx] is equal to the variation of 0.225 millimeter. The hexadecimal number [01h] is indicative of the current key position spaced from the rest position toward the end position by 0.225 millimeter. The hexadecimal number [30h] is indicative of the current key position spaced from the current key position at [01h] by 0.225×48=10.8 millimeters. The maximum current key position is outside of the end position. Thus, the keystroke is indicated by the hexadecimal numbers from [02h] to [2Fh] at intervals of 0.225 millimeter. The key trajectory in each region is assumed to be linear.

When the third byte [xx] is indicative of the minimum current key position, i.e., [01h] or the maximum current key position, i.e., [30h], the third byte [yy] expresses a relatively large increment or a relatively small decrement, and each digit is equal to 0.225/4 millimeter. The actual keystroke is represented by the sum of [xx] and [yy]×0.225/64 millimeters. Since the current key position in the overrunning region is determined at the low resolution, it is possible to express the actual keystroke in the overrunning region without increasing the number of data bytes.

On the other hand, the current hammer position is precisely expressed by the extended positioning data between the current key position at [0.2h] and the current key position at [2Fh]. Namely, the third byte [yy] is indicative of an increment and a decrement of the current hammer position between the rest position and the end position at a relatively high resolution. Each digit is equal to 0.225/64 millimeter. The actual keystroke is give as the sum of [xx] and [yy] ×0.225/64 millimeters.

The actual keystroke is determined as similar to the actual hammer stroke. The third byte [xx] is assumed to be fallen within the numerical range from [02h] to [30h]. If the third byte [yy] is equivalent to the hexadecimal number [00h], the actual keystroke is equal to the product of third byte [xx] and 0.225 millimeter. On the other hand, if the third byte [yy] is equivalent to [40h], the decrement is maximized at −64×0.225/64 millimeter, i.e., −0.225 millimeter, and the maximum decrement is added to the current key position expressed by the third byte [xx]. When the third byte [yy] is equivalent to [3Fh], the increment is maximized at +63×0.225/64 millimeter, i.e., +0.221484375 millimeter, and the maximum increment is added to the current key position expressed by the third byte [xx]. Thus, the current key position is precisely expressed by the piece of basic positioning data and the piece of extended positioning data as (0.225×(xx+yy/64) millimeters.

The third byte [xx] is assumed to be equal to the hexadecimal numbers [01h] and [30h]. The piece of extended positioning data expresses the length from the current key position [01h] or [30h] in the overrunning region. The hexadecimal number [00h], i.e., [yy]=[00h] is indicative of the reference position at [xx]=[01h] or [30h]. If the third byte [yy] is equivalent to [40h], the decrement is maximized at −64×0.225/4 millimeters, i.e., −3.6 millimeters with respect to the current key position expressed by the third byte [xx] of [01h]. On the other hand, when the third byte [yy] is equivalent to [3Fh], the increment is maximized at +63×0.225/4 millimeters, i.e., +3.54375 millimeters with respect to the current key position expressed by the third byte [xx] of [30h]. Thus, the numerical range is prolonged to about+3.6 millimeters. The actual keystroke in the overrunning region is expressed by the piece of basic positioning data and the piece of extended positioning data as (0.225×(xx+yy/4)) millimeters. Since each digit is equivalent to the large value, it is possible to express the margin without increasing the number of digits incorporated in the third data byte [yy].

The keystroke of zero is expressed by the combination of the piece of basic positioning data [An kk 01], which is indicative of the keystroke of 0.225 millimeter, and the piece of extended positioning data [Bn 10 7C], which is indicative of the decrement of (−4×0.224/4) millimeter, i.e., 0.225 millimeter. Similarly, the actual keystroke of 10.125 millimeters is expressed by the combination of the piece of basic positioning data [An kk 2D], which is indicative of the keystroke of 10.125 millimeters, and the piece of extended positioning data [Bn 10 00], which represents the increment/decrement of zero. When the black/white key overruns the rest position, the actual keystroke of −0.025 millimeter is expressed by the combination of the piece of basic positioning data [An kk 01], which is indicative of the keystroke of 0.225 millimeter, and the piece of extended positioning data [Bn 10 7F], which represents the decrement of −0.25 millimeter.

As will be understood from the foregoing description, the current hammer position and current key position are expressed by a piece of basic positioning data and a piece of extended positioning data, and the increment/decrement is enlarged in the overrunning region. As a result, the enlarged increment/enlarged decrement makes it possible to indicate the current hammer position/current key position without increasing the number of digits in the third byte. This feature is desirable, because the idle voice messages are available for the hybrid keyboard musical instrument.

SECOND EXAMPLE

Although two sorts of voice messages are required for the current key position in the first example, only one sort of voice messages is shared between the current key position in the overrunning regions and the current key position between the rest position and the end position in the second example. In this example, the voice message for the polyphonic key pressure [An kk xx] is shared between the basic positioning data and the extended positioning data. The voice message for the polyphonic key pressure has the third byte expressed as [xx], and the numerical range of the third byte [xx] is divided into three numerical sub-ranges as shown in FIG. 8.

The numerical range of the third byte [xx] is divided into three sub-regions, i.e., [00h] to [7Fh], [10h] to [6Fh] and [70h] to [7Fh]. The numerical subregion [10h] to [6Fh] is assigned to the current key position between the rest position and the end position. In this instance, the end position is spaced from the rest position by 10 millimeters. Since there are 96 hexadecimal numbers between [19h] to [6Fh], each digit of the hexadecimal number is equivalent to about 0.01 millimeter.

The numerical sub-range from [00h] to [0Fh] is assigned to the current key position in the overrunning region outside of the rest position. About 0.16 millimeter is expressed by each digit, that is, the resolution is of the order of 0.16 millimeter so that the margin outside of the rest position is of the order of 2.5 millimeters. On the other hand, the numerical sub-range from [70h] to [7Fh] is assigned to the current key position in the overrunning region outside of the end position. The resolution is also of the order of 0.16 millimeter so that the margin outside of the end position is of the order of 2.5 millimeters.

Thus, the resolution is changed depending upon the numerical sub-ranges so that the third byte [xx] of only one sort of the MIDI message can express the current key position in the overrunning regions as well as the current key position between the rest position and the end position.

When the current hammer position is required for reproduction of a performance, another sort of MIDI message is assigned to the current hammer position.

THIRD EXAMPLE

Figure 9A:
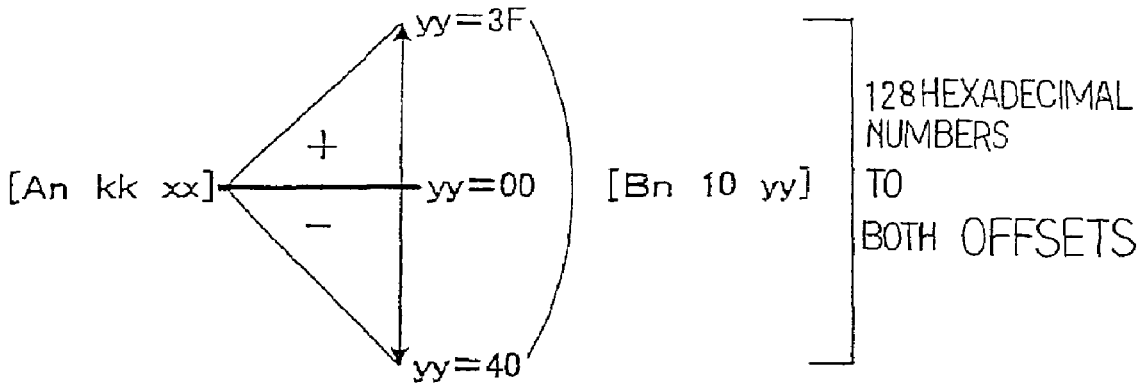
FIG. 9A is a view showing the numerical ranges assigned to a decrement and an increment in the first example.

As described in conjunction with the first example, the reference position expressed by the hexadecimal number [00h] of the third byte [yy] is aligned with hexadecimal numbers of the third byte [xx], and the numerical ranges [00h] to [3Fh] and [00h] to [40h] are assigned to the increment or positive offset value from the reference position and the decrement or negative offset value from the reference position, respectively, as shown in FIG. 9A. All the pieces of extended positioning data have the second byte fixed to [10h].

Figure 9B:
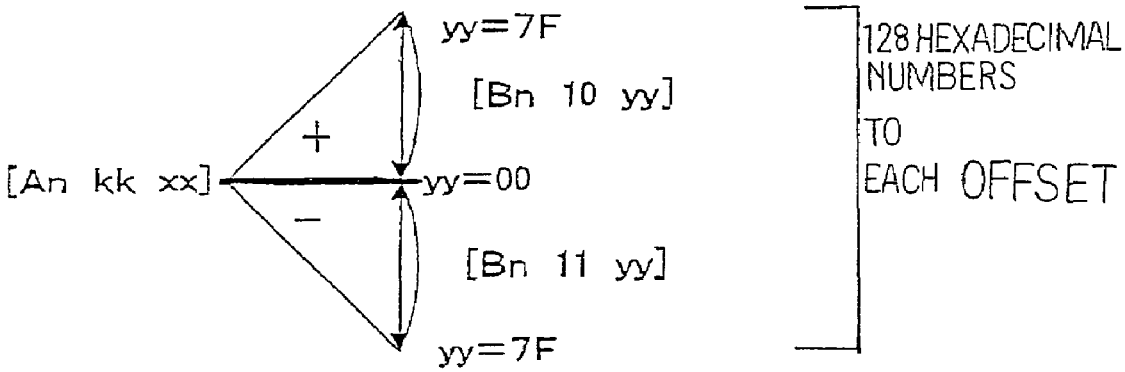
FIG. 9B is a view showing the numerical ranges assigned to a decrement and an increment in the third example.

In the third embodiment, the pieces of extended positioning data are expressed as [Bn 10 yy] and [Bn 11 yy]. The reference position expressed by the hexadecimal number [00h] of the third byte [yy] is also aligned with hexadecimal numbers of the third byte [xx]. The third byte [yy] of the pieces of extended positioning data [Bn 10 yy] are assigned to an increment or positive offset from the reference position, and the third byte [yy] of the pieces of extended positioning data [Bn 11 yy] are assigned to a decrement or negative offset from the reference position as shown in FIG. 9B. The first and second bytes [Bn 10] are representative of the extended data applied to the positive offset value from the reference position, and the first and second bytes [Bn 11] are representative of the extended data applied to the negative offset value from the reference position. Since 129 hexadecimal numbers are expressed by the third byte [yy], the resolution in the overrunning regions is twice higher than that of the first example in so far as the margin of the third example is equal to that of the first example. Otherwise, the third byte [yy] in the third example offers a margin larger than that of the first example does.

Figure 10A:
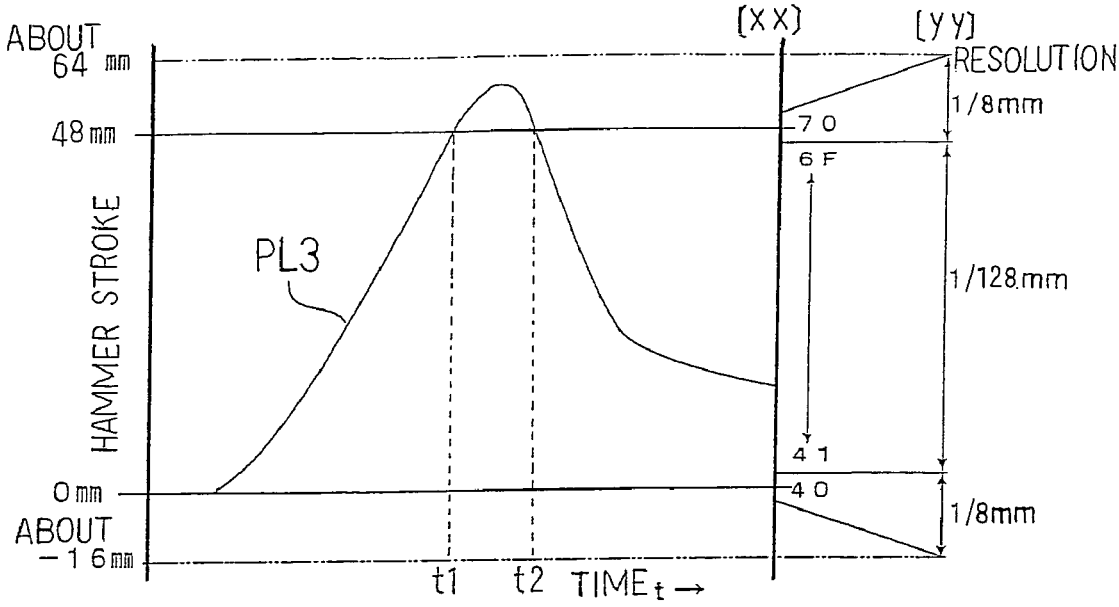
FIG. 10A is a graph showing a relation between an actual hammer stroke and basic positioning/extended positioning data for the third example.
Figure 10B:
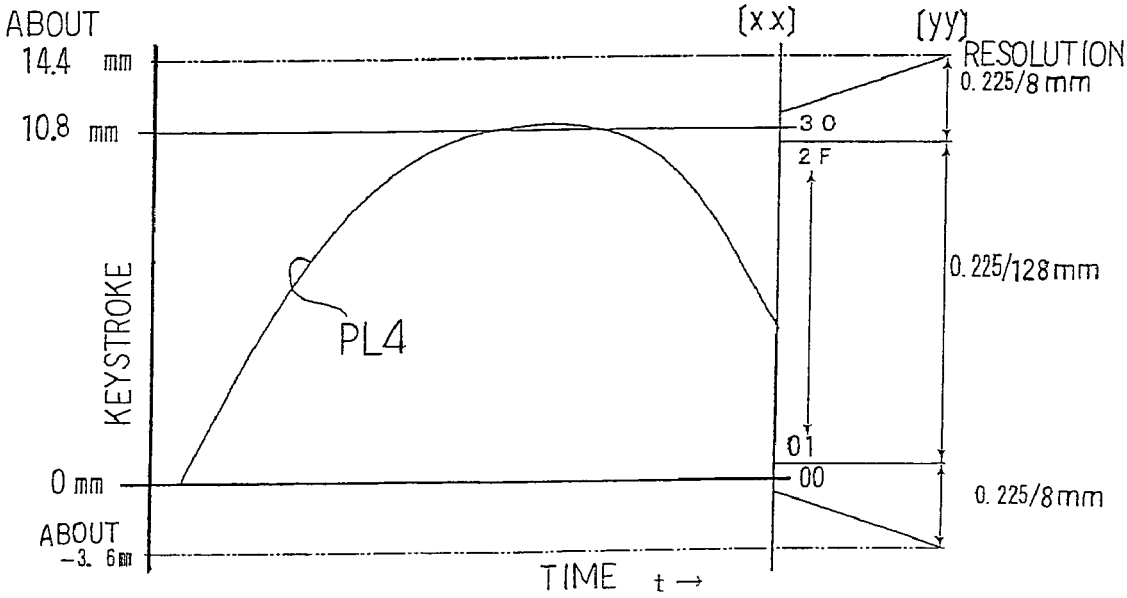
FIG. 10B is a graph showing a relation between an actual keystroke and basic positioning/extended positioning data for the third example.

FIGS. 10A and 10B show a relation between an actual hammer stroke PL3 and the hexadecimal numbers of the third bytes [xx] and [yy] and a relation between an actual keystroke PL4 and the hexadecimal numbers of the third bytes [xx] and [yy], respectively. The axes of abscissas are indicative of a lapse of time, and the axes of coordinates are indicative of the actual keystroke/actual hammer stroke or the current hammer position/current key position expressed by hexadecimal numbers [xx] and [yy].

FIGS. 11A and 11B show a table describing features of the basic positioning/extended positioning data for the actual hammer stroke and a table describing features of the basic positioning/extended positioning data for the actual keystroke.

Description is firstly made on the actual hammer stroke. The theoretical fully hammer stroke is assumed to be 48 millimeters. The rest position is equivalent to the hammer stroke of zero, and the end position is equivalent to the hammer stroke of 48 millimeters. The numerical range of the third byte [xx] is partially assigned to the hammer stroke, and partially assigned to the keystroke. In this instance, the numerical range [40h] to [70h] is assigned to the hammer stroke (see FIG. 11A). Each digit or each hexadecimal number expresses the hammer stroke of 1 millimeter. The hexadecimal number [40h] is indicative of the rest position, and the hexadecimal number [70h] is indicative of the end position. The current hammer position between the rest position and the end position is expressed by a hexadecimal number between [41h] and [6Fh], and the unit hammer stroke of 1 millimeter is assumed to be linearly varied. Thus, the features expressed by the third byte [xx] are same as those described in conjunction with FIGS. 6A and 7A.

When the third byte [xx] is indicative of the current hammer position between the rest position and the end position, i.e., from [41h] to [6Fh]. The third byte [yy] of each piece of extended positioning data [Bn 10 yy] and the third byte [yy] of each piece of extended positioning data [Bn 11 yy] precisely indicate the current hammer position, and express the increment and decrement, i.e., the offset value from the current hammer position expressed by the hexadecimal number of the third byte [xx]. Each digit or each hexadecimal number is equivalent to $1/128$ millimeter. Thus, the third byte [yy] expresses the offset value at a relatively high resolution under the condition that the hammer 150 travels between the rest position and the end position.

On the other hand, when the third byte [xx] is indicative of the rest position at [40h] or the end position at [70h], the third byte [yy] of each piece of extended positioning data [Bn 10 yy] is indicative of the current hammer position in the overrunning region outside of the end position, and the third byte [yy] of each piece of extended positioning data [Bn 11 yy] is indicative of the current hammer position in the overrunning region outside of the rest position. Each digit or each hexadecimal number is equivalent to $1/8$ millimeter. Thus, the third byte [yy] expresses the offset value at a relatively low resolution under the condition that the hammer 150 overruns the end position and rest position. The maximum increment is 15.875 millimeters from the end position, and the maximum decrement is −15.875 millimeters from the rest position. Thus, the pieces of extended positioning data offer the margin ±15.875 to the hammers 150, and make the detectable range prolonged on both sides of the ordinary range between the rest position and the end position. Since two sorts of the MIDI messages [Bn 10 yy] and [Bn 11 yy] are used for the pieces of extended positioning data, the resolution is improved rather that that of the first example.

A hammer 150 is assumed to travel in the ordinary region, which is equal to 48 millimeters, between the rest position and the end position. The third byte [xx] is greater than [40h] and less than [70h], and the resolution is 1.0 millimeter in the ordinary region. When the piece of basic positioning data and an associated piece of extended positioning data are expressed as [An kk xx] and [Bn 10 00], the hammer 150 is located at the current hammer position expressed by the third byte [xx], and the hexadecimal number [00h] of the third byte [yy] teaches that the positive offset is zero from the current hammer position expressed by the third byte [xx]. If the third byte [yy] is equivalent to [7Fh], the positive offset is maximized, and the maximum increment is equal to $127/128$ millimeter, i.e.,+0.9921875 millimeter. Thus, the piece of extended positioning data [Bn 10 yy] expresses the positive offset from zero millimeter to +0.9921875 millimeters at the resolution of $1/128$ millimeter.

On the other hand, when the piece of basic positioning data [An kk xx] is accompanied with a piece of extended positioning data [Bn 11 yy], the current hammer position is offset from the position equivalent to the third byte [xx] in the direction to the rest position. If the third byte [yy] is equivalent to hexadecimal number [00h], the negative offset is zero, and the hammer 150 is located at the current hammer position equivalent to the third byte [xx]. If the third byte [yy] is equivalent to hexadecimal number [7Fh], the negative offset is maximized, and the maximum decrement is equal to $-127/128$ millimeter, i.e., −0.9921875 millimeter. Thus, the piece of extended positioning data [Bn 11 yy] expresses the negative offset from zero to −0.9921875 millimeter at the resolution of $1/128$ millimeter.

The hammer 150 is assumed to overrun the end position or rest position. The third byte [xx] is equivalent to [40h] or [70h], and the resolution is $1/8$ millimeter in the overrunning regions. When the piece of basic positioning data [An kk xx] is accompanied with a piece of extended positioning data [Bn 10 yy], the hammer 150 overruns the end position. If the third byte [yy] is equivalent to [00h], the hammer 150 is located at the end position. If the third byte [yy] is equivalent to [7Fh], the current hammer position is positively offset from the end position by +127/8 millimeter, i.e., +15.875 millimeters. Thus, the third byte [yy] expresses the offset or increment from the end position at the resolution of ⅛ millimeter, and the maximum increment is equal to +15.875 millimeters.

On the other hand, when the piece of basic positioning data [An kk xx] is accompanied with a piece of extended positioning data [Bn 11 yy], the hammer 150 overruns the rest position. If the third byte [yy] is equivalent to [00h], the hammer 150 is located at the rest position. If the third byte [yy] is equivalent to [7Fh], the current hammer position is negatively offset from the rest position by −127/8 millimeter, i.e., −15.875 millimeters. Thus, the third byte [yy] expresses the negative offset or decrement from the rest position at the resolution of ⅛ millimeter, and the maximum decrement is equal to −15.875 millimeters.

A black/white key 130 is assumed to travel between the rest position, which is expressed by the hexadecimal number [00h], and a boundary key position, which is expressed by the hexadecimal number [30h]. The keystroke between the rest position and the end position is about 10 millimeters, and the keystroke at the boundary key position is equal to 10.8 millimeters. The resolution of the pieces of basic positioning data is 0.225 millimeter between the rest position and the boundary key position. On the other hand, the resolution of the pieces of extended positioning data is 0.225/128 millimeter between in the numerical range of the third byte [xx] between hexadecimal number [01h] and hexadecimal number [2Fh].

When the piece of basic positioning data and an associated piece of extended positioning data are expressed as [An kk xx] and [Bn 10 00], the black/white key 130 is located at the current key position expressed by the third byte [xx], and the hexadecimal number [00h] of the third byte [yy] teaches that the positive offset is zero from the current hammer position expressed by the third byte [xx]. If the third byte [yy] is equivalent to [7Fh], the positive offset or increment is maximized, and the maximum increment is equal to +127×0.225/128 millimeter, i.e.,+0.2232421875 millimeter. Thus, the piece of extended positioning data [Bn 10 yy] expresses the positive offset from zero millimeter to +0.2232421875 millimeter at the resolution of 0.225/128 millimeter.

On the other hand, when the piece of basic positioning data [An kk xx] is accompanied with a piece of extended positioning data [Bn 11 yy], the current key position is offset from the position equivalent to the third byte [xx] in the direction to the rest position. If the third byte [yy] is equivalent to hexadecimal number [00h], the negative offset or decrement is zero, and the black/white key 130 is located at the current key position equivalent to the third byte [xx]. If the third byte [yy] is equivalent to hexadecimal number [7Fh], the negative offset is maximized, and the maximum decrement is equal to −127×0.225/128 millimeter, i.e., −0.2232421875 millimeter. Thus, the piece of extended positioning data [Bn 11 yy] expresses the negative offset from zero to −0.2232421875 millimeter at the resolution of 0.225/128 millimeter.

The black/white key 130 is assumed to overrun the end position or boundary key position. The third byte [xx] is equivalent to [00h] or [30h], and the resolution is 0.225/8 millimeter in the overrunning regions. When the piece of basic positioning data [An kk xx] is accompanied with a piece of extended positioning data [Bn 10 yy], the black/white key 130 overruns the boundary key position. If the third byte [yy] is equivalent to [00h], the black/white key 130 is located at the boundary key position. If the third byte [yy] is equivalent to [7Fh], the current key position is positively offset from the boundary key position by +127×0.225/8 millimeter, i.e., +3.571875 millimeters. Thus, the third byte [yy] expresses the offset or increment from the boundary key position at the resolution of 0.225/8 millimeter, and the maximum increment is equal to +3.571875 millimeters.

On the other hand, when the piece of basic positioning data [An kk xx] is accompanied with a piece of extended positioning data [Bn 11 yy], the black/white key 130 overruns the rest position. If the third byte [yy] is equivalent to [00h], the black/white key 130 is located at the rest position. If the third byte [yy] is equivalent to [7Fh], the current key position is negatively offset from the rest position by −127×0.225/8 millimeter, i.e., −3.571875 millimeters. Thus, the third byte [yy] expresses the negative offset or decrement from the rest position at the resolution of 0.225/8 millimeter, and the maximum decrement is equal to −3.571875 millimeters.

Thus, the relatively low resolution is used in the overrunning regions so that the two sorts of voice messages can express the margin outside of the rest position and outside of the boundary key position.

Figure 12:
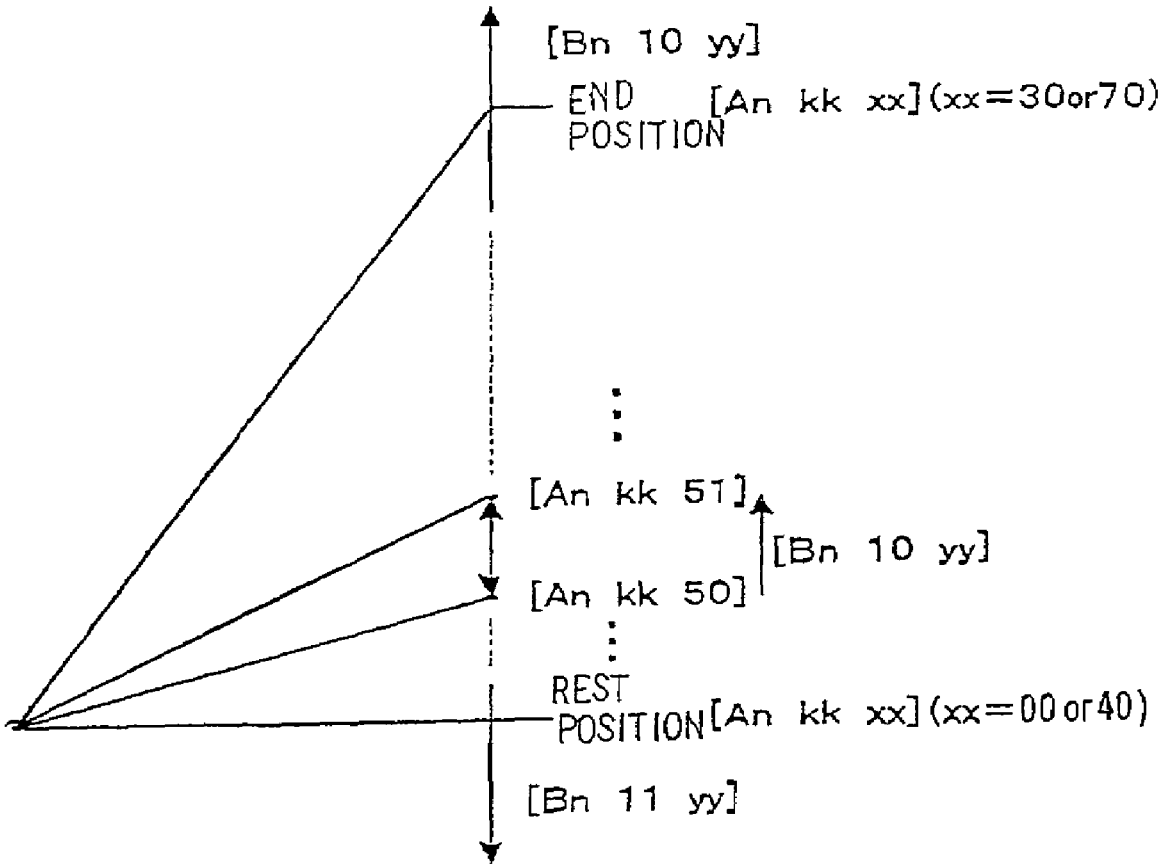
FIG. 12 is a diagram showing the numerical ranges assigned to pieces of basic positioning data and pieces of extended positioning data used in the third example.

Although both of the extended positioning data [Bn 10 yy] and [Bn 11 yy] are available for the current hammer position and current key position between the rest position and the end/boundary key position, only the extended positioning data [Bn 10 yy] is used for the offset from the position expressed by the third byte [xx] in the third example as shown in FIG. 12. The pieces of extended positioning data [Bn 11 yy] express the negative offset or negative decrement from the rest position [00h] or [40h], only. The hammer 150 and black/white key 130 are located at a current hammer position/current key position on the basis of the combination of piece of basic positioning data [An kk xx] and associated piece of extended positioning data [Bn 10 yy]. For example, when the hammer 150 or black/white key 130 reaches a certain position between the piece of basic positioning data [An kk 50] and the piece of basic positioning data [An kk 51], the positive offset from [An kk 50] is expressed by a piece of extended positioning data [Bn 10 yy]. If the hammer 150 or black/white key 130 overruns the end position or boundary key position, the hammer 150 or black/white key 130 is located at the current hammer position or current key position offset from the end position or boundary key position by the margin expressed by [Bn 10 yy].

Nevertheless, only the hammer 150 or black/white key 130 outside of the end position or boundary key position may be located at the current hammer position or current key position offset therefrom by the distance expressed by a piece of extended positioning data. Otherwise, the two sorts of voice messages [Bn 10 yy] and [Bn 11 yy] may be selectively used together with the voice message [An kk xx]. For example, if a hammer 150 or black/white key 130 is located at a current hammer position or a current key position on the basis of the piece of basic positioning data [An kk 50] and an associated extended positioning data [Bn 10 yy], it is possible to express the current hammer position or current key position by using the piece of basic positioning data [An kk 51] and another associated extended positioning data [Bn 11 yy].

The pieces of extended positioning data may express only the current hammer position and current key position in the overrunning regions. In this instance, the hammer 150 and black/white key 130 are located at a certain current hammer position and a certain current key position on the basis of only the pieces of basic positioning data [An kk xx].

As will be understood, the numerical range of the third byte [xx] is divided into two sub-ranges, the voice message [An kk xx] can expresses two sorts of current position as similar to the first example.

Moreover, the two sorts of voice messages [Bn 10 yy] and [Bn 11 yy] are used for the positive decrement and negative decrement, and this feature results in the resolution higher than the resolution of the first example. The resolution is changed between the ordinary region and the overrunning regions, and this feature results in the margin outside of the rest/end/boundary key positions.

Changing the resolution depending upon the current position on the actual trajectory, that is, the first concept of the present invention is realized in the first, second and third examples, and makes it possible to precisely express the actual motion of the moving object. The pieces of data, which express the actual motion, are encoded in the idle formats of the protocols employed in various musical instruments, and are stored in or supplied to another musical instrument. This feature is desirable, because the actual motion is accurately reproduced in the musical instrument in a playback.

The description has been made on the structure of the hybrid keyboard musical instrument, the system configuration of the recorder 107 and the basic positioning data/extended positioning data. The computer program, on which the central processing unit 200 or a digital signal processor runs, and a method, which is expressed in the computer program, is briefly described.

When a player instructs the recording system 105 to record his or her performance, the central processing unit 200 periodically fetches the digital key position signal from the analog-to-digital converter 250*a*. A key table, where memory areas are to be respectively assigned to the black/white keys 130, has been prepared, and the central processing unit 200 puts the pieces of positional data, which are expressed by the digital key position signals, into the queues at the respective memory areas. The periodical data fetching may be carried out through a timer interruption.

Upon return from the timer interruption sub-routine, the central processing unit 200 analyzes the queues or series of pieces of positional data to see whether or not the player depresses any one of the black/white keys 130. The central processing unit 200 is assumed to notice that a black/white key 130 is depressed. The central processing unit 200 produces the note-on message for the depressed black/white key 130, and writes the MIDI music data codes, which is representative of the note-on event, into the random access memory 210. Furthermore, the central processing unit 200 reads out selected ones of the pieces of positional data, which expresses the key trajectory from the queue, and determines the current key positions on the key trajectory.

When the central processing unit 200 determines each current key position, the central processing unit 200 roughly locates the current key position, and determines the offset from the rough key position. The central processing unit 200 produces the voice message [An kk xx] and the associated voice message [Bn 10 yy], and stores the voice messages [An kk xx] and [Bn 10 yy] into the random access memory 210. Even though the black/white key 130 overruns the end position, the central processing unit 200 determines the offset from the end position, and produces the voice messages [An kk xx] and [Bn 10 yy]. Thus, the central processing unit determines the key trajectory by using the current key positions each expressed by the voice messages [An kk xx] and [Bn 10 yy] or [Bn 11 yy] for each black/white key. The central processing unit repeats the above-described sequence, and produces the plural combinations of voice messages [An kk xx] and [Bn 10 yy]/[Bn 11 yy] for the depressed keys 130.

When the player releases the depressed black/white keys 130, the central processing unit 200 produces the MIDI music data code representative of the note-off message, and also determines the current key positions on the key trajectory toward the rest position. Each current key position is expressed by a combination of voice messages [An kk xx] and [Bn 10 yy]/[Bn 11 yy], and are stored in the random access memory 210. The central processing unit 200 repeats the above-described sequence, and produces the plural combinations of voice messages [An kk xx] and [Bn 10 yy]/[Bn 11 yy] for the released keys 130.

The central processing unit 200 also periodically fetches the digital hammer positions from the analog-to-digital converter 250*b*, and expresses current hammer positions on the hammer trajectories with the voice messages [An kk xx] and [Bn 10 yy]/[Bn 11 yy]. Since the key motion gives rise to the hammer motion, the central processing unit 200 correlates the voice messages [An kk xx] and [Bn 10 yy]/[Bn 11 yy] representative of the hammer trajectories with the voice messages [An kk xx] and [Bn 10 yy]/[Bn 11 yy] representative of the key trajectories.

When the player completes the performance, the player instructs the recording system 105 to store the set of MIDI music data codes into the memory unit 260. The central processing unit 200 requests the memory unit 260 to prepare a standard MIDI file, and transfers the set of MIDI music data codes to the memory unit 260. The memory unit 260 writes the set of MIDI music data codes in the data chunk of the standard MIDI file so that the performance is recorded in the information storage medium of the memory unit 260.

As will be understood from the foregoing description, players record their performances through the recording system 105, and the key motion is exactly expressed with the voice messages [An kk xx] and [Bn 10 yy]/[Bn 11 yy].

Second Embodiment

Figure 13:
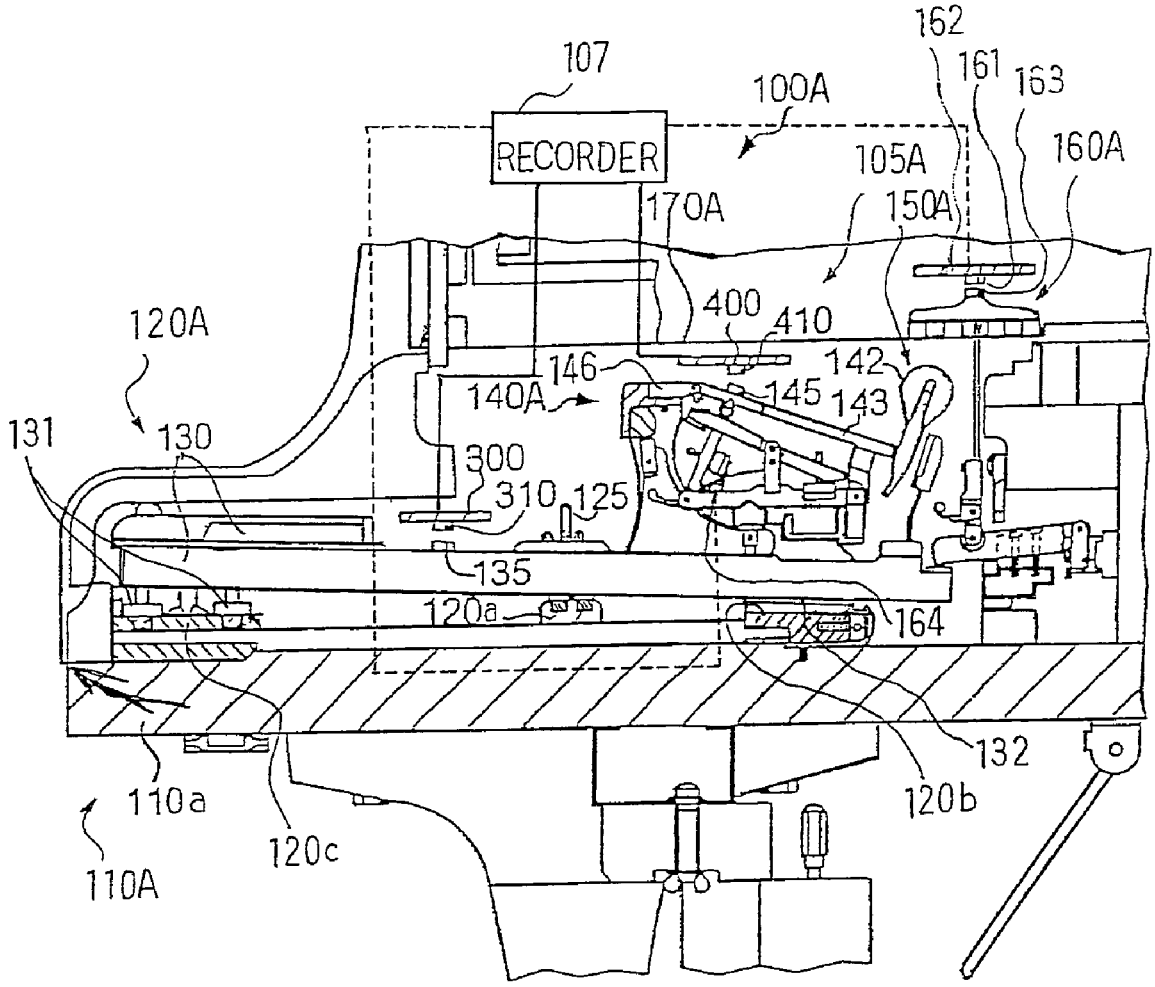
FIG. 13 is a cross sectional side view showing the structure of another hybrid keyboard musical according to the present invention.
Figure 14:
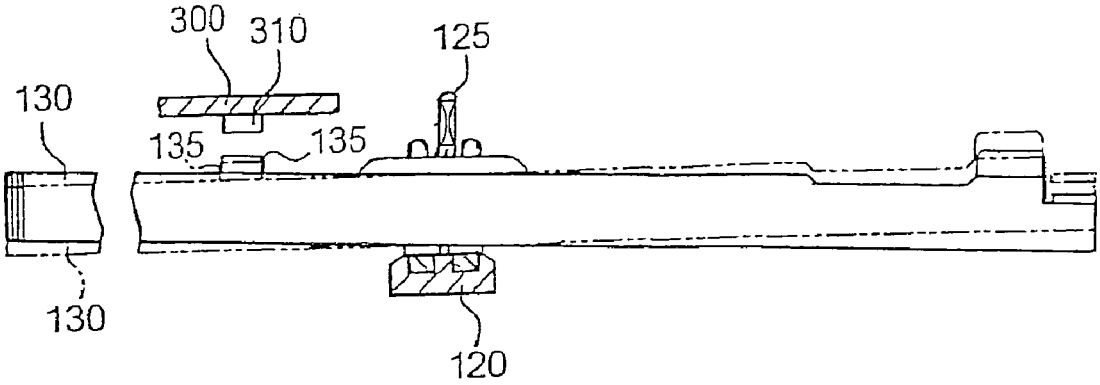
FIG. 14 is a side view showing a white key incorporated in the hybrid keyboard musical instrument.
Figure 15:
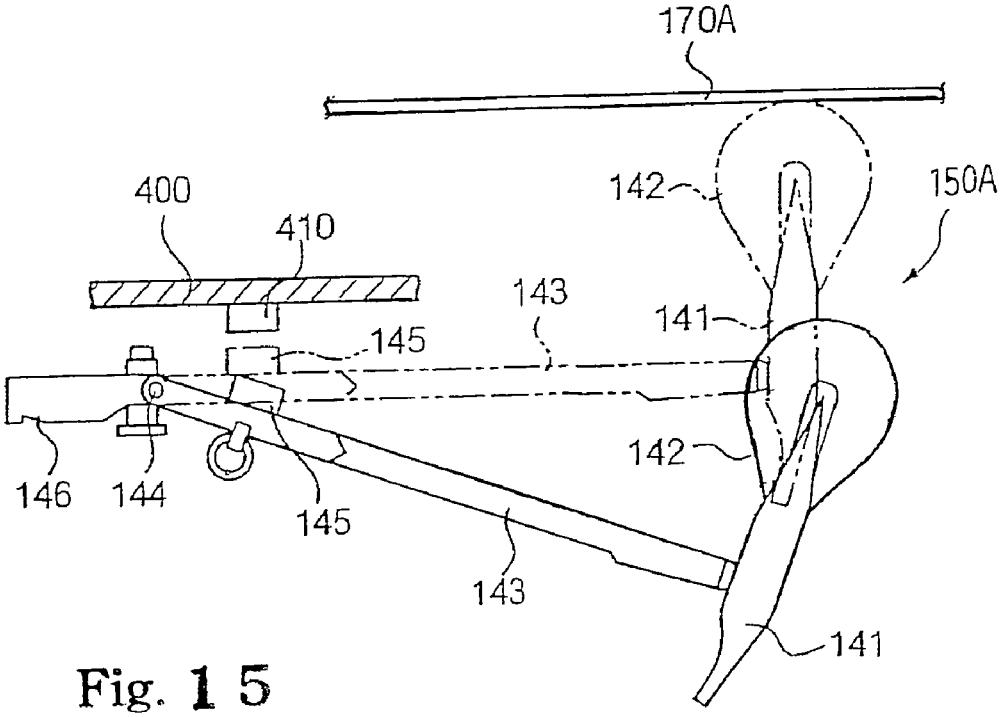
FIG. 15 is a side view showing a hammer also incorporated in the hybrid keyboard musical instrument.

Turning to FIGS. 13, 14 and 15, another hybrid keyboard musical instrument embodying the present invention largely comprises an acoustic piano 100A and a recording system 105A. The recording system 105A is installed in the acoustic piano 100A, and produces music data codes representative of a performance on the acoustic piano 100A.

The acoustic piano 100A includes a piano cabinet 110A, a keyboard 120A, action units 140A, hammers 150A, dampers 160A and strings 170A. These components 110A to 170A are similar in structure to the piano cabinet 110, keyboard 120, action unit 140, hammers 150, dampers 160 and strings 170. For this reason, parts of those components 110A to 170A are labeled with references designating corresponding parts of the components 110 to 170 without detailed description.

The parts of the components 110A to 170A are resiliently deformable, and some parts are plastically deformed as aged deterioration. For example, since front key cloth punchings 131 and a back rail cloth 132 receive the front portions and rear portions of the black/white keys 130, these parts 131 and 132 are compressed by the black/white keys 130. The black/white keys 130 leap on the balance rail 120*a*. In other words, the black/white keys 130 behave in actual performance differently from the ideal key motion. This results in that the black/white keys 130 tend to overrun the end positions and rest positions. Thus, the acoustic piano 100A behaves in the situation similar to that of the hybrid keyboard musical instrument described hereinbefore.

Figure 16:
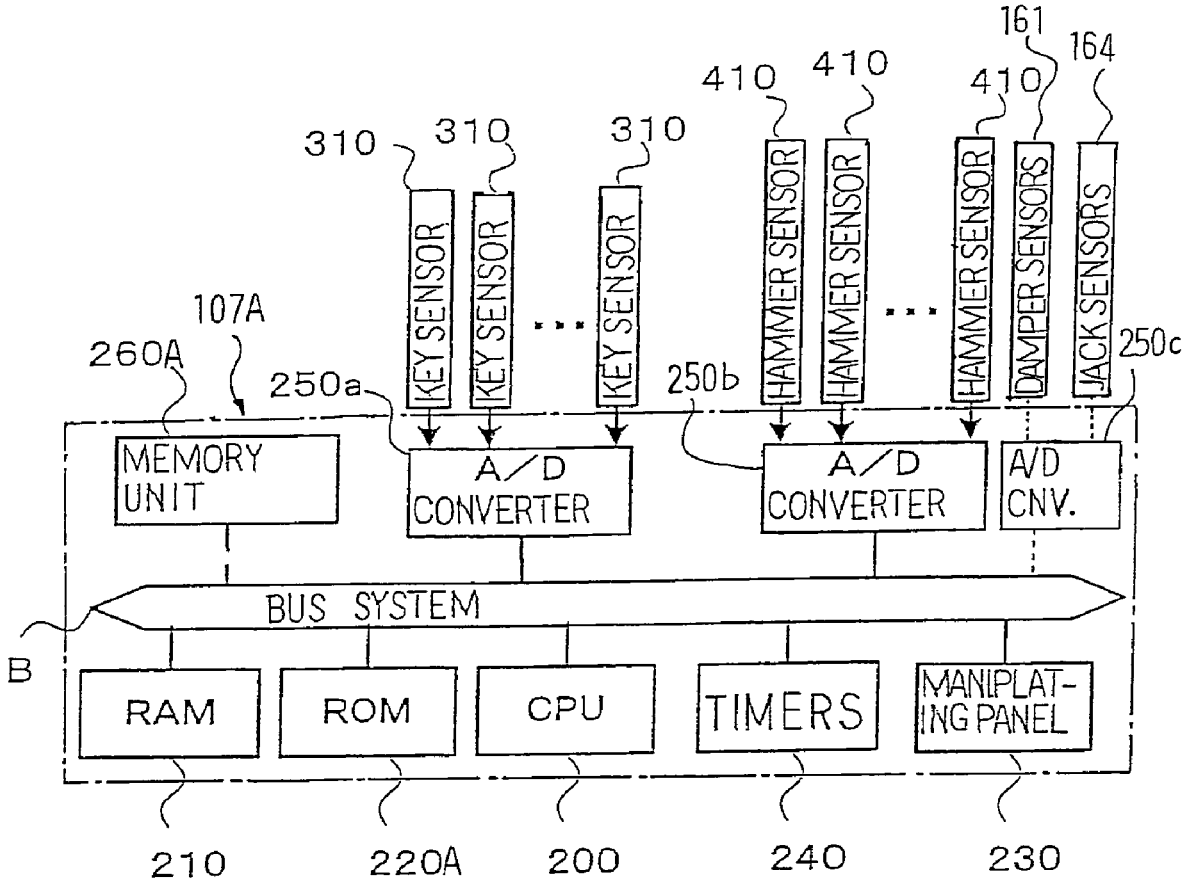
FIG. 16 is a block diagram showing the system configuration of a recorder incorporated in the hybrid keyboard musical instrument.

Turning to FIG. 16 of the drawings, the recording system 105A includes a recorder 107A, key sensors 310 and hammer sensors 410. The key sensors 310 are respectively associated with the black/white keys 130, and monitor the associated black/white keys 130. On the other hand, the hammer sensors 410 are respectively associated with the hammers 150A, and monitors the associated hammers 150A. The key sensors 310 and hammer sensors 410 are connected to the recorder 107A, and supply key position signals representative of current key positions of the associated black/white keys 130 and hammer position signals representative of current hammer positions of the associated hammers 150A.

As will be better seen in FIGS. 14 and 15, the key sensors 310 and hammer sensors 410 are supported by rigid plates 300 and 400 as similar to those of the first embodiment, and are also implemented by combinations of pairs of reflecting type photo-couplers 310/410 and reflection plates 135/145. The reflection-type photo-couplers 310/410 can discriminate a variation in length of the order of 0.001 millimeter, and the detectable range is longer than the theoretical full keystroke and theoretical full hammer stroke as similar to those of the first embodiment. Thus, the key sensors 310 and hammer sensors 410 are similar to those of the first embodiment, and no further description is hereinafter incorporated for avoiding repetition.

Although the key sensors 310 and hammer sensors 410 are prepared for the acoustic piano 100A, another sort of the component parts may be monitored with sensors. For example, damper sensors 161 may be provided over the dampers 160A. The damper sensors 161 will be attached to a rigid plate 162 in such a manner as to be opposed to reflection plates 163. As described hereinbefore, the dampers 160A permit the strings 170A to vibrate and decay the vibrations. However, the dampers 160A are not merely changed between the two positions. In actual performances, pianists sometimes keep the dampers 160A lightly in contact with the strings 170A so as to impart an artificial expression to the tones. If the damper sensors 161 are further installed in the acoustic piano 100A, the recorder 107A acquires another sort of music data from the damper sensors 161, and makes the performance closer to the original performance.

Jack sensors 164 may be further prepared for jacks incorporated in the action units 140A. The jacks are well-known to persons in the art, and are important component parts of the action units 140A. While a player is depressing a black/white key 130, the depressed black/white key 130 lifts the associated hammer 150A, and drives the hammer 150A to rotate in the opposite direction to the action unit 140A. When the jack is brought into contact with an associated regulating button, the jack escapes from the associated hammer 150A, and the associated hammer starts the freefly toward the strings 170A. Thus, the jacks define the timing to escape from the hammers 150A, and give important data to the recorder 107A. For this reason, the jack sensors 164 are provided on the whippen, and monitor the associated jacks.

Though not shown in the drawings, pedal sensors may monitor the damper pedal, soft pedal and sostenuto pedal. Another voice message may be assigned to the pedals, and the numerical range is divided into three sub-ranges, which are assigned to the three pedals, respectively.

Turning back to FIG. 16 of the drawings, the recorder 107A includes a central processing unit 200, which is abbreviated as "CPU", a random access memory 210, which is abbreviated as "RAM", a read only memory 220A, which is abbreviated as "ROM", a manipulating panel 230, timers 240, analog-to-digital converters 250*a*/250*b*/250*c*, a built-in memory unit 260A and a shared bus system B.

The central processing unit 200, random access memory 210, read only memory 220A, manipulating panel 230, timers 240, analog-to-digital converters 250*a*/250*b*/250*c* and the memory unit 260A are connected to the shared bus system B so that the central processing unit 200 can communicate with the other components 210/220A/230/240/250*a*/250*b*/250*c*/260A through the shared bus system B. The eighty-eight key sensors 310 are connected to the analog-to-digital converter 250*a*, and the key position signals are converted to digital key position signals by means of the analog-to-digital converter 250*a*. On the other hand, the eighty-eight hammer sensors 410 are connected to the other analog-to-digital converter 250*b*, and the hammer position signals are converted to digital hammer position signals through the analog-to-digital converter 250*b*. The digital key position signal and digital hammer position signal have a bit string long enough to express the resolution. In this instance, 12 bits are assigned to the current key position or current hammer position.

If the damper sensors 161 and jack sensors 164 are further incorporated in the recording system 105A, the damper sensors 161 and jack sensors 164 are connected to the analog-to-digital converter 250*c*, and analog damper position signals and analog jack position signals are converted to digital damper position signals and digital jack position signals before being fetched by the central processing unit 200.

Computer programs and tables of parameters are stored in the read only memory 220A, and the random access memory 210 serves as a working memory. The central processing unit 200 runs on the computer programs, and accomplishes tasks expressed in the computer programs so as to produce music data codes representative of MIDI messages for a performance on the keyboard 120A. A set of music data codes representative of the MIDI messages, i.e., MIDI music data codes is stored in the memory unit 260A, and are transferred from the memory unit 260A to the random access memory 210 before reproduction of the performance. The manipulating panel 230, timers 240 and memory unit 260A behaves similarly to those of the first embodiment, and no further description is hereinafter incorporated for the sake of simplicity.

While a pianist is performing a piece of music on the acoustic piano 100A, the central processing unit 200 runs on the computer program so as to produce the MIDI music data codes. The central processing unit 200 periodically fetches pieces of data representative of the current key positions and pieces of data representative of current hammer positions from the analog-to-digital converters 250*a*/250*b*, and writes the current key positions and current hammer positions in the random access memory 210. The new current key positions and new current hammer positions are added to series of current key positions and series of current hammer positions already stored in the random access memory 210. The central processing unit 200 checks the series of current key positions to see whether or not any key 130 is moved. When the central processing unit 200 finds a black/white key 130 changed in position, the central processing unit 200 determines the key motion, and produces MIDI voice messages, i.e., note-on messages and note-off messages for the tones to be produced and decayed. The central processing units 200 further starts the timer 240 at the occurrence of the MIDI voice message, and stops the timer 240 at the occurrence of the next MIDI voice message. The central processing unit 200 measures the lapse of time between the MIDI voice messages, and produces a duration data code representative of the lapse of time. The set of MIDI music data codes representative of a performance is stored in a standard MIDI file together with voice messages representative of the key trajectories and hammer trajectories. The voice messages for the key trajectories and hammer trajectories will be hereinafter described in detail.

In this instance, the central processing unit 200 further produces the voice messages representative of the current key positions and current hammer positions. The idle formats, which are not employed in musical instrument used for the playback, are also assigned to the voice messages representative of the current key positions and current hammer positions, and the MIDI music data codes representative of the current key positions and current hammer positions are stored in the standard MIDI file created in the memory unit 260A together with the MIDI music data representative of the note-on, note-off and lapse of time. The idle formats will be hereinlater described in detail.

Positioning Data

FIG. 17 shows the idle formats assigned to the key motion and hammer motion, respectively. Although the formats are assigned to the polyphonic key pressure and control change in the MIDI protocols, the polyphonic key pressure and control change are useless in an musical instrument such as, for example, an automatic player piano, through which the performance is reproduced. In other words, these formats stand idle in the automatic player piano. For this reason, the idle formats are assigned to basic positioning data and extended positioning data as described hereinafter in detail.

The basic positioning data and extended positioning data express the current key position and current hammer position at different resolution. A piece of the basic positioning data roughly indicates the current key position on the key trajectory between the rest position and the end position or the current hammer position on the hammer trajectory between the rest position and the end position at a relatively low resolution. In other words, a certain region of the key trajectory between the rest position and the end position or a certain region on the hammer trajectory between the rest position and the end position is roughly specified by the piece of basic positioning data.

On the other hand, a piece of the extended positioning data is indicative of the current key position in the certain region at a relatively high resolution or the current key position in the overrunning region at a relatively low resolution. Otherwise, the piece of extended positioning data is indicative of the current hammer position in the certain region at the relatively high resolution or the current hammer position in the overrunning region at a relatively low resolution. Thus, the piece of extended positioning data describes not only the keystroke/hammer stroke between the rest position and the end position but also the keystroke/hammer stroke in the overrunning region. Since the basic positioning data and extended positioning data are shared between the current key position and the current hammer position, two numerical ranges are respectively assigned to the black/white keys 130 and hammers 150A as similar to those used in the first embodiment.

Comparing the idle formats shown in FIG. 17 with the idle formats shown in FIG. 5, it is understood that the pieces of basic positioning data and pieces of extended positioning data are also encoded into the formats usually assigned to the polyphonic key pressure and control change in the MIDI protocols. In other words, the bit strings of the first, second and third bytes are same as those described in conjunction with the first embodiment. For this reason, the idle formats shown in FIG. 17 are not detailed for the sake of simplicity.

Although the third byte [xx] can express 128 hexadecimal numbers, the numerical range expressed by the third byte [xx] is divided into two numerical sub-ranges, i.e., from [01h] to [30h] and from [40h] to [70h], and the two numerical sub-ranges are respectively assigned to the current key position and current hammer position, respectively, as shown in FIG. 18. The basic positioning data can theoretically occupy the numerical range from [00h] to [7Fh]. The numerical range contains two numerical sub-ranges [01h] to [30h] and [40h] to [70h], which are respectively assigned to the black/white keys 130 and hammers 150A. On the other hand, the extended positioning data occupy the numerical range from [00h] to [7Fh], and the numerical range [00h] to [7Fh] is shared between the black/white keys 130 and the hammers 150A. It is possible to determine whether the third byte [yy] expresses the current key position or the current hammer position depending upon the numerical sub-range [01h]-[30h] or [40h]-[70h] expressed by the third byte [xx] of the antecedent basic positioning data.

The third byte [xx] is assumed to be fallen into the numerical sub-range [01h] to [30h]. The central processing unit 200 notices the third byte [xx] roughly expressing the current key position, and interprets that the associated piece of extended positioning data accurately expresses the current key position. If, on the other hand, the central processing unit 200 finds the third byte [xx] to be within the numerical sub-range from [40h] to [70h], the central processing unit 200 determines that the third byte [xx] roughly expresses the current hammer position, and the associated piece of extended positioning data accurately locate the current hammer position.

As will be understood, the voice message [An kk xx] is shared between plural component parts, i.e., the black/white keys 130 and the hammers 150A, and the different numerical sub-ranges are respectively assigned to the black/white keys 130 and hammers 150A. This feature is desirable from the viewpoint that the economical usage of the voice messages. Another advantage is that the shared voice message [An kk xx] makes editors easy to modify a set of MIDI music data codes. For example, an editor is assumed to modify the set of MIDI music data codes for a certain sort of musical instrument, the data processor of which can not control the manipulators with the basic positioning data and extended positioning data. The editor simply makes the voice message [An kk xx] disabled. Then, the data processor ignores the voice message [An kk xx]. Thus, the shared voice message makes the editorial work easy. Another editor is assumed to make tones in a certain register removed from a music passage. The editor easily selects the notes by using the note numbers. The editor simply compares the second byte [kk] with the note numbers in the certain register for both black/white keys 130 and hammers 150A. Then, the editor concurrently finds not only the pieces of basic positioning data for the black/white keys 130 but also the associated pieces of extended positioning data from the set of MIDI music data codes.

The numerical sub-range from [01h] to [30h] is antecedent to the other numerical sub-range from [40h] to [7Fh]. Similarly, the black/white keys are firstly moved, and the hammers follow the key action. Thus, the numerical sub-ranges are consistent with the order of activation. This feature is also desirable, because the editor easily makes the numerical sub-ranges correlated with the numerical sub-ranges.

EXAMPLE 1

Figure 19A:
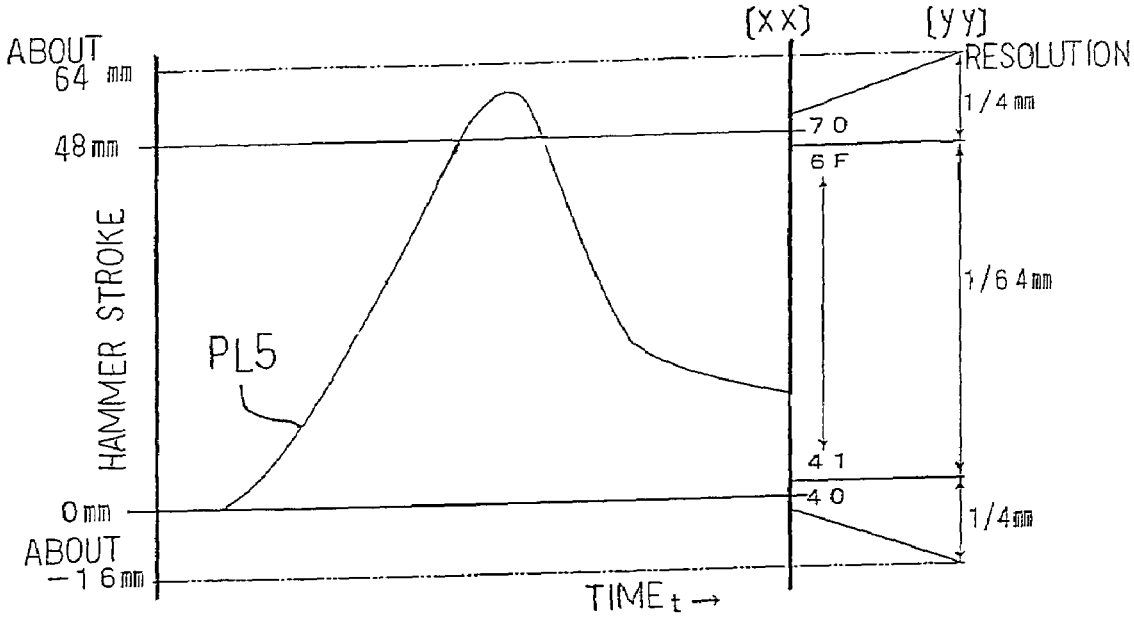
FIG. 19A is a graph showing a relation between an actual hammer stroke and basic positioning/extended positioning data for the first example.
Figure 19B:
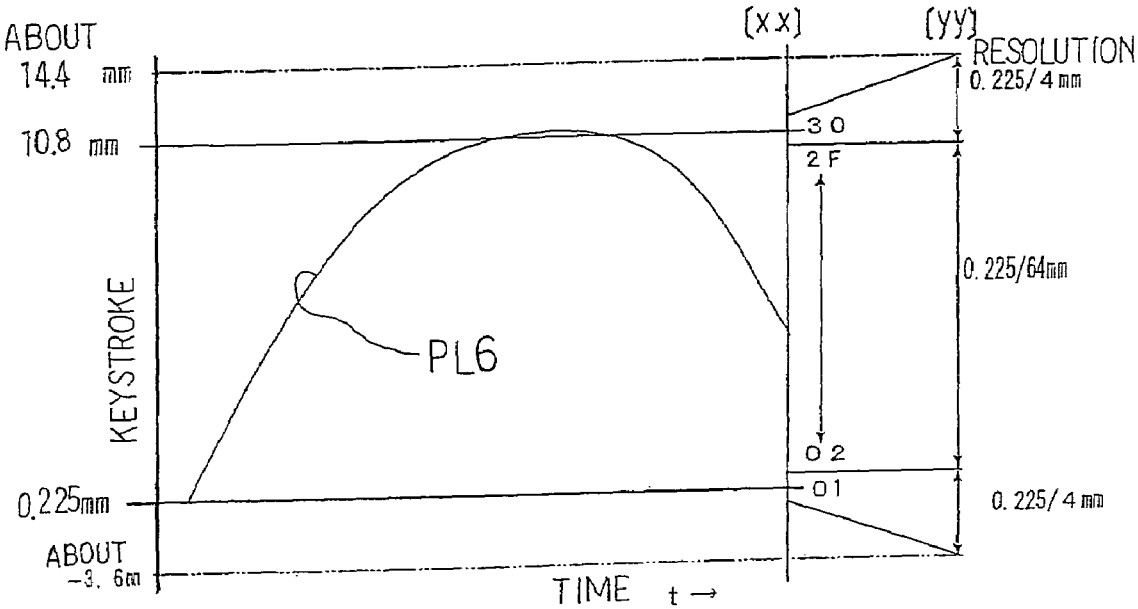
FIG. 19B is a graph showing a relation between an actual keystroke and basic positioning/extended positioning data for the first example.

FIGS. 19A and 19B show a hammer trajectory PL5 and a key trajectory PL6. The hammer 150A starts the rest position, which is located at 0 millimeter, and overruns the end position, which is located at 48 millimeters. The hammer reaches the maximum actual hammer stroke. Then, the hammer 150A starts to return toward the rest position. The hammer 150A passes through the end position, and stops at a certain position between the end position and the rest position.

On the other hand, the black/white key 130 passes through a current hammer position, which is located at 0.225 millimeter from the rest position, and overruns the end position. The black/white key 130 passes another certain position, which is located at 10.8 millimeters from the end position, and reaches the maximum actual keystroke. The black/white key 130 returns toward the rest position, and stops at a position between the rest position and the end position.

Comparing FIGS. 19A and 19B with FIGS. 6A and 6B, the hammer trajectory PL5 and key trajectory PL6 are same as the hammer trajectory PL1 and key trajectory PL2, respectively. For this reason, no further description is hereinafter incorporated for the sake of simplicity.

A current hammer position on the hammer trajectory PL5 is expressed by a piece of basic positioning data [An kk xx] and an associated piece of extended positioning data [Bn 10 yy]. A current key position on the key trajectory PL6 is also expressed by a piece of basic positioning data [An kk xx] and an associated piece of extended positioning data [Bn 10 yy]. Although the third byte [xx] can expresses 128 hexadecimal numbers from [00h] to [7Fh], a numerical sub-range from [40h] to [70h] is assigned to the hammers 150A, and another numerical sub-range from [01h] to [30h] is assigned to the black/white keys 130.

The third byte [yy] also expresses 128 hexadecimal numbers from [00h] to [7Fh]. However, the numerical range is shared between the hammers 150A and the black/white keys 130. The piece of extended positioning data [Bn 10 yy] follows the piece of basic positioning data [An kk xx], and the common numerical range is applied to either hammers 150A or black/white keys 130 depending upon the numerical sub-range of the third byte [xx]. Thus, a piece of basic positioning data [An kk xx] and the associated piece of extended positioning data [Bn 10 yy] can express the current hammer position or current key position by virtue of the split numerical range.

The third byte of the pieces of extended positioning data [Bn 10 yy] is differently interpreted by the central processing unit 200 depending upon the hexadecimal number of the third byte [xx]. When the third byte [xx] expresses a hexadecimal number greater than [40h] and less than [70h] or a hexadecimal number greater than [01h] and less than [30h], a relatively high resolution is applied to the hexadecimal number of the third byte [yy]. On the other hand, when the third byte [xx] expresses the hexadecimal number [40h]/[70h] or the hexadecimal number [01h]/[30h], a relatively low resolution is applied to the hexadecimal number of the third byte [yy]. The relatively high resolution is 1/64 millimeter for the hammers 150A and 0.225 millimeter for the black/white key 130. On the other hand, the relatively low resolution is 1/4 millimeter for the hammers 150A and 0.225/64 millimeter for the black/white keys 130. Thus, the basic positioning data [An kk xx] and extended positioning data [Bn kk yy] are designed in the same manner as those applied to the first embodiment. For this reason, the features of the basic positioning data [An kk xx] and extended positioning data [Bn 10 yy] are tabled in FIGS. 20A and 20B without detailed description.

SECOND EXAMPLE

Figure 21A:
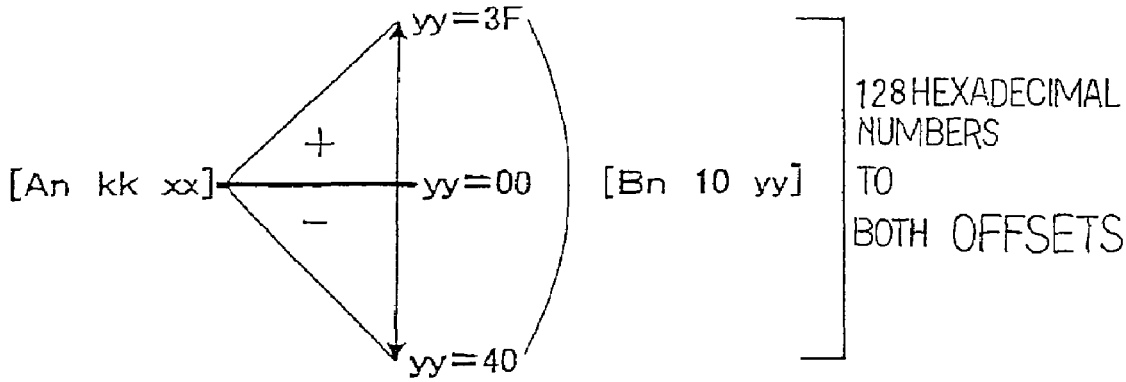
FIG. 21A is a view showing the numerical ranges assigned to a decrement and an increment in the first example.
Figure 21B:
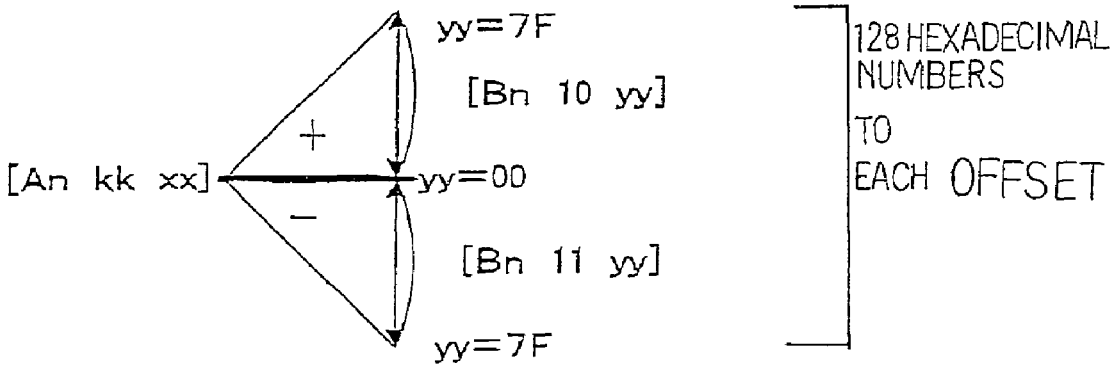
FIG. 21B is a view showing the numerical ranges assigned to a decrement and an increment in the second example.

Although only one sort of the voice messages [Bn 10 yy] is assigned to the extended positioning data for expressing both positive and negative offsets in the first example, two sorts of voice messages [Bn 10 yy] and [Bn 11 yy] are assigned to the extended positioning data for expressing the positive offset and negative offset, respectively. FIGS. 21A and 21B shows the difference between the first example and the second example.

Figure 22A:
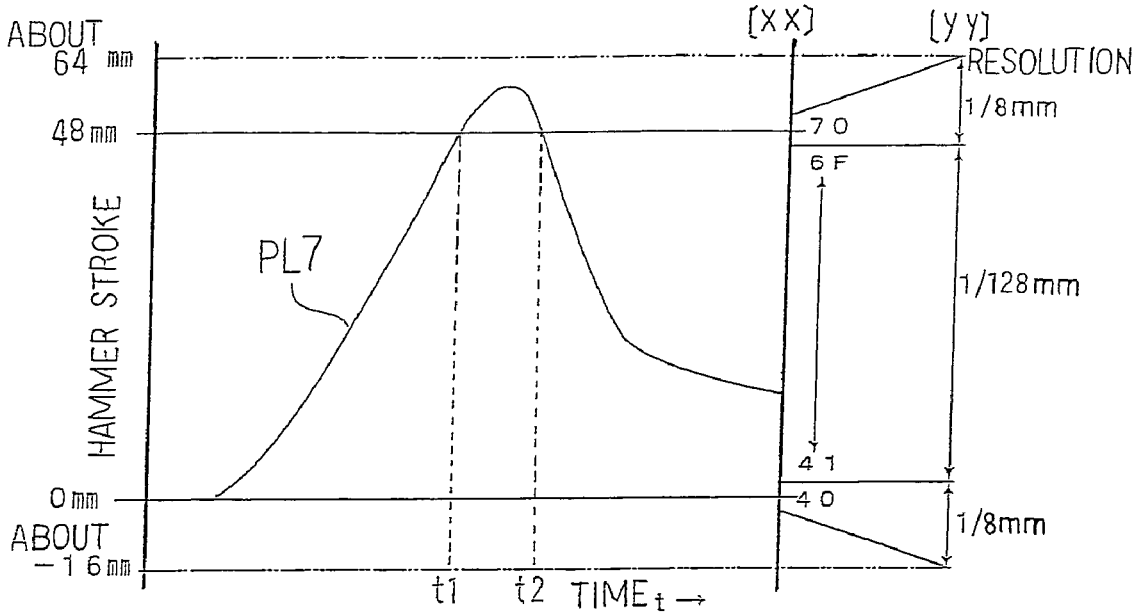
FIG. 22A is a graph showing a relation between an actual hammer stroke and basic positioning/extended positioning data for the second example.
Figure 22B:
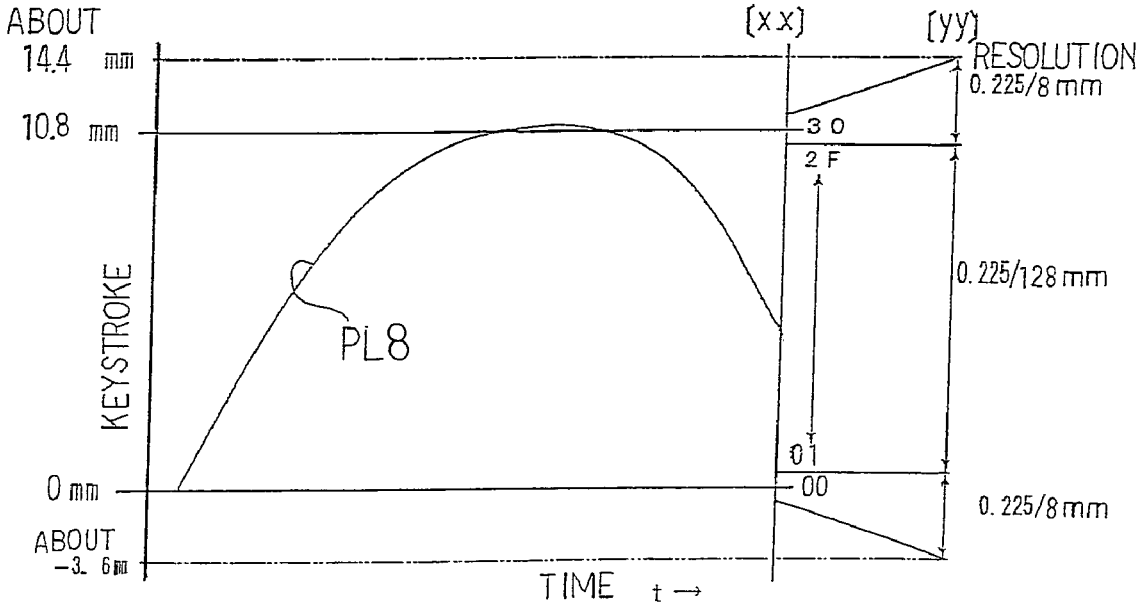
FIG. 22B is a graph showing a relation between an actual keystroke and basic positioning/extended positioning data for the second example.

Assuming now that a hammer and a black/white key 130 are moved on a hammer trajectory PL7 and a key trajectory PL8 shown in FIGS. 22A and 22B, a piece of basic positioning data [An kk xx] and an associated piece of extended positioning data [Bn 10 yy] or [Bn 11 yy] locate the hammer 150A and black/white key 130 at a current hammer position and a current key position as similar to the third example of the first embodiment. For this reason, the features of the basic positioning data [An kk xx] and features of the extended positioning data [Bn 10 yy] and [Bn 11 yy] are tabled in FIGS. 23A and 23B, respectively, without detailed description. Comparing FIGS. 23A and 23B with FIGS. 11A and 11B, it is understood that the basic positioning data [An kk xx] and extended positioning data [Bn 10 yy] and [Bn 11 yy] express the current hammer position and current key position as similar to those in the third example of the first embodiment. Detailed description is omitted for the sake of simplicity.

Figure 24:
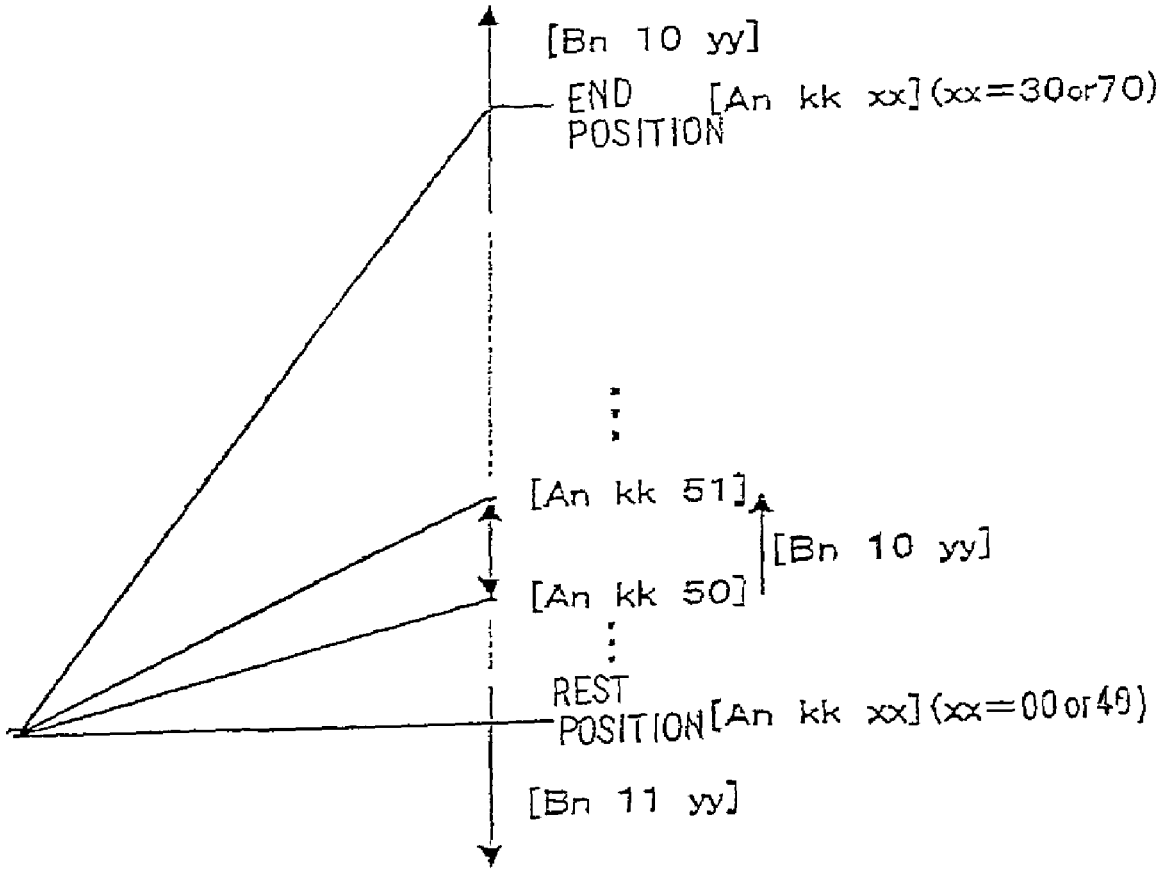
FIG. 24 is a diagram showing the numerical ranges assigned to pieces of basic positioning data and pieces of extended positioning data used in the second example.

Although both of the extended positioning data [Bn 10 yy] and [Bn 11 yy] are available for the current hammer position and current key position between the rest position and the end/boundary key position, only the extended positioning data [Bn 10 yy] is used for the offset from the position expressed by the third byte [xx] in the second example as shown in FIG. 24. The pieces of extended positioning data [Bn 11 yy] express the negative offset or negative decrement from the rest position [00h] or [40h], only. The hammer 150A and black/white key 130 are located at a current hammer position/current key position on the basis of the combination of piece of basic positioning data [An kk xx] and associated piece of extended positioning data [Bn 10 yy]. This rule is same as that applied to the third example of the first embodiment, and no further description is incorporated hereinafter for avoiding undesirable repetition.

As will be appreciated from the foregoing description, the numerical range of the third byte [xx] is divided into plural numerical sub-ranges, which are respectively assigned to different sorts of component parts. In the first and second examples, two sorts of component parts, i.e., the black/white keys 130 and hammers 150A are respectively monitored by the key sensors 310 and hammer sensors 410. When more than two sorts of component parts are to be monitored by plural arrays of sensors, the numerical range of the third byte [xx] is divided into plural numerical sub-ranges equal to the plural sorts, and the plural numerical sub-ranges are respectively assigned to the plural sorts of component parts, respectively. In case where the dampers 160 are monitored by the damper sensors 161 as similar to the black/white keys 130 and hammers 150A, the numerical sub-ranges from [01h] to [30h], from [40h] to [70h] and from [71h] to [7Fh] may be assigned to the black/white keys 130, hammers 150A and dampers 160A, respectively. Thus, the only one sort of voice messages is shared between the plural sorts of component parts. This results in the advantages described hereinbefore in detail.

The present invention is not restricted to the hybrid keyboard musical instrument with the built-in recording system 105A. The recording system 105A may be prepared separately from the acoustic piano 100A. The manufacturer may retrofit an acoustic piano to the hybrid keyboard musical instrument by using the separate-type recording system 105A.

The recording system 105A behaves as similar to the recording system 105, and no further description is hereinafter incorporated for the sake of simplicity.

Third Embodiment

Figure 25:
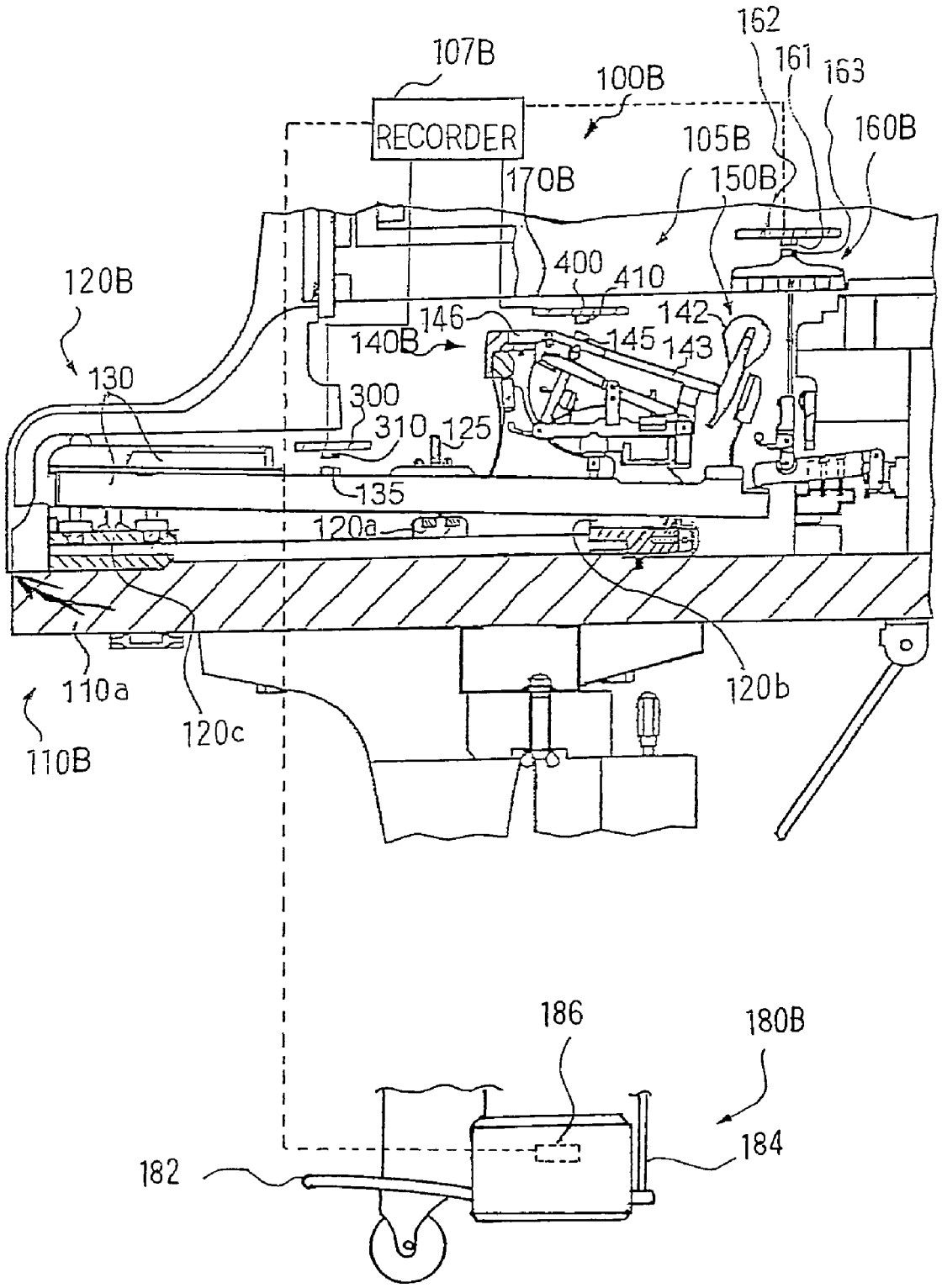
FIG. 25 is a cross sectional side view showing the structure of yet another hybrid keyboard musical according to the present invention.
Figure 26:
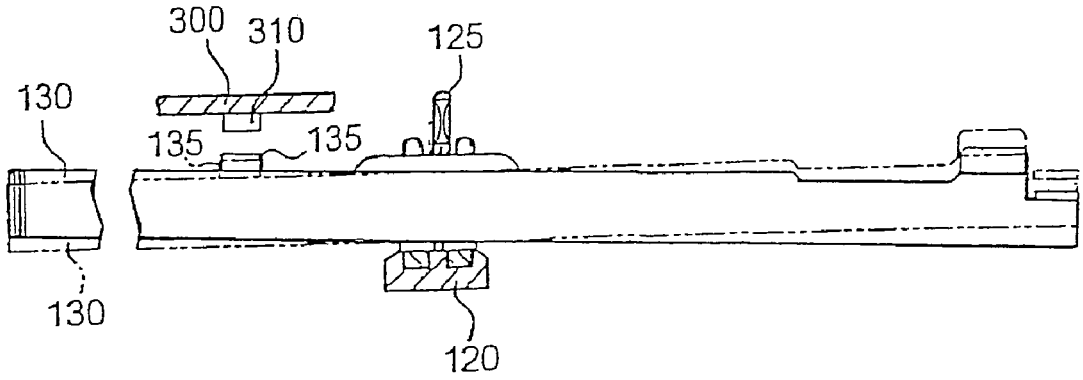
FIG. 26 is a side view showing a white key incorporated in the hybrid keyboard musical instrument.
Figure 27:
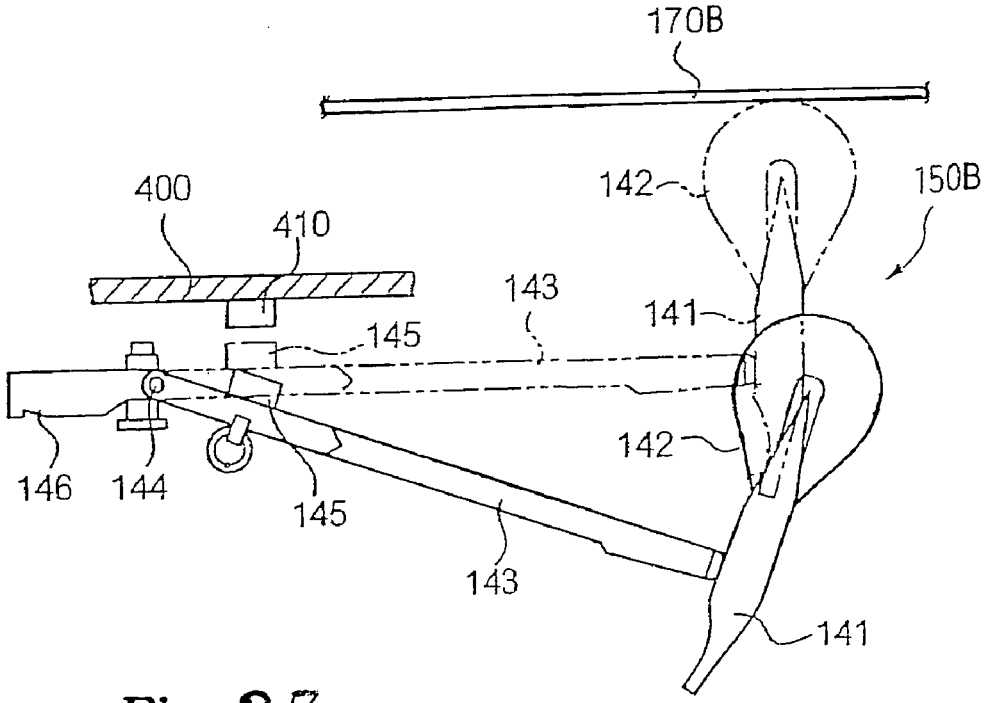
FIG. 27 is a side view showing a hammer also incorporated in the hybrid keyboard musical instrument.

FIG. 25 shows the structure of yet another hybrid keyboard musical instrument embodying the present invention, and FIGS. 26 and 27 show a black/white key 130 and a hammer 150B both incorporated in the hybrid keyboard musical instrument.

The hybrid keyboard musical instrument implementing the third embodiment largely comprises an acoustic piano 100B and a recording system 105B. The recording system 105B is installed in the acoustic piano 100B, and produces music data codes representative of a performance on the acoustic piano 100B.

The acoustic piano 100B includes a piano cabinet 110B, a keyboard 120B, action units 140B, hammers 150B, dampers 160B, strings 170B and a pedal system 180B. These components 110B to 170B are similar in structure to the piano cabinet 110, keyboard 120, action unit 140, hammers 150, dampers 160 and strings 170. For this reason, parts of those components 110A to 170A are labeled with references designating corresponding parts of the components 110 to 170 without detailed description.

The pedal system 180B includes a damper pedal, a soft pedal and a muffler pedal, i.e., three pedals 182 and link works 184 respectively connected to the three pedals 182. These three pedals 182 are well known to the persons skilled in the art, and, for this reason, no further description is hereinafter incorporated.

Figure 28:
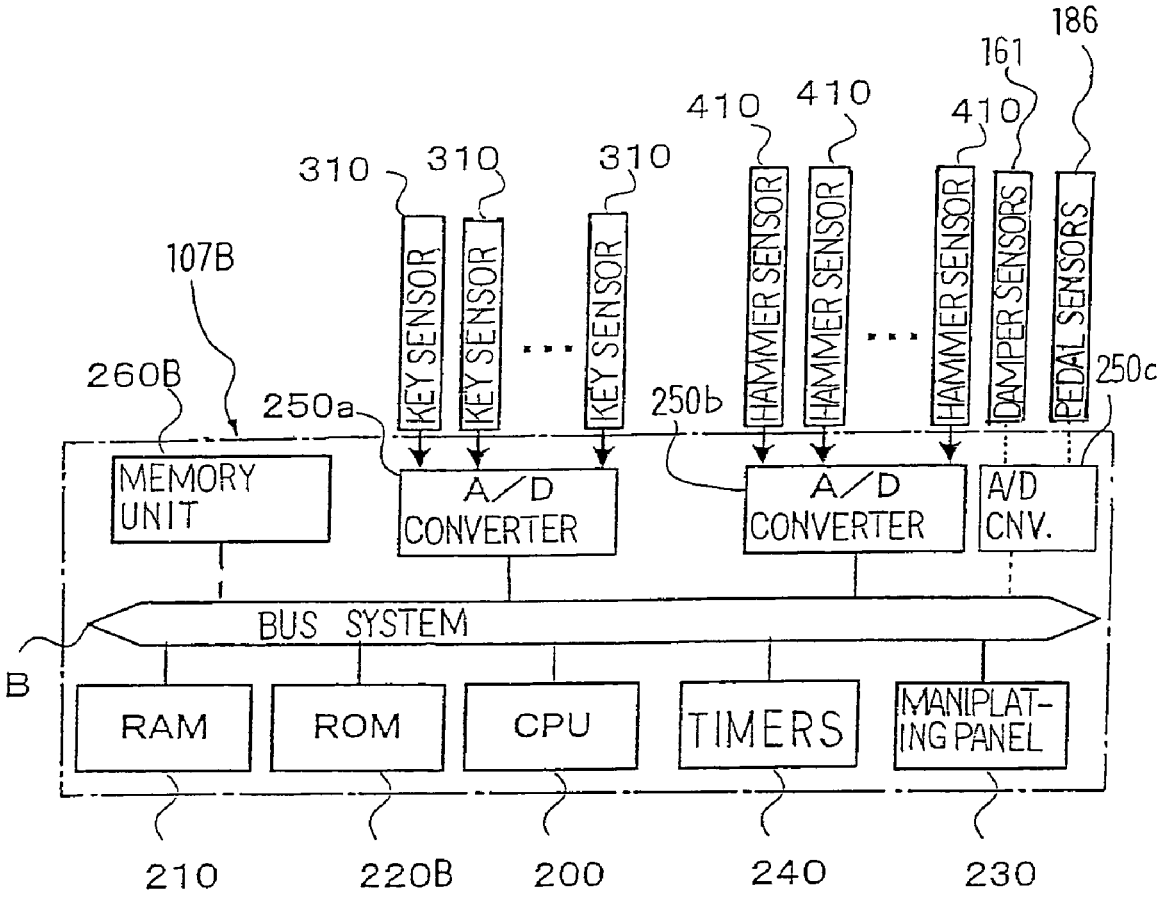
FIG. 28 is a block diagram showing the system configuration of a recorder incorporated in the hybrid keyboard musical instrument.

Turning to FIG. 28 of the drawings, the recording system 105B includes a recorder 107B, key sensors 310 and hammer sensors 410. The key sensors 310 are respectively associated with the black/white keys 130, and monitor the associated black/white keys 130. The hammer sensors 410 are also respectively associated with the hammers 150B, and monitor the associated hammers 150B. The key sensors 310 and hammer sensors 410 are connected to the recorder 107B, and supply key position signals representative of current key positions of the associated black/white keys 130 and hammer position signals representative of current hammer positions of the associated hammers 150B.

As will be better seen in FIGS. 26 and 27, the key sensors 310 and hammer sensors 410 are supported by rigid plates 300 and 400 as similar to those of the first embodiment, and are also implemented by combinations of pairs of reflecting type photo-couplers 310/410 and reflection plates 135/145. The reflection-type photo-couplers 310/410 can discriminate a variation in length of the order of 0.001 millimeter. Thus, the key sensors 310 and hammer sensors 410 are similar to those of the first embodiment, and no further description is hereinafter incorporated for avoiding repetition.

Although the key sensors 310 and hammer sensors 410 are prepared for the acoustic piano 100B, another sort of the component parts may be monitored with sensors. For example, damper sensors 161 may be provided over the dampers 160B. The damper sensors 161 will be attached to a rigid plate 162 in such a manner as to be opposed to reflection plates 163. As described hereinbefore, the dampers 160B permit the strings 170B to vibrate and decay the vibrations. However, the dampers 160B are not merely changed between the two positions. In actual performances, pianists sometimes keep the dampers 160B lightly in contact with the strings 170B so as to impart an artificial expression to the tones. If the damper sensors 161 are further installed in the acoustic piano 100B, the recorder 107B acquires another sort of music data from the damper sensors 161, and makes the recorded performance closer to the original performance.

Pedal sensors 186 may be further provided for the pedals 182. The pedal sensors 186 monitor the pedal motion, and supply pedal position signals to the recorder 107B. The player sometimes selectively steps on the pedals 182 in his or her performance so as to impart effects to the tones. Although the player usually depresses the pedals 182 to the end positions, he or she sometimes keeps the pedals 182 at a certain position between the rest positions and the end positions. When the player depresses the damper pedal, by way of example, the dampers 160B are perfectly spaced from the associated strings 170B, and the acoustic piano tones are prolonged. On the other hand, when the player keeps the damper pedal at the certain position, the dampers 160B are held lightly in contact with the strings 170B, and the acoustic piano tones are produced differently from those on the condition that the damper pedal is depressed to the end position. Thus, the pedal stroke has the influence on the acoustic piano tones. If the pedal sensors 186 are provided for the three pedals 182, the recorder 107B can determine the pedal trajectories so as to impart the effects to the acoustic tones.

Turning back to FIG. 28 of the drawings, the recorder 107B includes a central processing unit 200, a random access memory 210, a read only memory 220B, a manipulating panel 230, timers 240, analog-to-digital converters 250*a*/250*b*/250*c*, a built-in memory unit 260B and a shared bus system B.

The central processing unit 200, random access memory 210, read only memory 220B, manipulating panel 230, timers 240, analog-to-digital converters 250*a*/250*b*/250*c* and the memory unit 260B are connected to the shared bus system B so that the central processing unit 200 can communicate with the other components 210/220B/230/240/250*a*/250*b*/250*c*/260B through the shared bus system B. The eighty-eight key sensors 310 are connected to the analog-to-digital converter 250*a*, and the key position signals are converted to digital key position signals by means of the analog-to-digital converter 250*a*. On the other hand, the eighty-eight hammer sensors 410 are connected to the other analog-to-digital converter 250*b*, and the hammer position signals are converted to digital hammer position signals through the analog-to-digital converter 250*b*. The digital key position signal and digital hammer position signal have a bit string long enough to express the resolution. In this instance, 12 bits are assigned to the current key position or current hammer position.

If the damper sensors 161 and pedal sensors 186 are further incorporated in the recording system 105B, the damper sensors 161 and pedal sensors 186 are connected to the analog-to-digital converter 250*c*, and analog damper position signals and analog pedal position signals are converted to digital damper position signals and digital pedal position signals before being fetched by the central processing unit 200.

Computer programs and tables of parameters are stored in the read only memory 220B, and the random access memory 210 serves as a working memory. The central processing unit 200 runs on the computer programs, and accomplishes tasks expressed in the computer programs so as to produce music data codes representative of MIDI messages for a performance on the keyboard 120. A set of music data codes representative of the MIDI messages, i.e., MIDI music data codes is stored in the memory unit 260B, and are transferred from the memory unit 260B to the random access memory 210 before reproduction of the performance. The manipulating panel 230, timers 240 and memory unit 260A behaves similarly to those of the first embodiment, and no further description is hereinafter incorporated for the sake of simplicity.

While a pianist is performing a piece of music on the acoustic piano 100B, the central processing unit 200 runs on the computer program so as to produce the MIDI music data codes. The central processing unit 200 periodically fetches pieces of data representative of the current key positions and pieces of data representative of current hammer positions from the analog-to-digital converters 250*a*/250*b*, and writes the current key positions and current hammer positions in the random access memory 210. The new current key positions and new current hammer positions are added to series of current key positions and series of current hammer positions already stored in the random access memory 210.

The central processing unit 200 checks the series of current key positions to see whether or not any key 130 is moved. When the central processing unit 200 finds a black/white key 130 changed in position, the central processing unit 200 determines the key motion, and produces MIDI voice messages, note-on messages and note-off messages for the tones to be produced and decayed. The central processing units 200 further starts the timer 240 at the occurrence of the MIDI voice message, and stops the timer 240 at the occurrence of the next MIDI voice message. The central processing unit 200 measures the lapse of time between the MIDI voice messages, and produces a duration data code representative of the lapse of time. The set of MIDI music data codes representative of a performance is stored in a standard MIDI file.

In this instance, the central processing unit 200 further produces the voice messages representative of the current key positions and current hammer positions. The idle formats are also assigned to the voice messages representative of the current key positions and current hammer positions, and the MIDI music data codes representative of the current key positions and current hammer positions are stored in the standard MIDI file created in the memory unit 260B together with the MIDI music data representative of the note-on, note-off and lapse of time. The idle formats will be hereinlater described in detail.

Positioning Data

FIG. 29 shows a series of pieces of basic positioning data/extended positioning data. A piece of basic positioning data and an associated piece of extended positioning data express a current key position on the key trajectory or a current hammer position on the hammer trajectory as similar to those of the first and second embodiments. The black/white key 130 or hammer 150B is located at a rough key position or rough hammer position with the piece of basic positioning data, and the associated piece of extended positioning data gives the offset from the rough key position or rough hammer position to the black/white key 130 or hammer 150B. When the black/white key 130 or hammer 150B is located at the rough key position or rough hammer position between the rest position and the end position, the offset is given at a high resolution. However, when the black/white key 130 or hammer 150 overruns the rest position or end position, the offset is given at a low resolution.

FIRST EXAMPLE

As shown in FIG. 29, the basic positioning data are coded in the idle format [An kk xx], and the extended positioning data are coded in the idle format [Bn 10 yy]. The first byte [An], second byte [kk] and third byte [xx] are same as those of the basic positioning data used in the first and second embodiment, and the first byte [Bn], second byte [10] and third byte [yy] are also same as those of the extended positioning data used in the first and second embodiments. For this reason, description on the idle formats is omitted for the sake of simplicity.

The usage of the idle formats makes the edition easy and speedy. For example, a designer is assumed to wish to shift the key trajectories to either side of the presently expressed trajectories. The designer searches the set of the MIDI music data codes for the idle formats, and changes the third bytes [xx] and/or [yy] from the previous hexadecimal numbers to new hexadecimal numbers. Thus, the usage of the idle formats is desirable for the editing work.

Figure 30A:
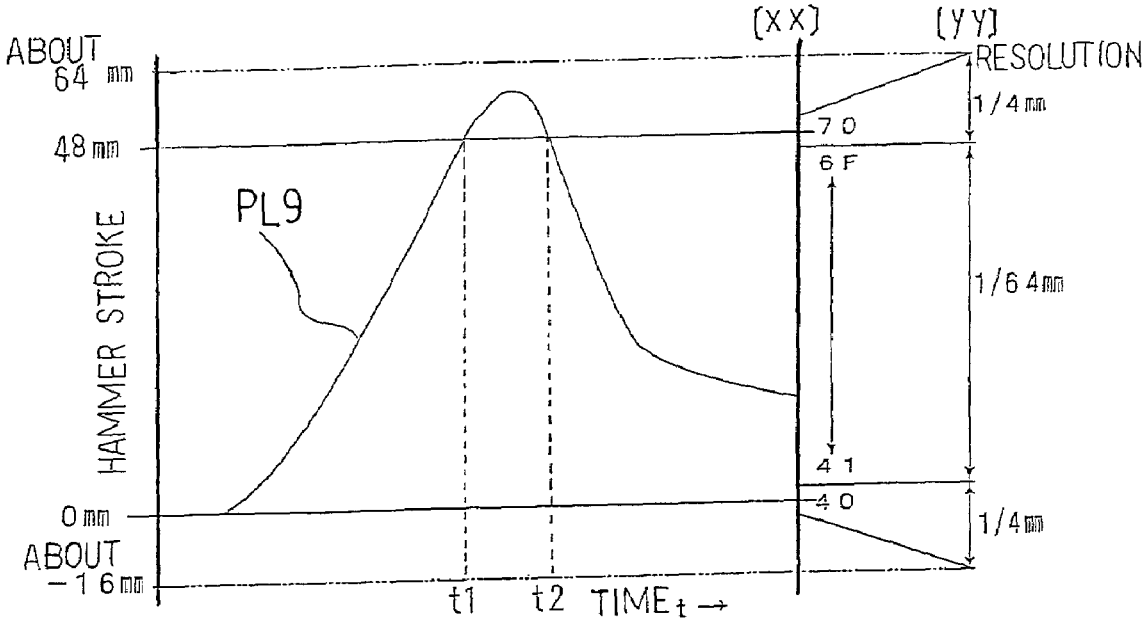
FIG. 30A is a graph showing a relation between an actual hammer stroke and basic positioning/extended positioning data for the first example.
Figure 30B:
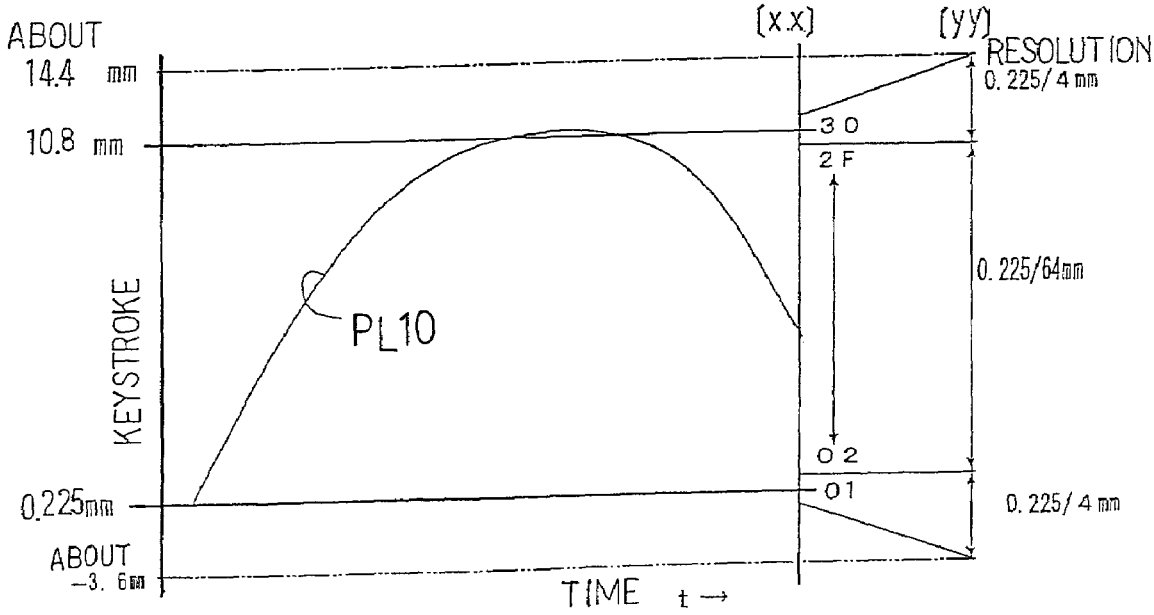
FIG. 30B is a graph showing a relation between an actual keystroke and basic positioning/extended positioning data for the first example.

FIGS. 30A and 30B show a hammer trajectory PL9 and a key trajectory PL10. The numerical range of the third byte [xx] assigned to the hammers 150B is from [40h] to [70h], and the numerical range from [01h] to [30h] is assigned to the black and white keys 130.

The theoretical full hammer stroke is 48 millimeters, and the rest position and end position are located at 0 millimeter and 48 millimeters. The hammer stroke of 1 millimeter between the rest position and the end position is equivalent to each increment of the hexadecimal number expressed by the third byte [xx]. On the other hand, the offset is expressed at intervals of 1/64 millimeter between the rest position and the end position, and at intervals of 1/4 millimeter in the overrunning regions.

On the other hand, the theoretical full keystroke is about 10 millimeters, and each increment of the hexadecimal number expressed by the third byte [xx] is equivalent to 0.225 millimeter. The offset is expressed at internals of 0.225/64 millimeter between the rest position and the end position, and at intervals of 0.225/4 in the overrunning regions.

Comparing FIGS. 30A and 30B with FIGS. 6A and 6B, the hammer trajectory shown in FIG. 30A and key trajectory shown in FIG. 30B are respectively same as the hammer trajectory shown in FIG. 6A and key trajectory shown in FIG. 6B, and the theoretical full hammer stroke and theoretical full keystroke are equal between the first embodiment and the third embodiment. The features of the data positioning system are same as those of the data positioning system employed in the first embodiment as shown in FIGS. 31A and 31B, and detailed description is omitted for the sake of simplicity.

SECOND EXAMPLE

As described hereinbefore, the basic positioning data [An kk xx] is accompanied with only one sort of extended positioning data [Bn 10 yy] in the first example, and the offset is expressed by a piece of extended positioning data [Bn 10 yy]. This means that only a predetermined pitch or multiple of the predetermined pitch expresses the offset from the rough hammer position or rough key position. The hammer or key is not always found at any one of the marks of the scale, which is defined by the only one sort of the extended positioning data. However, more than one sort of extended positioning data makes it possible to locate the black/white key 130 or hammer 150B at a mark of one of the different scales, which are defined by the more than one sort of extended positioning data, respectively. From this viewpoint, the black/white key 130 or hammer 150B is accurately located at the current key position or current hammer position with a piece of basic positioning data and associated pieces of extended positioning data, the pitches of which are different from one another. This means that a piece of basic positioning data is accompanied with more than one piece of extended positioning data, which are respectively discriminative by identifiers. Of course, if the black/white key 130 or hammer 150B is found at a mark of the scale defined by only one sort of extended positioning data, the piece of the basic positioning data and associated single piece of extended positioning data express the current key position or current hammer position as similar to the first example.

FIG. 32A shows a set of pieces of extended positioning data, which follows a piece of basic positioning data [An kk xx]. A piece of the first extended positioning data is coded in the above-described format [Bn 10 yy], and expresses an offset from the rough key position or rough hammer position at the resolution, i.e., 0.225/64 millimeter, 0.225/4 millimeter or 1/64 millimeter, 1/4 millimeter. Thus, the piece of the first extended positioning data [Bn 10 yy] locates the black/white key 130 or hammer 150B at a fairly accurate key position or a fairly accurate key position. A piece of the second extended positioning data is coded in another format [Bn 30 yy'], and the first byte [Bn] and second byte [30] are indicative of the second extended positioning data. The third byte [yy'] expresses an offset from the fairly accurate key position or fairly accurate hammer position at a resolution higher than that of the piece of first extended positioning data [Bn 10 yy]. Thus, the piece of the second extended positioning data [Bn 30 yy'] locates the black/white key 130 or hammer 150B at a well accurate key position or a well accurate hammer position. A piece of the third extended positioning data is coded in the yet another format [Bn 11 zz], and the first byte [Bn] and second byte [11] are indicative of the third extended positioning data. The third byte [zz] expresses an offset from the well accurate key position or well accurate hammer position at a resolution higher than that of the piece of the second extended positioning data [Bn 30 yy']. Thus, the piece of the third extended positioning data [Bn 11 zz] locates the black/white key 130 or hammer 150B at a remarkably accurate key position or a remarkably accurate key position. A piece of the fourth extended positioning data is coded in still another format [Bn 31 zz'], and the first byte [Bn] and second byte [31] are indicative of the fourth extended positioning data. The third byte [zz'] expresses an offset from the remarkably accurate key position or remarkably accurate hammer position at a resolution higher than that of the piece of the third extended positioning data. Thus, the piece of the fourth extended positioning data [Bn 31 zz'] locates the black/white key 130 or hammer 150B at an extremely accurate key position or an extremely accurate hammer position.

FIG. 32B shows another set of extended positioning data, which follows a piece of basic positioning data [An kk xx]. The pieces of the first, second and third extended positioning data share the numerical range, i.e., [00h] to [7Fh] of the third byte. In detail, the numerical range of the third byte is divided into plural numerical sub-ranges, which are respectively assigned to the first extended positioning data, second extended positioning data, third extended positioning data, . . . The piece of basic extended positioning data [An kk xx] locates the black/white key 130 or hammer 150B at a rough key position or a rough hammer position. The piece of the first extended positioning data expresses an offset from the rough key position or rough hammer position at a resolution higher than that of the piece of basic positioning data, and locates the black/white key 130 or hammer 150B at a fairly accurate key position or a fairly accurate hammer position. The piece of the second extended positioning data expresses an offset from the fairly accurate key position or fairly accurate hammer position at a resolution higher than that of the piece of the first extended positioning data. Thus, the piece of the second extended positioning data locates the black/white key 130 or hammer 150B at a well accurate key position or a well accurate hammer position. The piece of the third extended positioning data expresses an offset from the well accurate key position or well accurate hammer position at a resolution higher than that of the piece of second extended positioning data, and locates the black/white key 130 or hammer 150B at a remarkably accurate key position or a remarkably accurate hammer position.

As will be understood, the extended positioning data make it possible to accurately express the current key position and current hammer position. Thus, the basic positioning data accompanied with the extended positioning data are preferable to a single sort of positioning data.

THIRD EXAMPLE

Figure 33A:
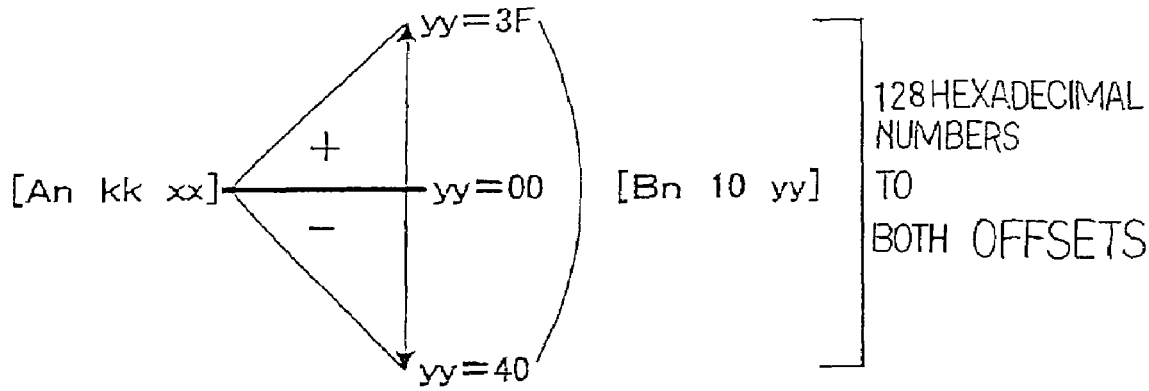
FIG. 33A is a view showing the numerical ranges assigned to a decrement and an increment in the first example.
Figure 33B:
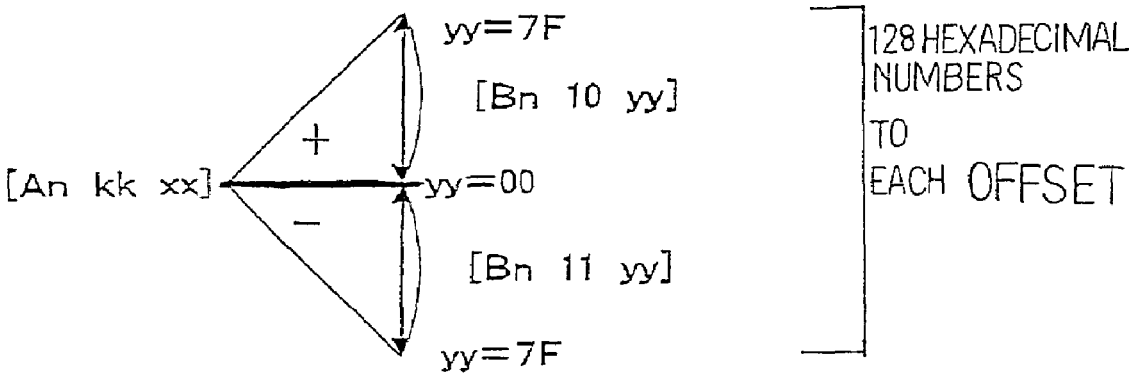
FIG. 33B is a view showing the numerical ranges assigned to a decrement and an increment in the third example.

The basic concepts, which are respectively employed in the first and third examples, are shown in FIGS. 33A and 33B. Although 128 hexadecimal numbers are assigned to both positive and negative offsets in the first example as shown in FIG. 33A, 128 hexadecimal numbers are assigned to each of the positive and negative offsets in the third example as shown in FIG. 33B. This results in a resolution twice higher than that of the first example. In order to assign 128 hexadecimal numbers to each of the positive and negative offsets, pieces of extended positioning data are coded in two sorts of formats, i.e., [Bn 10 yy] and [Bn 11 yy].

Figure 34A:
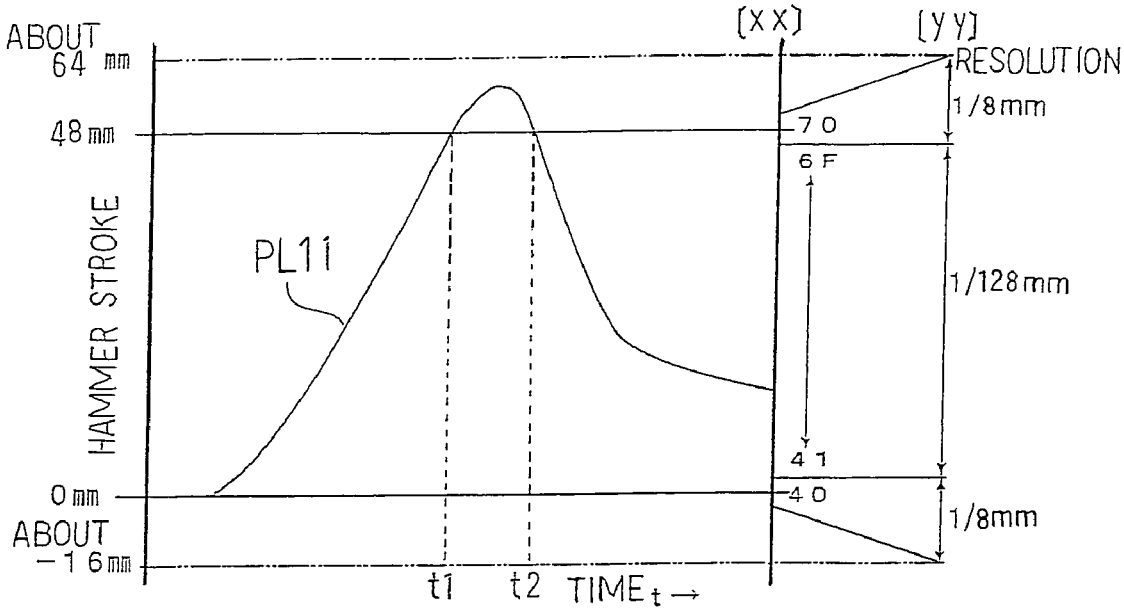
FIG. 34A is a graph showing a relation between an actual hammer stroke and basic positioning/extended positioning data for the third example.
Figure 34B:
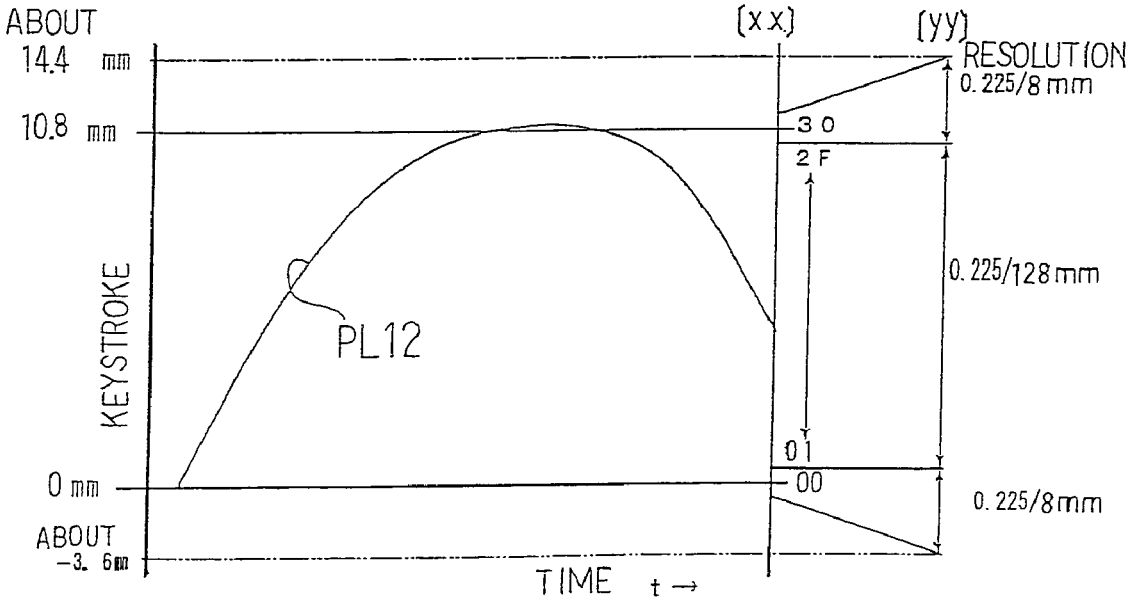
FIG. 34B is a graph showing a relation between an actual keystroke and basic positioning/extended positioning data for the third example.

FIGS. 34A and 34B show a relation between a hammer trajectory and the basic positioning data/extended positioning data and a relation between a key trajectory and the basic positioning data/extended positioning data. As similar to the third example of the first embodiment. The theoretical full hammer stroke and theoretical full keystroke are 48 millimeters and 10 millimeters, respectively, and the numerical range of the third byte [xx] contains two sub-ranges, i.e., from [40h] to [70h] and from [00h] to [7Fh], and the two numerical sub-ranges are respectively assigned to the hammers 150B and black/white keys 130. For this reason, the features of the basic positioning data/extended positioning data are same as those of the basic positioning/extended positioning data used in the third example of the first embodiment as shown in FIGS. 35A and 35B.

Figure 36:
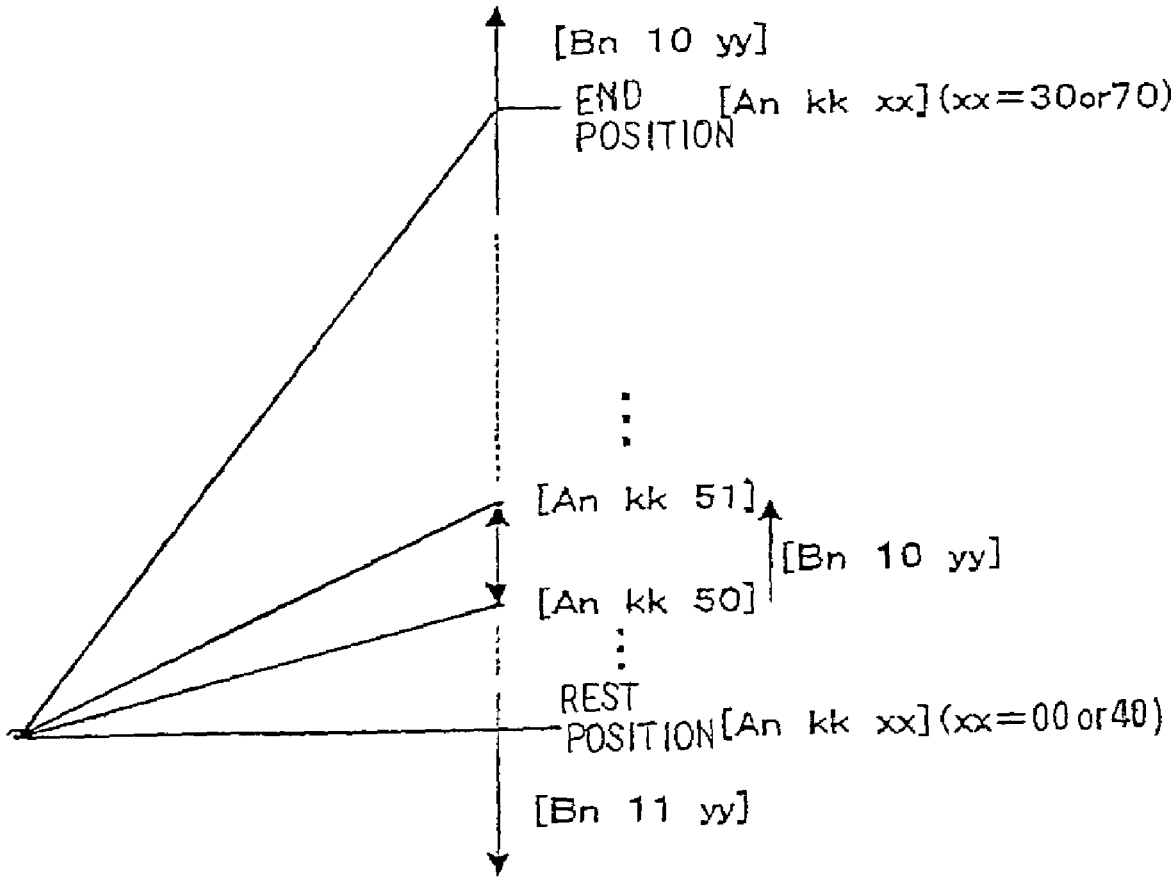
FIG. 36 is a diagram showing the numerical ranges assigned to pieces of basic positioning data and pieces of extended positioning data used in the second example.

Although either combination between a piece of basic positioning data [An kk xx] and an associated piece of extended positioning data [Bn 10 yy] or [Bn 11 yy] can express a current hammer position or a current key position between the rest position and the end position, the combination between a piece of basic positioning data [An kk xx] and an associated piece of extended positioning data [Bn 10 yy] may be used for the current hammer position/current key position between the rest position and the end position as well as the overrunning region outside of the end position as shown in FIG. 36. In this instance, the other combination between a piece of basic positioning data [An kk xx] and an associated piece of extended positioning data [Bn 11 yy] is used for expressing a current hammer position or a current key position in the overrunning region outside of the rest position.

As will be understood, the extended positioning data follow the basic positioning data, which express a rough hammer position or rough key position, and express the offset from the rough hammer position or rough key position at a resolution higher than that of the basic positioning data. As a result, the hammer 150B or black/white key 130 is accurately located at the current hammer position on the hammer trajectory or current key position on the key trajectory.

Playback

Figure 37:
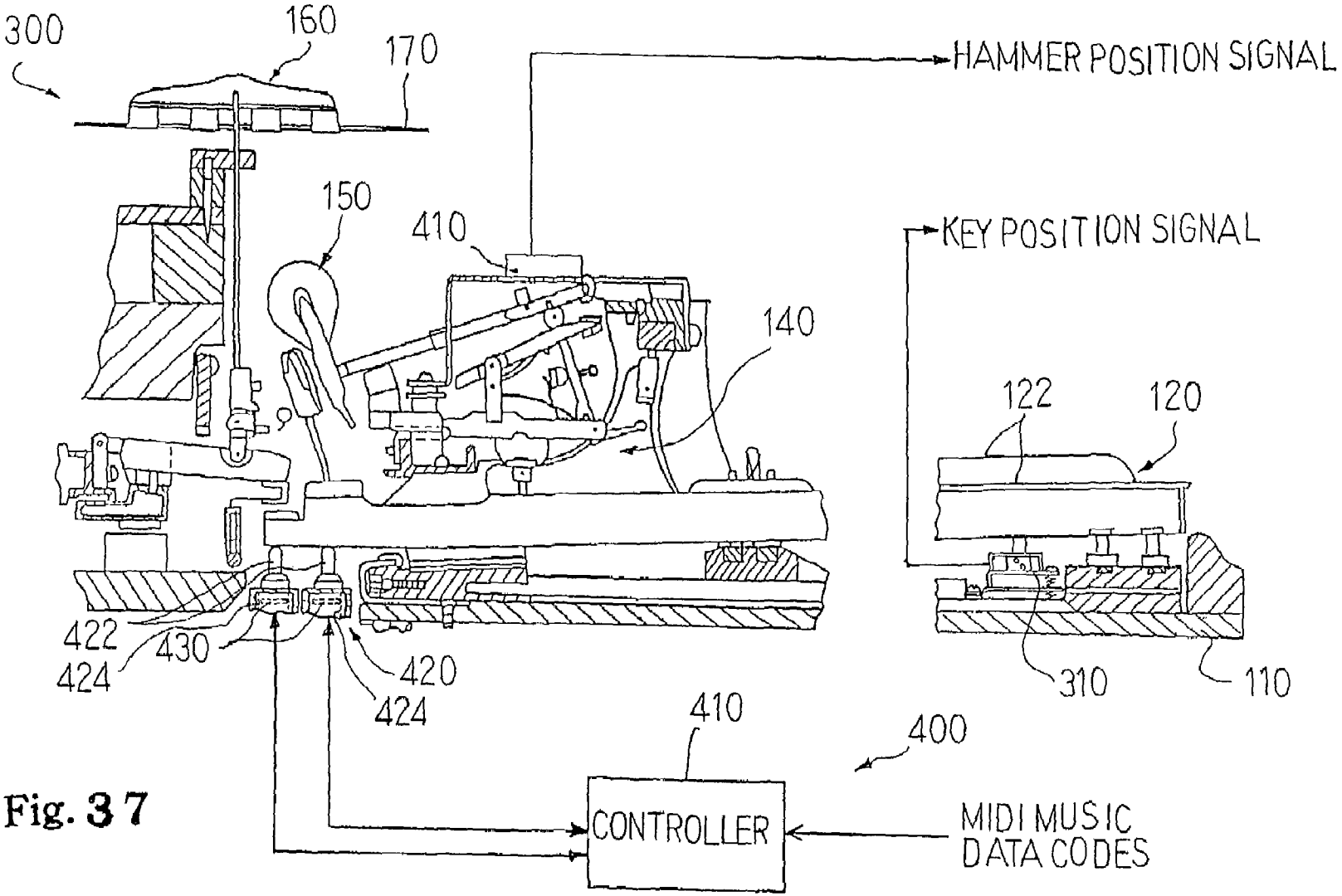
FIG. 37 is a side view showing the structure of an automatic player for reproducing a performance on the basis of a set of MIDI music data codes.

A set of MIDI music data codes, which expresses a performance, is available for an automatic player piano shown in FIG. 37. The automatic player piano is a combination between an acoustic piano 300 and an automatic playing system 400. Since the automatic player piano is equipped with the recording system 105, 105A or 105B, the hammer sensors and key sensors are illustrated in FIG. 37. The acoustic piano 300 is similar to the acoustic piano 100 so that the component parts are labeled with references same as those designating the corresponding component parts of the acoustic piano 100.

The automatic playing system 400 includes a controller 410 and an array of solenoid-operated key actuators 420 with build-in plunger sensors 430. The solenoid-operated key actuators 420 are provided under the rear portions of the black/white keys 122 of the keyboard 120, and includes respective plungers 422, respective solenoids 424 and the built-in plunger sensors 430. The plungers 422 are projectable from and retractable into the solenoids, and the built-in plunger sensors 430 monitor the associated plungers 422 so as to produce plunger position signals representative of current plunger positions or plunger stroke. The controller 410 has a data processing capability, and MIDI music data codes are supplied to the controller 410 for the playback.

The controller 410 analyzes the MIDI music data codes so as to determine plunger trajectories for the plungers 422 to be moved. When the controller 410 determines the plunger trajectory, the controller 410 supplies a driving signal to the solenoid 424. The driving signal gives rise to the magnetic field, and the magnetic force is exerted on the plunger 422. The plunger 422 starts to project from the energized solenoid 424, and pushes the rear portion of the associated black/white key 122. Thus, the solenoid-operated key actuator 420 gives rise to the key motion without any fingering of a human player. While the plunger 422 is projecting from the associated solenoid 424, the plunger sensor 430 reports the current plunger position to the controller 410, and the controller 410 periodically compares the current plunger position with the target plunger position on the plunger trajectory to see whether or not the plunger 422 is travelling on the trajectory. When the answer is positive, the controller 410 keeps the driving signal unchanged. On the other hand, if the answer is given negative, the controller 410 changes the duty ratio of the driving signal so as to force the plunger 422 exactly to trace the trajectory.

The basic positioning data and extended positioning data are used in the playback as follows. When a user instructs the controller 410 to reproduce a performance on the basis of a set of MIDI music data codes, the MIDI music data codes are transferred to the controller 410, and are stored in a working memory. The controller 410 sequentially fetches the MIDI music data codes from the working memory. When the time period ÄT, which is expressed by the duration data code, is expired, the controller starts to analyze the associated voice message.

Assuming now that the controller 410 fetches a note-on message from the working memory, the controller determines the black/white key 122 to be moved, and reads out the pieces of basic positioning data and associated pieces of extended positioning data from the working memory. The controller 410 analyzes the pieces of basic positioning data and associated pieces of extended positioning data so as to determine a target key trajectory and a target hammer trajectory on the basis of the pieces of basic positioning data/pieces of extended positioning data. The controller 410 further determines the target plunger trajectory, which gives rise to the key motion along the target key trajectory, which in turn gives rise to the hammer motion along the target hammer trajectory. Thus, the controller 410 determines the target plunger trajectory on the basis of the basic positioning data and extended positioning data. When the target plunger trajectory is determined, the controller 410 supplies the driving signal to the solenoid 424, and the driving signal gives rise to the plunger motion. While the plunger 422 is projecting from the solenoid 424, the plunger sensor 430 reports the current plunger position to the controller 410, and the controller 410 forces the plunger 422 to travel on the target plunger trajectory through the feedback control. The plunger 422 moved on the target plunger trajectory causes the associated black/white key 122 to travel on the target key trajectory, and the black/white key 122 thus moved on the target key trajectory gives rise to the hammer motion along the target hammer trajectory. Thus, the hammers 150 are moved as similar to those in the original performance. This results in the acoustic tones equal in loudness to those in the original performance.

As will be understood, the original acoustic tones are reproduced in the playback by virtue of the basic positioning data and extended positioning data. This results in the performance identical with the original performance.

Although particular embodiments of the present invention have been shown and described, it will be apparent to those skilled in the art that various changes and modifications may be made without departing from the spirit and scope of the present invention.

A hybrid keyboard musical instrument may be fabricated on the basis of an upright piano, a mute piano or a harpsichord. Moreover, the present invention is applicable to any sort of musical instrument such as, for example, a percussion instrument. An example of the percussion instrument is a celesta.

For example, the current key "position" and current hammer "position" do not set any limit to the technical scope of the present invention. The voice messages [An kk xx] and [Bn 10 yy] are available for any physical quantity representative of a moving object of a musical instrument. The voice messages [An kk xx] and [Bn 10 yy] may represent a velocity of the moving object such as, for example, the black/white key 130, hammer 160 or damper 160 at a relatively low resolution and at a relatively high resolution. Otherwise, the voice messages [An kk xx] and [Bn 10 yy] may represent an acceleration of the moving object at a relatively low resolution and a relatively high resolution.

The MIDI protocols do not set any limit to the technical scope of the present invention. Other protocols are available for expressing pieces of music to be recorded.

The status bytes [An] and [Bn] do not set any limit to the technical scope of the present invention. Other status bytes are available for the physical quantity in so far as the other status bytes are not used in the musical instruments to which the MIDI music data codes are supplied.

The value of the theoretical full hammer stroke and value of the theoretical full keystroke are mere examples. If the recorder is installed in a piano of another model, the theoretical full hammer stroke and theoretical full keystroke are different from the values described in the embodiments, and, accordingly, the increment/decrement or positive offset/negative offset are different from the values described in the embodiments.

In the above-described embodiments, the resolution outside of the rest position is equal to the resolution outside of the end position or boundary key position. This feature does not set any limit to the technical scope of the present invention. The resolution outside of the rest position may be different from the resolution outside of the end position or boundary key position.

The numerical sub-ranges from [01h] to [30h] and from [40h] to [70h] do not set any limit to the technical scope of the present invention. The numerical sub-ranges are depending upon the theoretical full keystroke/theoretical full hammer stroke and the resolution to be required. If the theoretical stroke is narrower than that of the black/white key 130 or the hammers 150, the numerical sub-ranges will be narrowed.

A piece of basic positioning data may not be accompanied with any piece of extended positioning data as labeled with references B1, B2 and B3 (see FIG. 29), and a piece of extended positioning data may not follow a piece of basic positioning data as labeled with references E1 and E2. Term "delta time" means a lapse of time from the previous event and the corresponding piece of basic positioning data or corresponding piece of extended positioning data, and symbol "ÄT" is indicative of the lapse of time. The piece of basic positioning data B1 and B2 teaches that the black/white key [kk] or hammer [kk] is to be found at the current key position [xx] or current hammer position [xx] after ÄT measured from the previous event.

Although the pieces of basic positioning data B1 and B2 roughly locate the black/white key 130 or hammer 150B on the key trajectory or hammer trajectory, such a rough expression may be allowed in a certain section of the key trajectory/hammer trajectory.

The piece of basic positioning data B3 is followed by the pieces of extended positioning data E1 and E2. The black/white key [kk] or hammer [kk] is to be found at the current key position expressed by third byte [xx] and third byte [yy] of the piece of extended positioning data E1 after ÄT measured from the previous event, and, thereafter, is to be found at the current key position expressed by the third byte [xx] and third byte [yy] of the next piece of extended positioning data E2 after ÄT measured from the previous event. The lapse of time ÄT of the piece of extended positioning data E2 is longer than the lapse of time ÄT of the piece of extended positioning data E1. Thus, the pieces of extended positioning data successively specify the current key position or current hammer position in a simple manner.

Basic data and extended data may express another sort of physical quantity such as, for example, velocity or acceleration. The velocity and acceleration are usually required for the current status of a moving object. In fact, the key motion and hammer motion are determined on the basis of not only the key position/hammer position but also key velocity/hammer velocity and key acceleration/hammer acceleration. The velocity and acceleration are calculated from the positions. The velocity or acceleration may be measured through an appropriate sensor, and the acceleration/position or position/velocity may be calculated from the velocity or acceleration.

In the embodiments described hereinbefore, when the black/white keys 130 or hammers 150/150A/150B overrun the rest positions or end positions, the resolution is lowered so as to cover the relatively long overrunning regions. However, the resolution in the overrunning regions may be higher than the resolution in the ordinary regions between the rest positions and the end positions in so far as there are many hexadecimal numbers assigned to the overrunning regions.

Claim languages are correlated with the component parts of the embodiments as follows. The black/white keys 130, the action units 140/140A/140B, hammers 150/150A/150B, dampers 160/160A/160B and strings 170/170A/170B as a whole constitute a "tone generating system". Each black/white key 130, associated action unit 140/140A/140B, associated hammer 150/150A/150B and associated damper 160/160A/160B form in combination a "link-work", and the strings 170/170A/170B as a whole constitute a "tone generating subsystem". Each pedal 182, associated link work 184 and keyboard 120 or associated damper 160/160A/160B also form in combination the "link-work". The key position signals and hammer position signals, damper position signals or jack position signals serve as "detecting signals", and "physical quantity" means the length, velocity or acceleration. The central processing unit 200, random access memory 210, read only memory 220 and timers 240, analog-to-digital converters 250*a*/250*b*/250*c* and bus system B as a whole constitute "data processing unit". The black/white key 130, hammers 150/150A/150B, dampers 160/160A/160B or jacks serve as "certain component parts".

The recording system 105/105A/105B serves as a "music data generator", and the memory unit 260/260A/260B is corresponding to a "music data source".

When the black/white keys 130 are corresponding to "component parts", the hammers 150/150A/150B serve as "other component parts". The key position signals and hammer position signals are corresponding to "detecting signals" and "other detecting signals", respectively, and, accordingly, the key positions or key stroke and hammer positions or hammer stroke are respectively corresponding to "physical quantity" and "another physical quantity".

The voice message [An kk xx] and voice message [Bn 10 yy]/[Bn 11 yy], the voice message [An kk xx] and voice messages [Bn 10 yy]/[Bn 30 yy']/[Bn 11 zz]/[Bn 31 zz'] or the voice message [An kk xx] and voice messages [Bn 10 yy]/[Bn 10 yy']/[Bn 10 yy"] are "subset of music data codes", and the third byte [xx] and third byte [yy]/[yy']/[zz]/[zz']/[yy"] have the first bit string and second bit string, respectively.

What is claimed is:

1. A musical instrument for producing tones, comprising:

a tone generating system including:

plural link-works selectively actuated for designating the pitch of said tones to be produced, each of said plural link-works having a certain component part moved in a space having an ordinary zone and a zone outside of said ordinary zone so that the certain component parts of said plural link-works have the respective spaces divisible into the respective ordinary zones and the respective zones, and a tone generating subsystem driven to produce said tones by means of said plural link works; and a recording system including:

plural sensors monitoring at least the certain component parts of said plural link-works moved in said respective spaces and producing detecting signals carrying pieces of data each representative of a physical quantity for expressing motion of said certain component parts, and a data processing unit analyzing said pieces of data for producing a set of music data codes representative of said tones produced by said tone generating system, wherein said set of music data codes includes certain music data codes each having a data field assigned to a bit string expressing said physical quantity in said ordinary zones at a resolution and in said zones at another resolution different from said resolution.

2. The musical instrument as set forth in claim 1, in which said certain music data codes are assigned a format defined in certain protocols.

3. The musical instrument as set forth in claim 2, in which said certain protocols are known as MIDI (Musical Instrument Digital Interface) protocols.

4. The musical instrument as set forth in claim 3, in which said format is defined in said MIDI protocols for another message different from the message for said physical quantity, and said another message is not used in said musical instrument.

5. The musical instrument as set forth in claim 1, in which said certain music data codes are respectively associated with other music data codes, and each of said other music data codes has another data field assigned to another bit string on which said data processing unit determines whether said resolution or said another resolution is applied to said bit string of associated one of said certain music data code.

6. The musical instrument as set forth in claim 5, in which said another bit string expresses an approximate value of said physical quantity, and said bit string expresses an offset from said approximate value.

7. The musical instrument as set forth in claim 6, in which said bit string expresses a numerical range dividable into a numerical sub-range assigned to said offset in said ordinary zone at said resolution and another numerical sub-range assigned to said offset in said zone outside of said ordinary zone at said another resolution.

8. The musical instrument as set forth in claim 6, in which said certain music data codes are assigned a format where said bit string expresses a positive offset or another format where said bit string expresses a negative offset.

9. The musical instrument as set forth in claim 1, in which said certain component parts are keys incorporated in a keyboard and selectively depressed for designating said pitch of said tones to be produced, and each of said keys tends to overrun a rest position and an end position so as to enter said zone outside of said ordinary zone between said rest position and said end position, wherein said certain music data codes are respectively associated with other music data codes each having another data field assigned to another bit string expressing an approximate value of said physical quantity, and said bit string expresses an offset from said approximate value at said resolution when said approximate value is fallen within said ordinary zone and at said another resolution when said approximate value is found at one of said rest and end positions.

10. The musical instrument as set forth in claim 1, in which said certain component parts are hammers operative to strike strings of said tone generating subsystem, and each of said hammers tends to overrun a rest position and an end position so as to enter said zone outside of said ordinary zone between said rest position and said end position, wherein said certain music data codes are respectively associated with other music data codes each having another data field assigned to another bit string expressing an approximate value of said physical quantity, and said bit string expresses an offset from said approximate value at said resolution when said approximate value is fallen within said ordinary zone and at said another resolution when said approximate value is found at one of said rest and end positions.

11. A musical instrument for producing tones, comprising:

a tone generating system including:

plural link-works selectively actuated for designating the pitch of said tones to be produced, and having respective component parts and respective other component parts moved in a space having an ordinary zone and a zone outside of said ordinary zone so that the certain component parts of said plural link-works have the respective spaces divisible into the respective ordinary zones and the respective zones, and a tone generating subsystem driven to produce said tones by means of said plural link works; and a recording system including plural sensors monitoring said component parts and said other component parts of said plural link-works moved in said respective spaces and producing detecting signals carrying pieces of first data each representative of a physical quantity for expressing motion of said component parts and other detecting signals carrying pieces of second data each representative of another physical quantity for expressing motion of said other certain component parts, and a data processing unit analyzing said pieces of first data and said pieces of second data for producing a set of music data codes representative of said tones produced by said tone generating system, wherein said set of music data codes includes certain music data codes each having a data field assigned to a bit string, a numerical range of which is dividable into at least two numerical ranges expressing said physical quantity and said another physical quantity, respectively.

12. The musical instrument as set forth in claim 11, in which said certain music data codes are assigned a format defined in certain protocols.

13. The musical instrument as set forth in claim 12, in which said certain protocols are known as MIDI (Musical Instrument Digital Interface) protocols.

14. The musical instrument as set forth in claim 13, in which said format is defined in said MIDI protocols for another message different from the message for said physical quantity, and said another message is not used in said musical instrument.

15. The musical instrument as set forth in claim 11, in which said set of music data codes further includes other music data codes respectively associated with said certain music data codes, and each of said certain music data codes and each of said other music data codes have a bit string expressing an approximate value of said physical quantity or an approximate value of said another physical quantity and another bit string expressing an offset from said approximate value, respectively.

16. The musical instrument as set forth in claim 15, in which said another bit string expresses a numerical range dividable into a numerical sub-range expressing said offset in an ordinary zone at a resolution and another numerical sub-range expressing said offset in a zone outside of said ordinary zone at another resolution lower than said resolution.

17. The musical instrument as set forth in claim 11, in which said component parts and said other component parts are keys of a keyboard selectively depressed for designating said pitch of said tones to be produced and hammers driven for rotation in order to strike strings of said tone generating subsystem for producing said tones at the designated pitch.

18. A musical instrument for producing tones, comprising:

a tone generating system including:

plural link-works selectively actuated for designating the pitch of said tones to be produced, each of said plural link-works having a certain component part moved in a space having an ordinary zone and a zone outside of said ordinary zone so that the certain component parts of said plural link-works have the respective spaces divisible into the respective ordinary zones and the respective zones, and a tone generating subsystem driven to produce said tones by means of said plural link works; and a recording system including:

plural sensors monitoring at least the certain component parts of said plural link-works moved in said respective spaces and producing detecting signals carrying pieces of data each representative of a physical quantity for expressing motion of said certain component parts, and a data processing unit analyzing said pieces of data for producing a set of music data codes representative of said tones produced by said tone generating system, wherein said set of music data codes includes plural subsets of music data codes representative of said physical quantity, each subset of music data codes having a first bit string roughly expressing said physical quantity and a second bit string precisely expressing said physical quantity.

19. The musical instrument as set forth in claim 18, in which said first bit string and said second bit string respectively form a part of a music data code of each subset assigned a format defined in certain protocols and a part of another music data code of said each subset assigned another format defined in said certain protocols.

20. The musical instrument as set forth in claim 19, in which said certain protocols are known as MIDI (Musical Instrument Digital Interface) protocols.

21. The musical instrument as set forth in claim 20, in which said format and said another format are defined in said MIDI protocols for other messages different from the messages for said physical quantity, and said other messages are not used in said musical instrument.

22. The musical instrument as set forth in claim 18, in which said first bit string and said second bit string respectively express an approximate value of said physical quantity and an offset from said approximate value.

23. The musical instrument as set forth in claim 22, in which said certain component parts tend to overrun respective end positions and respective rest position, and said second bit string expresses said offset at a relatively high resolution when said first bit string expresses said physical quantity between said end positions and said rest positions and at relatively low resolution when said first bit string expresses said physical quantity at said rest positions and said end positions.

24. The musical instrument as set forth in claim 23, in which said certain component parts are keys incorporated in a keyboard and selectively depressed for designating said pitch of said tones to be produced.

25. The musical instrument as set forth in claim 23, in which said certain component parts are hammers operative to strike strings of said tone generating subsystem.

* * * * *